US012800256B2

(12) United States Patent
Pestrue et al.

(10) Patent No.: US 12,800,256 B2
(45) Date of Patent: Nov. 17, 2026

(54) CROSSBOW CRANK AND RELATED METHOD OF USE

(71) Applicant: Killer Instinct, Inc., Milwaukee, WI (US)

(72) Inventors: Jeffrey A. Pestrue, St. Louis, MI (US); David McNeil, Grant, MI (US)

(73) Assignee: Killer Instinct, Inc., Frankenmuth, MI (US)

( * ) Notice: Subject to any disclaimer, the term of this patent is extended or adjusted under 35 U.S.C. 154(b) by 199 days.

(21) Appl. No.: 18/767,264

(22) Filed: Jul. 9, 2024

(65) Prior Publication Data

US 2025/0257977 A1 Aug. 14, 2025

Related U.S. Application Data

(63) Continuation-in-part of application No. 18/441,530, filed on Feb. 14, 2024, now Pat. No. 12,546,557.

(51) Int. Cl.

| | |
|---|---|
| ***F41B 5/18*** | (2006.01) |
| ***F41B 5/12*** | (2006.01) |
| ***F41B 5/14*** | (2006.01) |

(52) U.S. Cl.

CPC ..... *F41B 5/1469* (2013.01); *F41B 5/123* (2013.01)

(58) Field of Classification Search

CPC ..... F41B 5/1469; F41B 5/123; F41B 5/12
See application file for complete search history.

(56) References Cited

U.S. PATENT DOCUMENTS

| | | | |
|---|---|---|---|
| 3,043,287 | A | 7/1962 | Nelson |
| 3,625,324 | A | 12/1971 | Scharf |
| 3,670,711 | A | 6/1972 | Firestone |
| 3,731,774 | A | 5/1973 | Kitchin |
| 3,739,765 | A | 6/1973 | Moore |
| 4,130,191 | A | 12/1978 | Judd et al. |
| 4,192,281 | A | 3/1980 | King |
| 4,649,892 | A | 3/1987 | Bozek |
| 4,662,345 | A | 5/1987 | Stephens |
| 4,665,885 | A | 5/1987 | Glomski et al. |
| 4,719,897 | A | 1/1988 | Gaudreau |
| 4,721,092 | A | 1/1988 | Waiser |
| 4,942,861 | A | 7/1990 | Bozek |
| 5,115,795 | A | 5/1992 | Farris |
| 5,205,267 | A | 4/1993 | Burdick |

(Continued)

OTHER PUBLICATIONS

EZ Crossbow Silent Crank (https://www.beararchery.com/collections/hunting-crossbows/products/bear-x-ez-crossbow-silent-crank), downloaded Feb. 2, 2024.

*Primary Examiner* — John E Simms, Jr.
(74) *Attorney, Agent, or Firm* — Warner Norcross + Judd LLP

(57) ABSTRACT

A crossbow crank can comprise a drive shaft selectively coupled to a one-way bearing that allows rotation of the drive shaft and an associated spool in a first direction and impairs rotation of the drive shaft and the spool in a second direction. The drive shaft can be automatically locked and unlocked relative to the one-way bearing, allowing the bearing to control operation of the drive shaft, via an axially compressible brake. The crossbow crank can be in the form of a removeable and replaceable module that can be positioned on right or left sides of a crossbow for right or left sided operation. A related method of use is provided.

16 Claims, 30 Drawing Sheets

(56) References Cited

U.S. PATENT DOCUMENTS

| | | | | |
|---|---|---|---|---|
| 5,215,069 | A | 6/1993 | Liu | |
| 5,220,906 | A | 6/1993 | Choma | |
| 5,243,956 | A | 9/1993 | Luehring | |
| 5,437,260 | A | 8/1995 | King | |
| 5,553,596 | A | 9/1996 | Bednar | |
| 5,598,829 | A | 2/1997 | Bednar | |
| 5,649,520 | A | 7/1997 | Bednar | |
| 5,660,159 | A | 8/1997 | Clayton | |
| 5,678,528 | A | 10/1997 | Hadley | |
| 5,987,724 | A | 11/1999 | Kleman | |
| 6,095,128 | A | 8/2000 | Bednar | |
| 6,286,496 | B1 | 9/2001 | Bednar | |
| 6,799,566 | B1 | 10/2004 | Malucelli | |
| 6,874,491 | B2 | 4/2005 | Bednar | |
| 6,913,007 | B2 | 7/2005 | Bednar | |
| 7,100,590 | B2 | 9/2006 | Chang | |
| 7,284,745 | B2 | 10/2007 | Keane et al. | |
| 7,624,725 | B1 | 12/2009 | Choma | |
| 7,784,453 | B1 | 8/2010 | Yehle | |
| 8,375,928 | B1 | 2/2013 | Bednar | |
| 8,443,790 | B2 | 5/2013 | Pesture | |
| 8,695,945 | B2 | 4/2014 | Guyard | |
| 8,807,311 | B2 | 8/2014 | Lin | |
| 8,950,385 | B1 | 2/2015 | Khoshnood | |
| 9,341,434 | B2 | 5/2016 | McPherson et al. | |
| 9,383,159 | B2 | 7/2016 | Pulkrabek et al. | |
| 10,260,835 | B2 | 4/2019 | Pulkrabek et al. | |
| 10,421,637 | B1 * | 9/2019 | Huang | F41B 5/123 |
| 10,502,518 | B2 | 12/2019 | McPherson et al. | |
| 10,996,018 | B1 | 5/2021 | Kempf et al. | |
| 11,002,505 | B1 | 5/2021 | Shaff et al. | |
| 11,009,310 | B1 | 5/2021 | Shaffer et al. | |
| 11,221,191 | B2 | 1/2022 | Bednar et al. | |
| 11,236,963 | B2 | 2/2022 | Bednar et al. | |
| 11,236,964 | B2 | 2/2022 | Bednar et al. | |
| 11,346,632 | B1 * | 5/2022 | Kempf | F41B 5/1449 |
| 11,359,882 | B1 | 6/2022 | Chang | |
| 11,428,498 | B2 | 8/2022 | McPherson et al. | |
| 11,774,210 | B1 * | 10/2023 | Chang | F41B 5/1469 124/25 |
| 12,379,180 | B1 * | 8/2025 | Kempf | F41B 5/1469 |
| 2003/0089359 | A1 * | 5/2003 | Bednar | F41B 5/123 124/25 |
| 2009/0277435 | A1 * | 11/2009 | Pestrue | F41B 5/12 124/1 |
| 2010/0170486 | A1 | 7/2010 | Shepley et al. | |
| 2010/0170488 | A1 | 7/2010 | Rasor et al. | |
| 2012/0167710 | A1 | 7/2012 | Giudici | |
| 2015/0040883 | A1 * | 2/2015 | McPherson | F41B 5/123 124/88 |
| 2019/0011212 | A1 * | 1/2019 | Shaffer | F41B 5/12 |
| 2021/0222987 | A1 | 7/2021 | Yehle | |
| 2021/0309497 | A1 * | 10/2021 | Blosser | B66D 1/20 |
| 2021/0348872 | A1 * | 11/2021 | Bednar | F41B 5/123 |
| 2022/0155039 | A1 * | 5/2022 | Walthert | F41B 5/1469 |
| 2023/0288168 | A1 | 9/2023 | Bednar et al. | |
| 2024/0418474 | A1 * | 12/2024 | Polanich | F41B 5/1469 |
| 2025/0257976 | A1 * | 8/2025 | Pestrue | F41B 5/1469 |

* cited by examiner

CROSSBOW CRANK AND RELATED METHOD OF USE

BACKGROUND OF THE INVENTION

The present invention relates to archery crossbows, and more particularly to crossbow cocking and/or de-cocking systems.

Crossbows have been used throughout the centuries for hunting, fishing, and target shooting. Crossbows typically include a stock joined with a rail, upon which a bolt or an arrow is placed. A pair of bow limbs are mounted at an end of the rail and a bowstring is strung between the limbs over the rail for engagement with the bolt or arrow. Sometimes, the crossbow includes cams on the bow limbs that receive the bowstring and one or more power cables to increase stored energy. The crossbow also can include a trigger mechanism adjacent the rail operable to hold the bowstring and to release the bowstring to fire the crossbow, thereby shooting an arrow or bolt from the crossbow.

The bowstring of a crossbow usually is movable from an undrawn or un-cocked position to a drawn or cocked position. In the cocked position, the trigger mechanism secures the bowstring in a fixed, stationary position relative to the rail. When the bowstring is drawn from the undrawn position to the drawn position, this is referred to as cocking the crossbow. Sometimes, however, a user will want to convert the crossbow bowstring from the drawn position to the undrawn position without shooting a bolt or arrow. This cannot be done safely by simply removing the bolt or arrow and actuating the trigger mechanism to release the bowstring because the stored energy in the crossbow would damage or destroy the components of the crossbow, and potentially can injure the user. Accordingly, the user may desire to de-cock the crossbow by letting down the bowstring to the undrawn position. There are multiple conventional methods and systems for de-cocking a crossbow, however, many of them incorporate complicated, additional mechanical components in the trigger mechanism and/or require a complex sequence of steps to de-cock the crossbow.

Further, as mentioned above, the bowstring of a crossbow usually is movable from an undrawn or un-cocked position to a drawn or cocked position. Movement of the bowstring can be accomplished via a cord or rope being attached to the sled and pulled manually by a user. Alternatively, movement can be accomplished via a winch attached to the crossbow, typically rearward of the trigger assembly. Recently, due to higher draw weights on crossbows to improve speed, more and more crossbows are offered with a winch. Although these winches are helpful to draw a crossbow, they can be complicated to operate and control when a user wants to use such winch to de-cock a crossbow. This can discourage users from utilizing such winches, in which case the user may simply shoot the crossbow to return it to the undrawn state. Further, increased complexity in operation of the winch to de-cock a crossbow can lead to operator error, such as inadvertent release of the bowstring in a dry fire event, or a lock-up of the winch in some cases.

Accordingly, there remains room for improvement in the field of crossbows, and in particular systems and components to facilitate safe and reliable cocking and/or de-cocking of crossbows.

SUMMARY OF THE INVENTION

A crossbow can include a de-cocking system to allow a bowstring to be transitioned from a drawn mode to an undrawn mode and thereby de-cock the crossbow.

A crossbow can include a crossbow crank to cock and/or de-cock the crossbow.

In one embodiment, the de-cocking system can include a sled that engages the bowstring to draw the bowstring to a drawn mode and/or let down the bowstring to the undrawn mode during a de-cocking operation.

In another embodiment, the sled can include a stop that prevents the sled or bowstring from engaging a safety and/or interfering with transition of the safety from a safety on mode to a safety off mode.

In still another embodiment, the safety can be manually actuated from the safety on mode to the safety off mode while the sled is used to de-cock the bowstring. With the safety in the off mode, upon actuation of a trigger assembly, the sled can assist transition of the bowstring to the undrawn mode, for example, by letting down the bowstring from the drawn mode to the undrawn mode during a de-cocking operation.

In yet another embodiment, the stop can be modifiable, such that the sled can be used in both the de-cocking operation, as well as a drawing operation in which the sled transitions the bowstring from the undrawn mode to the drawn mode. Where modifiable, the stop of the sled can be operable in both a neutral mode in which the stop does not interfere with rearward movement of the sled so that the bowstring can move to the drawn mode, and in a de-cocking mode in which the stop interferes with movement of the sled along the frame so that the sled is prevented from engaging the bowstring against the safety, which faces a catch of the trigger assembly, while the safety remains in the safety on mode.

In even another embodiment, the stop in the de-cocking mode can allow a user to manually move the safety to the safety off mode, and subsequently activate the trigger assembly so that the bowstring can be let down from the drawn mode to the undrawn mode with the sled engaging the bowstring as the letting down occurs.

In a further embodiment, the trigger assembly can be joined with the frame and can include a catch that is operable in a holding mode in which the catch retains the bow string in the holding mode and a drop mode that releases the bowstring to the undrawn mode. The trigger assembly can include a sear operable in a cocked mode that retains the catch in the holding mode and a fire mode that allows the catch to move to the drop mode to release the bowstring, for example, when the crossbow shoots a bolt or when the crossbow undergoes a de-cocking operation.

In still a further embodiment, the trigger assembly can include a trigger coupled to the sear. The sled can remain distal from, disengaged from, and/or out of contact with the safety in the de-cocking mode. The safety can be manually moveable in the de-cocking mode to transition the safety from the safety on mode to the safety off mode so that the sear is operable in the fire mode when the trigger is moved, whereby the catch can move to the drop mode to release the bowstring.

In yet a further embodiment, the crossbow can include an anti-dry fire element moveable between a lockout position that prevents the safety from moving from the safety on mode to the safety off mode, and an open position that permits the safety to move to the safety off mode. Where the anti-dry fire element is included in the crossbow, the sled can include a protrusion that moves the anti-dry fire element to the open position when the sled is adjacent the trigger assembly, such that the safety can subsequently be converted to the safety off mode.

In even a further embodiment, the sled can include a guide that moves along the frame when the sled engages the bowstring. The sled can include a bowstring engager configured to receive the bowstring during movement of the bowstring to the drawn mode with the sled.

In another embodiment, the stop can be in the form of a first stop including a first flange and a first pivot axis about which the first flange is selectively pivotable. The first flange can include a first engagement surface. A stop engagement surface or stop limiter can be disposed adjacent the trigger assembly. The first engagement surface can contact the stop engagement surface or limiter in the de-cocking mode in which the first stop arrests movement of the sled.

In still another embodiment, the sled can include the first stop and a second stop. The second stop can include a second flange and a second pivot axis about which the second flange is selectively pivotable. The second flange can include a second engagement surface. The second engagement surface can contact the stop engagement surface distal from the first stop in the de-cocking mode, thereby assisting in arresting movement of the sled during a de-cocking operation.

In yet another embodiment, the frame can include a rail. The first stop and first flange can be mounted on a first side of the rail. The second stop and second flange can be mounted on the second side of the rail, opposite the first flange. The first flange and the second flange can be configured to simultaneously engage the limiter or a stop engagement surface thereof in the de-cocking mode.

In even another embodiment, a method is provided. The method can include pulling on a bowstring that is in a drawn mode with a sled including a stop, so the stop engages a limiter on the crossbow and ceases movement of the sled and stop relative to a frame of the crossbow in a de-cocking mode, leaving a first distance between the bowstring and a safety, without the sled and stop engaging the safety; moving the safety toward the bowstring to reduce the first distance to a second distance between the bowstring and the safety, the second distance being less than the first distance; pulling a trigger so that a catch disengages the bowstring; and transitioning the bowstring to an undrawn mode while the sled engages the bowstring to de-cock the crossbow.

In a further embodiment, the method can include manually engaging the safety to slide the safety in a slot so that a forward face of the safety moves toward the bowstring without engaging the bowstring during the moving step. This movement can occur without any part of the sled or its components engaging the safety.

In still a further embodiment, the method can include transitioning the stop from the de-cocking mode to a neutral mode by rotating the stop toward another stop on the sled after the crossbow is de-cocked and the bowstring is in the undrawn mode; and drawing the bowstring from the undrawn mode to the drawn mode while the stop is in the neutral mode.

In another embodiment, the crossbow can include a crossbow crank comprising a drive shaft selectively coupled to a one-way bearing that allows rotation of the drive shaft and an associated spool in a first direction and impairs rotation of the drive shaft and the spool in a second direction.

In still another embodiment, the drive shaft can be automatically locked and unlocked relative to the one-way bearing, allowing the bearing to control operation of the drive shaft, via a brake.

In yet another embodiment, the brake can be axially compressible along the drive shaft to automatically lock the drive shaft and a sleeve, so they are fixed relative to one another and rotate in unison when the drive shaft is rotated in the first direction. The brake can be deactivated by operation of a crank so that the drive shaft can rotate freely relative to the sleeve and thus the bearing in a second direction.

In even another embodiment, a crossbow crank can comprise: a sleeve disposed in a one-way bearing; a drive shaft extending through the sleeve; a drive gear joined with the drive shaft, so the drive gear and drive shaft rotate in unison; a spool coupled to the drive gear, the spool configured to engage a cord; and a crank joined with the drive shaft. The sleeve and drive shaft can automatically lock to one another upon actuation of the crank to rotate the drive shaft in the first direction, so that the sleeve and drive shaft rotate in unison. The sleeve and drive shaft can automatically unlock from one another upon actuation of the crank to rotate the drive shaft in the second direction, so that the drive shaft rotates freely relative to the sleeve.

In a further embodiment, the crossbow crank can include a brake mounted along the drive shaft. The brake can be axially compressible along the drive shaft to lock the drive shaft and the sleeve with one another when the drive shaft is rotated in the first direction. This locking can occur automatically when the crank is manually actuated or rotated.

In still a further embodiment, the crossbow crank can include a drive nut. The hand crank can be joined with the drive nut. A brake can be disposed along the drive shaft. The drive nut can be threadably joined with the drive shaft. Manual rotation of the crank in the first direction can tighten the drive nut on the drive shaft so that the drive nut axially compresses the sleeve and the brake between the drive nut and the drive gear so that the drive shaft and sleeve automatically lock to one another upon manual actuation of the crank. Accordingly, the sleeve and drive shaft can rotate in unison in the first direction. The sleeve and drive shaft however, can be impaired from rotating in a second direction opposite the first direction.

In yet a further embodiment, manual rotation of the crank in a second direction opposite the first direction can loosen the drive nut on the drive shaft so that the drive nut decompresses or no longer axially compresses the sleeve and the brake between the drive nut and the drive gear. Accordingly, the drive shaft and sleeve automatically unlock from one another upon manual actuation of the crank in the second direction. As a result, the brake no longer holds the sleeve and shaft relative to one another, so the one-way bearing no longer impairs rotation of the drive shaft in the second direction, so the drive shaft and other components such as the spool can rotate in the second direction, optionally unwinding a cord from the spool to de-cock the bowstring when the crank is secured to the bowstring directly or via a sled, such as the one described herein.

In even a further embodiment, the brake can be mounted along the drive shaft and can comprise a first brake collar; a second brake collar; and a brake disc mounted between the first and second brake collars. The brake can be axially compressible along a longitudinal axis of the drive shaft so that the first brake collar, second brake collar and brake disc frictionally engage one another. The second brake collar can be joined with the drive shaft in a nonrotatable manner.

In a further embodiment, the crossbow crank can include a secondary gear rotatable in response to the drive gear and a secondary shaft joined with the secondary gear so that the secondary gear and secondary shaft rotate in unison. The secondary shaft can be offset and/or parallel to the drive shaft. The spool can be fixedly and non-rotatably mounted to the secondary shaft. In some cases, the secondary gear is the only gear on the secondary shaft, and the drive gear can be the only gear on the drive shaft.

In even a further embodiment, the crossbow crank can be in the form of a removeable and replaceable module that can be positioned on a left or a right side of a crossbow for left or right sided operation by a user. The module can be joined with a frame of the crossbow and can interface with one or more spool gears on which a cord can be wound to move a sled or a moving receiver.

In yet a further embodiment, the crossbow crank module can be fastened to the frame with fasteners, which can be removed to remove and swap the module from one side to another of the frame to allow for right or left side cranking by a user.

In another embodiment, a crossbow is provided including a first limb and a second limb; a bowstring extending between the first limb and the second limb; a crossbow frame extending rearward from the first limb and the second limb, the crossbow frame including a transverse crank mounting hole extending from a first surface to an opposing second surface; and a crank module comprising a sleeve disposed in a one-way bearing, a drive shaft extending through the sleeve, and a drive gear, the crank module extending through the transverse crank mounting hole in a first orientation. The crank module can be removeable and replaceable relative to the crossbow frame in a second orientation opposite the first orientation.

In still another embodiment, a crossbow crank can include a sleeve disposed in a one-way bearing; a drive shaft extending through the sleeve and configured to extend within the transverse crank mounting hole; a first drive gear joined with the drive shaft so the first drive gear and drive shaft rotate in unison, the first drive gear configured to engage a first secondary gear joined with a spool in the crossbow frame; and a crank joined with the drive shaft. In some applications, the sleeve, one way bearing, and drive shaft are removable from the transverse crank mounting hole together in unison in the form of a crank module. The crank module can be configured to be reversed and reinstalled in the transverse crank mounting hole in an opposite direction. The crank module can be selectively mountable relative to the crossbow frame on either a right side or a left side of the crossbow frame to provide a user with the ability to operate the crossbow crank with a crank arm in a draw mode from the right side or the left side of the crossbow frame.

In yet another embodiment, the crossbow crank can include a housing configured to be removably joined with a first surface of the crossbow frame and a mounting plate configured to be removably joined with a second surface of the crossbow frame, the second surface opposite the first surface. The drive shaft can extend through the transverse crank mounting hole defined by the crossbow frame such that the drive shaft protrudes beyond the first surface and the second surface. The housing and mounting plate can be reversed so that the housing is able to be removably joined with the second surface and the mounting plate is able to be removably joined with the first surface.

In even another embodiment, a second drive gear is joined with the drive shaft. The crank module can be mountable in a first direction in the transverse crank mounting hole, such that the first drive gear is configured to engage a first secondary gear joined with a spool in the crossbow frame, and such that the second drive gear is configured to engage a secondary gear joined with the spool in the crossbow frame. The crank module can be reversed and reinstalled in the opposite direction to the first direction in the transverse crank mounting hole, such that the first drive gear is configured to engage a second secondary gear joined with a spool in the crossbow frame, and such that the second drive gear is configured to engage the first secondary gear joined with the spool in the crossbow frame.

In still a further embodiment, a method of using a crossbow is provided. The method can comprise: rotating in a first direction a shaft fixedly joined with a gear in a housing, the gear being rotatably coupled to a spool so that the spool winds a cord thereon; and axially compressing a brake along the shaft during and as a result of said rotating in the first direction to fixedly join the shaft with a sleeve disposed around the shaft so that the shaft, gear and sleeve rotate in unison. The sleeve can be disposed in a one-way bearing that is joined with the housing so that when said rotating in the first direction ceases, the shaft and gear can be impaired from rotating in a second direction opposite the first direction via the one-way bearing interacting with the sleeve.

In yet a further embodiment, the method can comprise rotating the shaft in the first direction; and rotating the shaft in the second direction via manual input. The shaft can free spin relative to the sleeve during said rotating in the second direction so that the one-way bearing does not impair rotation of the shaft in the second direction.

In even a further embodiment, the method can comprise ceasing rotating the shaft in the second direction via manual input. A tension in the cord can automatically urge the shaft to rotate in the second direction after said ceasing which causes axial compression of the brake along the shaft. Accordingly, the shaft and gear can again be impaired from rotating in the second direction via the one-way bearing interacting with the sleeve.

In another embodiment, a crank arm can be joined with the shaft via a threaded drive nut threaded to the shaft. A tension in the cord can automatically urge the shaft to rotate in the second direction to tighten the threaded drive nut relative to the shaft. This can push or move the sleeve relative to the brake whereby the shaft and gear again can be impaired from rotating in the second direction opposite the first direction via the one-way bearing interacting with the sleeve.

In still a further embodiment, the crossbow crank and the de-cocking system having a sled with one or more stops both can be incorporated into a crossbow. The crank can be used to draw the bowstring from the released mode to the drawn mode with the sled via one or more cords extending between the crank and the sled and let down the crossbow from the drawn mode to the released mode.

In yet a further embodiment, the crank can move the sled so the one or more stops when in the de-cocking mode, engage the stop engagement surface on the frame and/or a mounting arm of the crossbow, or some other portion of the crossbow, to arrest movement of the sled and thus the bowstring so the bowstring and/or sled do not engage the safety, allowing the safety to move from the safety on mode to the safety off mode. The one-way bearing of the crank can hold the drive shaft and drive gear, preventing them from moving or rotating in the second direction in the de-cocking mode.

In even a further embodiment, the safety can be converted to the safety off mode, and the trigger assembly can be actuated such that the sear converts to the fire mode, and the catch to the drop mode so that the catch no longer holds the bowstring in the drawn mode, and such that the bowstring is free to convert to the released mode but for the sled being held by the crank via the one or more cords extending therebetween. Again, the crank can hold the bowstring in the drawn mode via the one-way crank interacting with the sleeve and the drive shaft that are coupled or locked to one another, and nonrotatable relative to one another.

In another embodiment, the crank arm can be rotated in the second direction by a user, thereby releasing the sleeve from the drive shaft, such that the drive shaft can rotate relative to the one-way bearing in the second direction, which can allow the cord to spool off a spool coupled to the drive shaft via a secondary shaft and secondary gear. The user can controllably let down the bow string by continuing to rotate the crank arm in the second direction.

In still another embodiment, when rotation of the crank arm ceases, the tension on the cord by the bowstring during the transition to the released mode causes the drive shaft and sleeve to automatically lock rotationally relative to one another, and urge these temporarily secured components to attempt to rotate in the second direction, however, due to the sleeve interacting with the one-way bearing, these components are impaired from rotating in the second direction, in which case, the sled attached to the one or more cords cannot move away from the crossbow crank, and the bowstring is prevented from letting down any farther toward the released mode or configuration.

In yet another embodiment, a method is provided. The method can include removing a crank module from a first surface of a crossbow frame defining a crank mounting hole, the crank module comprising a sleeve disposed in a one-way bearing, a drive shaft extending through the sleeve, and a drive gear configured to rotatably couple with a spool rotatably mounted inside the crossbow frame; and installing the crank module through a second surface of the crossbow frame opposite the first surface so that the crank module extends through the crank mounting hole.

In even another embodiment, the method can include removing a housing within which the drive shaft extends from the first surface of the crossbow frame; removing a mounting plate from the second surface of the crossbow frame; securing the mounting plate to the first surface of the crossbow frame; securing the housing to the second surface of the crossbow frame.

In another embodiment, the method can include disengaging the drive gear from a first secondary gear joined with the spool during said removing; and engaging the drive gear with a second secondary gear joined with the spool during said installing, the second secondary gear being distal from the first secondary gear.

The current embodiments provide a crossbow and method for efficiently and safely drawing and de-cocking the crossbow.

These and other objects, advantages, and features of the invention will be more fully understood and appreciated by reference to the description of the current embodiment and the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DETAILED DESCRIPTION OF THE CURRENT EMBODIMENTS

Figure 1:
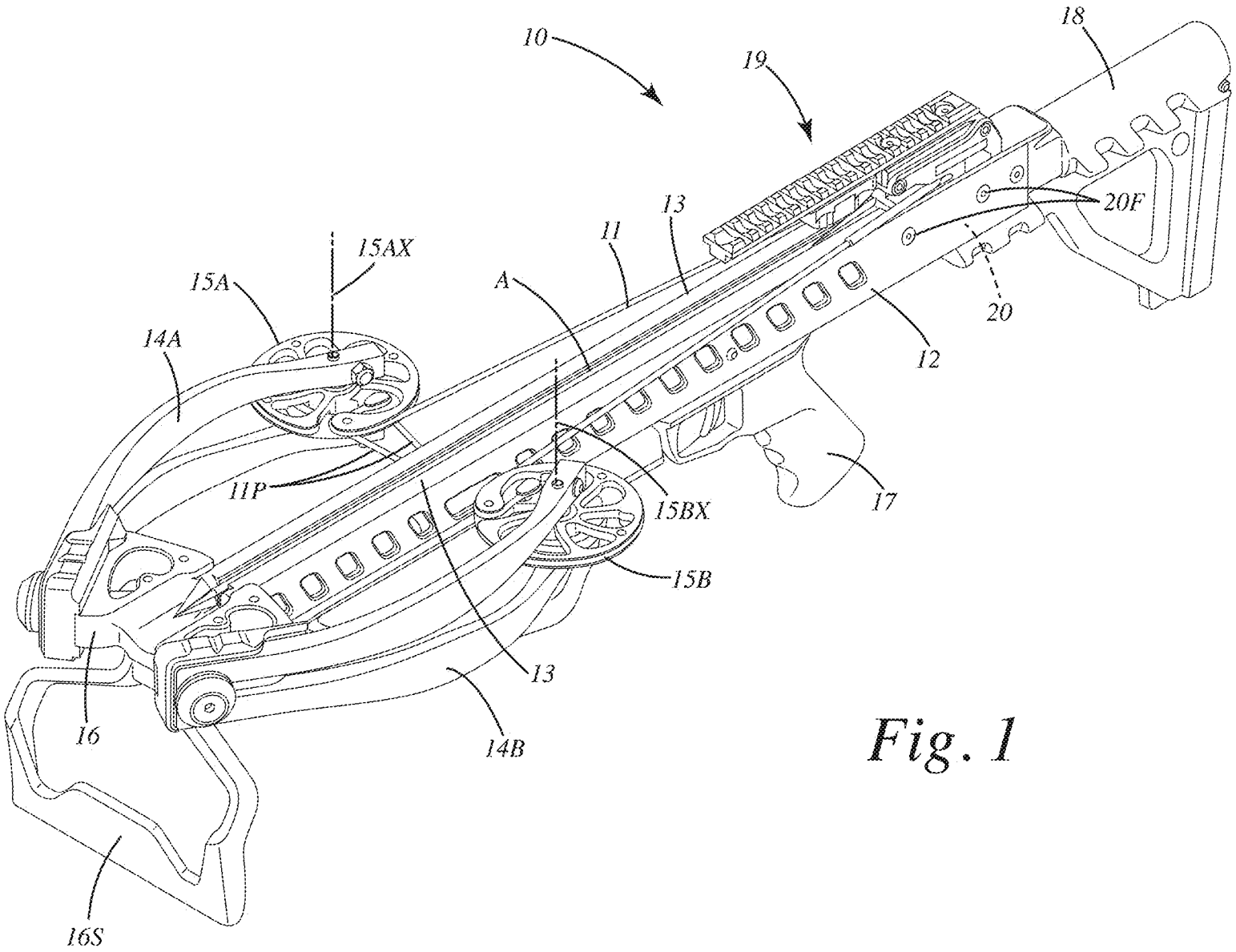
FIG. 1 is a perspective view of the crossbow of a current embodiment.

A current embodiment of the crossbow with a de-cocking system and a crossbow crank is shown in FIGS. 1-12 and generally designated 10. The crossbow 10 shown in FIG. 1 is shown as an archery crossbow. It will be appreciated that the de-cocking system and crossbow crank as described herein can be used with any type of projectile shooting device that uses or shoots an arrow, bolt, or other projectile. As used herein an arrow can refer to an arrow, a bolt, or some other elongated projectile. As generally shown in FIG. 1, the crossbow 10 is shown with its bowstring 11 in a drawn mode, held in place by a trigger assembly 20 that is mounted within a barrel or frame 12 of the crossbow. The bowstring 11 can be selectively released via the trigger assembly 20 to shoot the arrow A from the crossbow. As the crossbow transitions and the bowstring moves from the drawn mode shown in FIG. 1, to an undrawn mode or released mode, which are used interchangeably herein, the bowstring 11 moves forward until it extends generally perpendicular to the frame 12 and the rail 13 upon which the arrow A rests or moves as it is propelled by the bowstring.

As shown in FIG. 1, the crossbow 10 can include a first limb 14A and a second opposing limb 14B disposed that opposite sides of the barrel or frame 12 and the rail 13. To each of these respective limbs 14A and 14B, respective cams 15A and 15B can be joined. These cams 15A and 15B can be any type of cam, pulley, disc and/or round or oval member capable of rotating about the respective axes 15AX and 15BX. To these respective cams, the bowstring 11 can be joined and journaled in respective tracks of the cams. The bowstring generally can unwind or unfurl from the respective cams on opposing sides of the frame when moving from an undrawn mode, also referred to as a released mode herein, to a drawn mode or cocked mode as shown in FIG. 1. Generally, the bowstring can extend transverse to the frame and rail, between the respective cams in most if not all of these modes. Further, power cables 11P can be joined with and extend from one cam 15A to the other cam 15B to transfer energy stored in the limbs 14A and 14B in a conventional manner to the bowstring 11 to shoot the arrow A from the crossbow 10.

Figure 4:
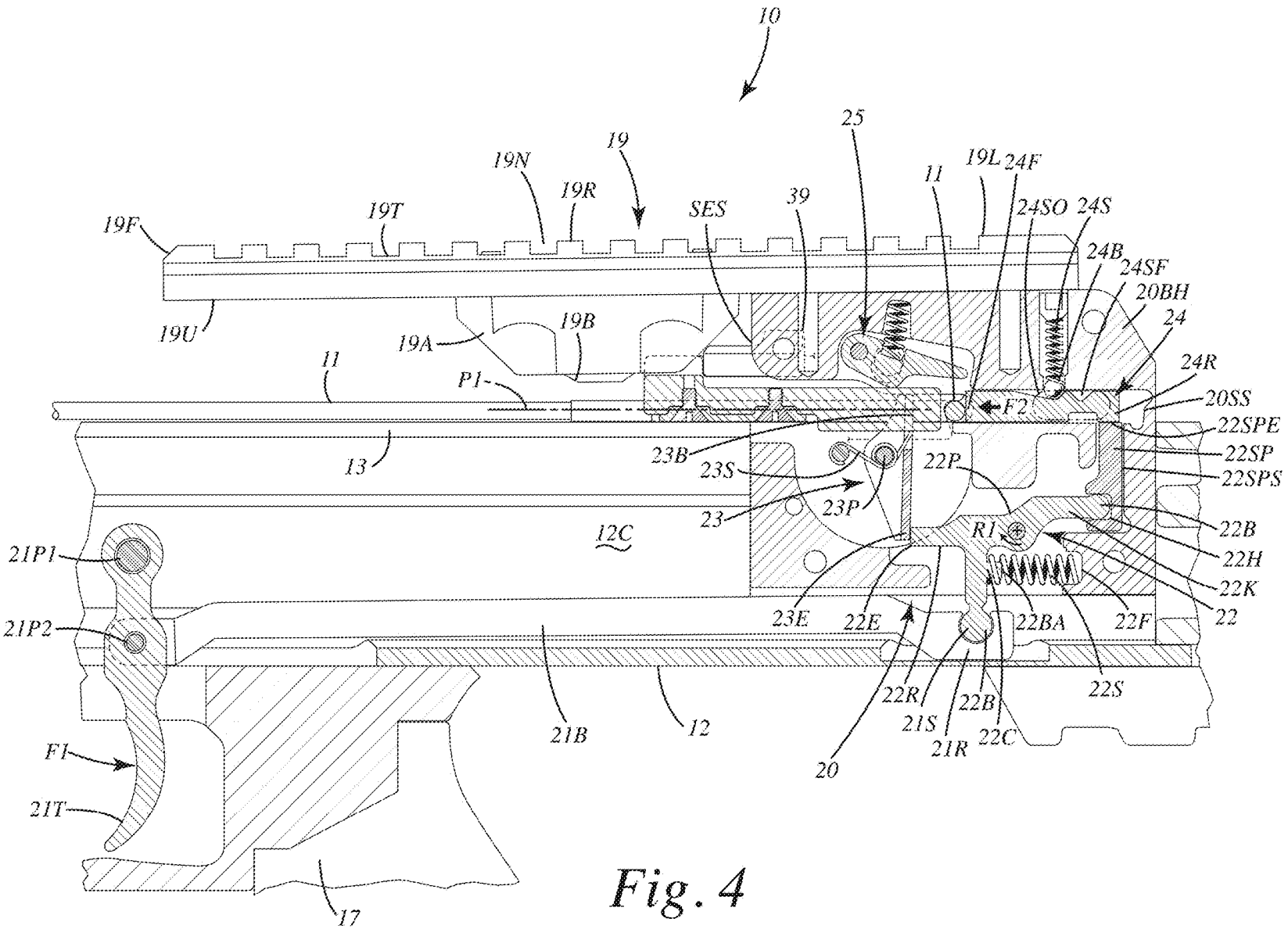
FIG. 4 is a partial section view of a trigger assembly including a safety, with the bowstring drawn by the sled past a catch and engaging a safety bar.

The crossbow 10, as mentioned above, can include the barrel or frame 12 which can extend rearwardly from a riser 16 of the crossbow. An optional stirrup 16S can be joined with the riser 16 and/or the frame 12 to allow a user to stabilize the crossbow 10 as it is drawn and/or de-cocked as described below. Limbs 14A and 14B can be fastened or secured to the riser 16 and/or the frame 12. The barrel or frame 12 can extend rearward from the riser and/or can be integral with the riser and/or the limbs depending on the configuration of the same. As shown in FIG. 1, the riser can extend rearwardly past the limbs and cams and is generally of an elongate structure. The frame 12 can include an internal compartment 12C as shown in FIG. 4. This internal compartment can house the trigger assembly 20 described below. The frame 12 can include and/or can be joined with a grip 17, which as shown can extend downward from the frame 12 generally between the riser 16 and a stock 18 that is secured to the rearward portion of the frame 12. The grip 17 can be in the form of a pistol grip and ergonomically configured to receive a user's hand allowing the user to grip, manipulate, hold and/or steady the crossbow 10 in a variety of configurations.

The frame 12 optionally can include a mounting arm 19. This mounting arm 19 can be joined with the frame 12 directly or joined with a trigger assembly 20 and secured thereto via a system of fasteners 20F. The mounting arm 19 in FIGS. 1 and 3 can be joined within the upper portion of the trigger assembly 20, sometimes referred to as a trigger box, via one or more fasteners 19F. The fasteners can be in the form of screws that are screwed into corresponding threaded holes in the upper portion 20U of the trigger box 20. The mounting arm 19 can include a forward end 19F and an opposing rearward end 19L closer to the stock 18. The forward end 19F can extend in any cantilevered manner forwardly over the rail 13 and the frame 12. The mounting arm 19 can include an arrow holder 19A that can extend downwardly from a lower surface 19U of the mounting arm 19. This arrow holder 19A as shown can include a button 19B that can engage a portion of the arrow A when the arrow is disposed on the rail 13 and generally within a channel 13C of the rail to hold the arrow down against the rail before it is shot from the crossbow. This can ensure that the arrow does not inadvertently become dislodged or drop out of the crossbow during transport. Although shown as a button 19B, the arrow holder 19A can include bristles, a plunger, or any other type of element that can touch, contact, or engage the arrow A with a low amount of force sufficient to hold the arrow in place along the rail 13. Of course, in some applications the arrow holder can be absent from the crossbow.

As shown in FIG. 4, the mounting arm 19 also can include an upper portion of rail that includes multiple ridges 19R and notches 19N. This rail can be in the form of a picatinny or dovetail rail and constructed to receive a sighting device (not shown) such as a scope, reflex sight, red dot, or other type of sighting device. The mounting arm 19 as mentioned above can be secured and/or can be integral with the trigger assembly 20 at its rearward end 19L. Adjacent to the mounting arm 19 or the trigger assembly 20 can be a sled limiter, also sometimes referred to as a sled engagement surface SES. This sled limiter or sled engagement surface SES can be configured to engage one or more stops 31, 32 of the sled 30 shown in FIG. 2 in a de-cocking mode using the de-cocking system as described below. As shown in FIG. 4, this sled engagement surface SES can be a portion of the trigger assembly or trigger box 20. Of course, depending on the application, the sled engagement surface SES can form or be a portion of the mounting arm 19, the frame 12 and/or the rail 30 or some other component extending adjacent the rail and frame near the trigger assembly 20.

Optionally, the sled engagement surface SES can be in the form of a wall or surface which can be flat, planar, curved, angled or of some other contour or configuration. The sled engagement surface can be configured again to engage the stops 31, 32 of the sled 30 and generally impair reward movement of the sled 30 toward the stock and/or further rearward relative to the trigger assembly. As used herein, the word impair can include an operation to impair, arrest, stop, interfere with (fully and/or partially) movement of the sled and/or components thereof. The operation and interaction of the sled engagement surface SES with the sled and in particular the stops 31 and 32 are described further below.

Turning to the trigger assembly 20, its various components will be described with reference to FIG. 4. The trigger assembly 20 can include or be coupled to a trigger 21T. The trigger 21T can be adjacent a grip 17 and can extend inward into a portion of the compartment 12C defined by the frame 12. The trigger 21T can be joined pivotally with the frame 12 via a pivot pin 21P1. The trigger 21T can include a second pivot pin 21P2 that joins the trigger 21T with a trigger bar 21B. The trigger bar 21B can extend rearward from the trigger and the grip 17 toward the trigger assembly or trigger box 20. The trigger bar can include a rearward end 21R that couples to a sear 22 of the trigger assembly 20 at a socket 21S. The socket 21S can define a hole that receives a ball 22B of the sear 22 to operably connect the trigger bar and thus the trigger with the sear 22. Of course, other constructions can be used to join the trigger and the sear depending on the application. Optionally, the trigger bar can be removable from the sear 22, for example the ball 22B can be removed from the socket 21S to provide removal of the trigger box 20 from the frame 12 to provide service, repair and/or replacement of the trigger assembly 20 relative to the crossbow 10.

The sear 22 can be selectively rotatable about a pivot pin 22P and a corresponding pivot axis. The sear can include a ball arm 22BA that extends down to the ball 22B. The ball arm can include a projection 22C that engages a biasing element 22S which can be in the form of a coil spring, leaf spring or elastomeric element. The spring 22S can be held in a cup 22F and can generally urge the sear to rotate in direction R1 about the pin 22P. The spring 22S also can provide resistance to a force F1 exerted on the trigger 21T. The sear can include a sear catch arm 22R that extends forwardly to a search catch engagement surface 22E. This engagement surface 22E can be configured to engage a bowstring catch 23 of the trigger assembly. The engagement surface 22E can be highly polished as can be a corresponding catch engagement surface 23E of the catch 23 so that the two members can slide and move smoothly and cleanly with regard to one another during actuation as described below. The sear also can include a safety engagement portion 22K that extends rearwardly from the pin 22P. The safety engagement portion 22K can include a rounded or ball shaped end 22B that interfaces with a receiver hole 22H in a sear safety pin 22SP.

Figure 5:
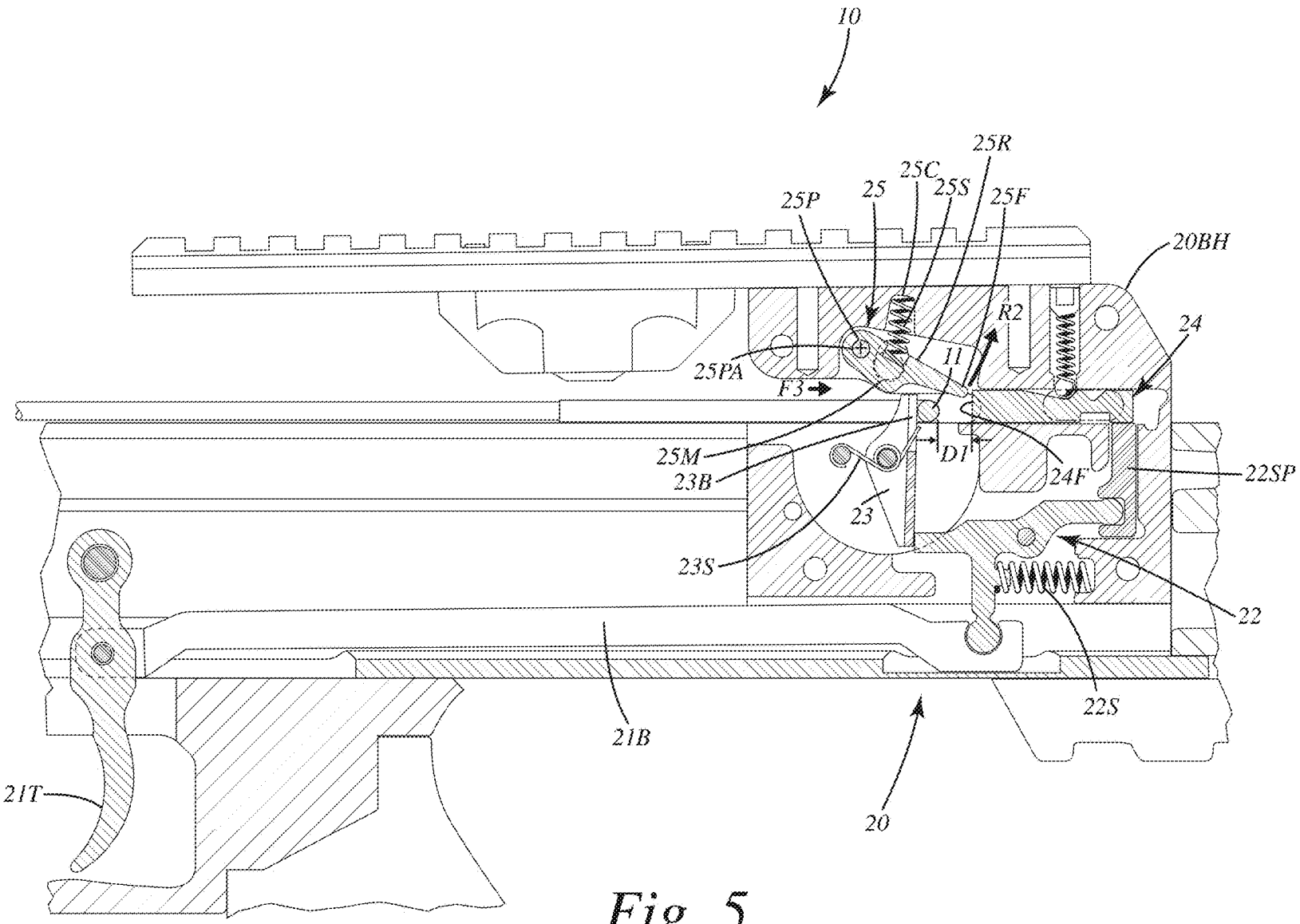
FIG. 5 is a partial section view of a trigger assembly with the bowstring drawn and held in a fully drawn mode and the catch in a holding mode to hold the bowstring in position, with the safety in a safety on mode to prevent a sear from actuating, and an anti-dry fire element in a lockout mode preventing the safety from moving from the safety on mode shown.

The sear safety pin 22SP shown in FIGS. 4-5 can extend vertically to selectively interact with the safety 24 of the trigger assembly 20. The sear safety pin 22SP can move upward and downward in the sear safety pin slot 22SPS depending on the movement of the sear 22 as described below. The upper end 22SPE of the sear safety pin 22SP can be blocked to prevent or impair upward movement via its engagement with the lower surface of a safety bar 24B or the safety 24 in general. For example, the rearward portion 24R of the safety 24 can be in the position shown in FIG. 4 in which the safety blocks movement of the sear safety pin 22SP and thus rotation of the sear 22 about the pin 22P in direction R1. As a result, the trigger 21T cannot activate the sear to release the bowstring catch 23.

As shown in FIG. 4, the sear 22 is in the cocked mode, thereby preventing the catch 23 from releasing the bowstring, and the safety is in the safety on mode in which it interferes with movement of the sear safety pin 22SP in an upward direction and thus does not allow rotation of the sear in direction R1. As mentioned above, the catch 23 is rotatable about the pin 23P. This rotation can be biased by a spring 23S which can generally return the catch to the position shown in FIG. 4 after the bowstring 11 is released from a drawn mode to the released or undrawn mode, for example, when the bowstring is used to shoot an arrow or is de-cocked as described below.

The catch 23 can include a bowstring engagement surface 23B above the pivot 23P and generally above the sear engagement surface 23E. This bowstring engagement surface 23B can engage the bowstring and when the catch 23 is engaged against the sear can hold the bowstring in the drawn mode. Additional catches can be joined with the catch 23 as shown to hold the bowstring in multiple locations, depending on the application. The bowstring catch is shown disengaged from the bowstring 11 in FIG. 4 because the sled 30 has been used to draw the bowstring 11 to its maximum position, engaging the bowstring 11 against the safety 24, before this sled is removed from the bowstring. In this position, the bowstring 11 might not engage the bowstring engagement surface 23B of the catch, and instead might engage the forward-facing end 24F of the safety 24. As shown in this position in FIG. 4, when the sled has pulled the bowstring beyond full draw, the safety 24 generally is not movable in direction F2, so it cannot be disengaged from the safety on mode. The safety pin 22SP thus cannot be moved upward, and sear 22 cannot rotate in this condition.

The trigger box 20 can include the safety 24 as mentioned above. The safety 24 can be moveable, for example, slidable in a safety slot 20SS defined by the trigger assembly box or housing 20BH. The safety can be configurable in the safety on mode shown in FIGS. 4 and 5 or alternatively in the safety off mode shown in FIGS. 8 and 10. In the safety on mode, the safety obstructs movement upward of the safety sear pin 22SP which prevents rotation of the sear 22 in direction R1, so that the sear engages the catch 23 to keep the catch in the holding mode as shown for example in FIG. 5. The safety also is operable in the safety off mode shown in FIGS. 8 and 10 such that the sear can be converted to the fire mode shown in FIG. 10 and the catch 23 can be converted or moved to the drop mode shown in FIG. 12 to release and allow the bowstring to transition from the drawn mode to the released or undrawn mode in either a shooting operation or a de-cocking operation of the crossbow as described below.

Optionally, the safety 24 can be aligned with and can move against a common plane P1 with the bowstring 11. Further optionally, the safety 24 can slide primarily along or linearly within that plane P1 without rotating. The safety slot 20SS also can be aligned with and/or intersected by the plane P1 as shown. The safety 24 can slide linearly within this safety slot 20SS as shown. The safety can interface with a detent ball 24B that is urged via a spring 24S into a safety on notch 24SO when the safety is in the safety on mode shown in FIG. 4 or into a safety off notch 24SF when the safety is in the safety off mode shown in FIG. 8. The interface of the ball and notches can secure the safety 24 in the safety on mode and/or safety off mode depending on the notch. Of course, other mechanisms can be used to secure, hold or locate the safety 24 in the safety on mode and the safety off mode.

The crossbow 10 optionally can include an anti-dry fire element 25 that can prevent inadvertent or unintentional dry firing of the crossbow 10 when an arrow A is not satisfactorily engaged with the bowstring or is absent from the crossbow altogether. The anti-dry fire element can be selectively movable between a lockout position shown in FIG. 5, which prevents the safety 24 from being transitioned from the illustrated safety on mode, where the safety 24 will not allow the sear 22 to rotate, and an open position shown in FIG. 10 that permits the safety to move to the safety off mode shown there for de-cocking, or for shooting an arrow from the crossbow. As shown in FIG. 5, the anti-dry fire element 25 can pivot about a pivot pin 25P and generally about a pivot axis 25PA. The anti-dry fire element 25 can be disposed generally above an arrow when the arrow is engaged via its nock with the bowstring 11, which is held in place in the drawn mode shown in FIG. 5 via the catch 23 in a holding mode. The anti-dry fire element 25 can include an arm 25F that extends toward and selectively is placed against or adjacent the forward-facing end 24F of the safety 24. As shown in FIG. 5 in this configuration, the safety 24 cannot be moved forwardly from the illustrated safety on mode, to a safety off mode. Likewise, the safety cannot be moved forward toward the bowstring 11 held by the catch 23.

Figure 10:
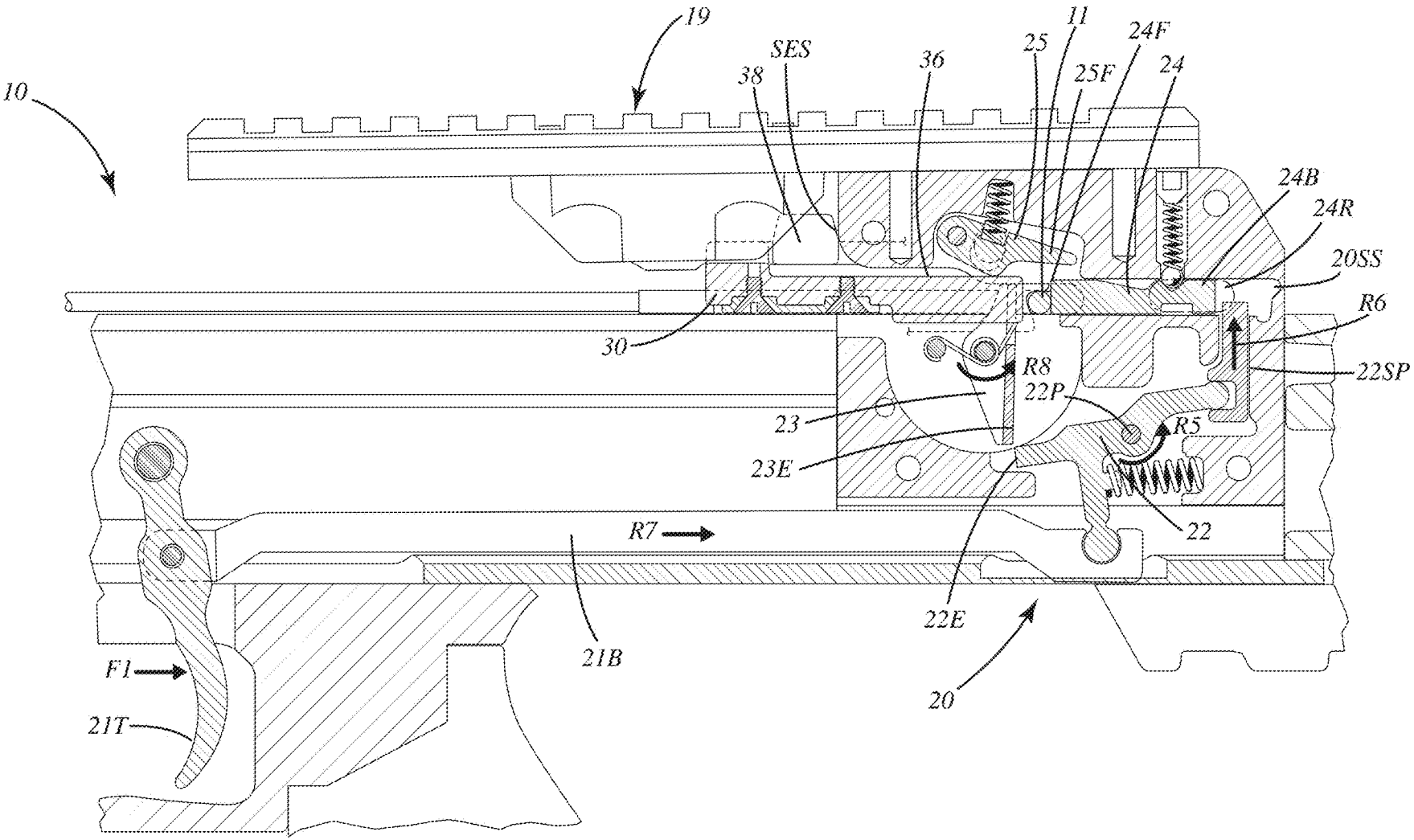
FIG. 10 is a partial section view of a trigger assembly with the bowstring drawn and a sled on the frame in a de-cocking mode in which an anti-dry fire protrusion has moved the anti-dry fire element to the open position when the sled is adjacent the trigger assembly, wherein the safety is in the safety off mode, wherein the trigger has been pulled and a sear is in a fire mode, with the sear safety element moving past the safety and a catch initially transitioning from a holding mode to a drop mode to release the bowstring while the bowstring is still held by the sled in the de-cocking mode so that the bowstring does not thereby move into the gap and toward the bowstring.

In this lockout position of the arm 25F and the anti-dry fire element 25 in general, the safety 24 is locked out from being able to transition from the safety on mode shown in FIG. 5 to the safety off mode shown in FIG. 10. The anti-dry fire element arm 25F can be biased to the locked mode via a biasing element 25S which can be in the form of a spring pressing against the arm 25F and seated in a recess 25R. Another portion of the spring 25S can be disposed in a cup 25C of the trigger box housing 20BH. When an arrow A or the protrusion 36 of the sled 30 is moved toward the bowstring 11, for example, as shown in FIG. 5, the arrow or sled will exert a force F3 upon a ramp 25M of the anti-dry fire element 25. This force F3 causes the arm 25F to move upward in direction R2 and thereby disengage or move out of an interference position relative to the safety 24. The spring 25S under such engagement force F3 also can compress slightly. When the arm 25F is no longer positioned in the lockout position or generally is in the open position after moving in direction R2, the anti-dry fire element will allow the safety 24 to slide or otherwise move forwardly from a safety on mode to a safety off mode.

As mentioned above, the crossbow optionally can be supplied with a sled 30 which can be used to cock and de-cock the crossbow 10. The sled can be used to move the sled from a released or undrawn mode, where the bowstring is all the way forward extending between the cams in a generally perpendicular manner, to a fully drawn or unreleased mode shown for example in FIG. 1. The sled in this embodiment optionally can be used as part of a de-cocking system for de-cocking the crossbow from the drawn mode to a released or undrawn mode.

With reference to FIGS. 13-16, the sled will now be described in further detail. Optionally, the sled 30 can include a body 33 which can be of a generally U or V shape. The body can include rearward extending first arms 31 and 32 disposed on opposite sides of a sled longitudinal axis SLA. The body 33 can further include a guide 34 which can have a first guide rail 34A and a second guide rail 34B disposed on opposite sides of the sled longitudinal axis SLA. These rails can cooperate to form a recess 24R which is sized to receive an upper portion of the rail 13 or the barrel 12 of the crossbow 10. The recess 34R can be of a width W1 that is greater than a width W2 of the rail 13. Optionally, the guide 34 can include an insert 34I that has built in slots 34S they can receive corresponding protrusions or rails along the rail 13 or frame 12 to assist further in smooth sliding along the rail as the sled 30 is used to draw and/or de-cock the crossbow 10.

Figure 16:
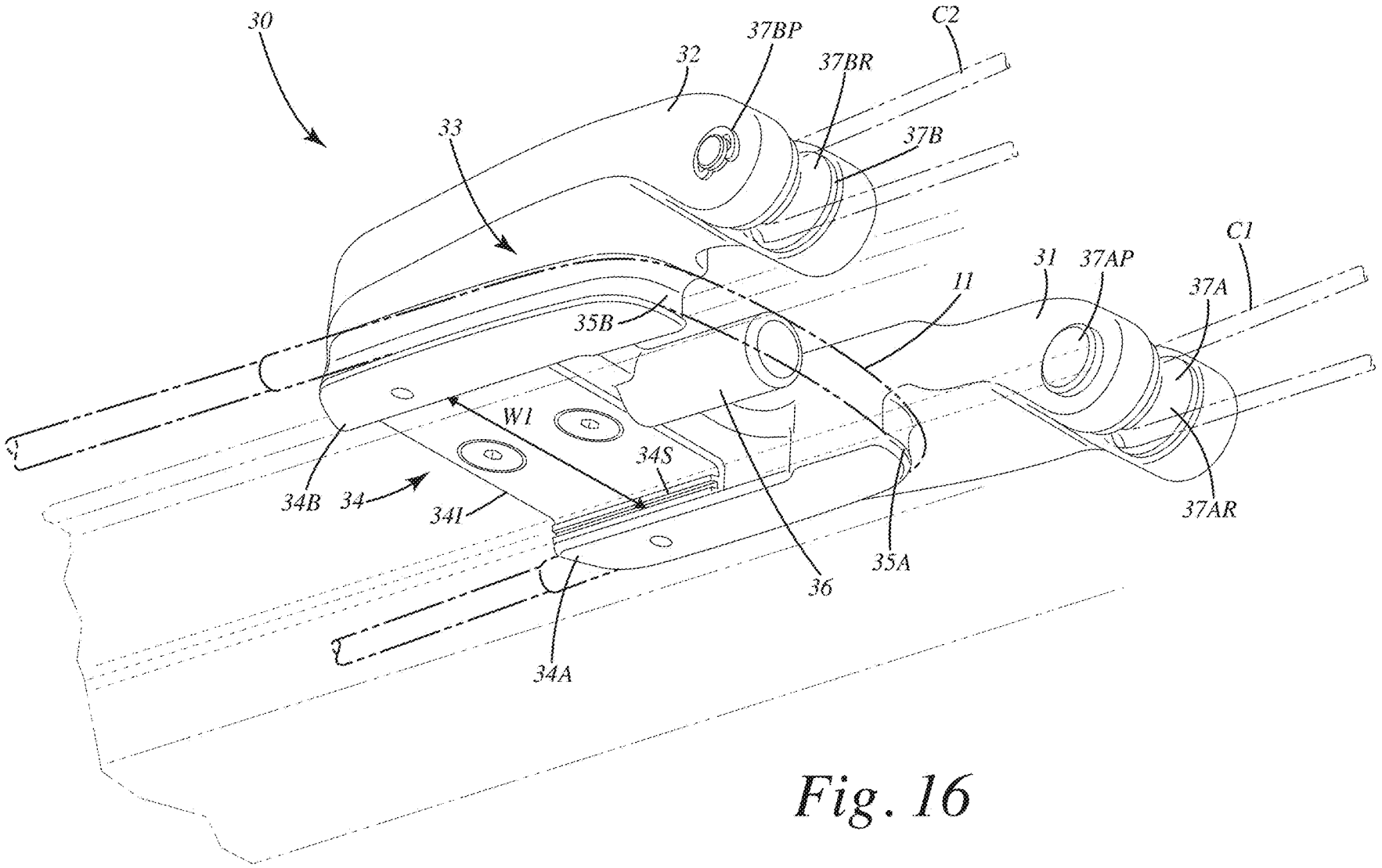
FIG. 16 is a bottom perspective view of the sled showing a bowstring engaged by the sled and a cord pulling on the sled in either a cocking mode or a de-cocking mode.

With further reference to FIG. 16, the sled 30 can be configured so that the body 33 includes one or more bowstring engagers 35A and 35B. These bowstring engagers can be in the form of channels, slots, recesses, grooves, or tracks that extend rearward from a forward portion of the body 33 and rearward of a protrusion 36 that is configured to move the anti-dry fire element of the crossbow to the open position from its lockout position when the sled is adjacent the trigger assembly 20. The bowstring engagers 35A and 35B can be configured to allow the bowstring 11 to wrap in a U shape as shown in FIG. 16 around the rearward portion of the sled 30 but forward and optionally above the cord engagement elements 37A and 37B. These cord engagement elements can be joined with the rearward portions of the respective arms 31 and 32. Further optionally, these cord engagement elements can include rollers 37BR and 37AR that are mounted on respective pins 37BP and 37AP that extend through the respective arms 31 and 32. The rollers can rotate relative to the arms to facilitate movement of the cord and in particular portions of the cord C1 and C2 relative to those rollers and the sled when the cord portions C1 and C2 are under tension by a user pulling manually on the cord and/or a crank 50 associated with the crossbow 10 as described below. As used herein, a cord or a portion of the cord can mean a cord, rope, string, set of filaments, cable, strap, web, ribbon, or any other elongated element.

The sled 30 shown in FIGS. 13-16 optionally can be outfitted with one or more stops to allow the sled to assist in drawing or cocking the crossbow, as well as letting down or de-cocking the crossbow, in particular the bowstring, from a drawn mode to a released mode or undrawn mode. The one or more stops can include a first stop 38 and a second stop 39. The first and second stops each can be selectively operable in a neutral mode shown in FIGS. 4 and 13, in which the first and second stops do not interfere with rearward movement of the sled 30 along the barrel 12 or rail 13. This is so that the bowstring 11 can move completely to the drawn mode and past the catch 23, and more particularly past the catch bowstring engagement surface 23B during a drawing operation or a de-cocking operation.

With the stops in the neutral mode, the user can pull on the sled 30 via the cord and its portions C1 and C2 such that the bowstring 11 actually contacts the safety 24 and in particular a front surface 24F of the safety as shown in FIG. 4 at a maximum drawing extent of the bowstring during a drawing operation with the sled. However, when the sled is disengaged from the bowstring and removed from the rail and frame, the bowstring 11, shown in FIG. 5, can retract forward and can be spaced a distance D1 from the forward-facing end 24F of the safety 24. This distance D1 can correspond to a gap between the bowstring 11 and the forward-facing end 24F of the safety. This gap between the bowstring and the safety 24 can be sized to accommodate the safety while transitioning the safety from the safety on mode to the safety off mode as described further below.

Returning to the sled and stops shown in FIGS. 13 and 14, each of the stops can generally be identical but disposed on opposite sides of the sled longitudinal axis SLA so only the first stop 38 will be described in detail here. The first stop 38 can include a first pivot axis 38P1 about which it can rotate direction R3, generally toward the sled longitudinal axis. The first stop can be fastened to the body 33 via a stop fastener or pin 38P. This fastener or pin can be of any configuration to allow the first flange 38F to rotate about the pivot access 38P1. The first flange 38F can include a stop block 38B which can include a first engagement surface 38E. The first flange, stop block 38B and engagement surface 38E each can rotate together with the flange about the pivot axis 38P1 in direction R3, from the neutral mode shown in FIG. 13 which is used to draw the archery bow, to a de-cocking mode shown in FIG. 14.

In the de-cocking mode, the flange, stop block, and/or first engagement surface can engage a stop limiter or sled engagement surface SES described above or some other component of the barrel, rail, trigger box, or mounting arm that is generally disposed along a travel path of the stop block when the stop block is deployed to the de-cocking mode. This is shown, for example, in FIG. 6, where the crossbow 10 is in the initial stages of a de-cocking mode. There, the first stop 38 and the second stop 39 each are deployed, for example, as further shown in FIG. 14. In this configuration, the respective and first engagement surface 38E and the second engagement surface 39E are each deployed to the de-cocking mode. In this mode, the stops and respective flanges and engagement surfaces are each on opposing first and second sides of the rail, opposite one another. These stops and engagement surfaces are configured to simultaneously engage the stop engagement surface SES in the de-cocking mode. As a result, with these engagement surfaces 38E and 39E engaging, contacting, or pushing against the sled engagement surface SES, this engagement and contact will impair and/or completely arrest movement of the sled so that it can no longer move rearward. This is further shown in FIG. 7 where the stop 38 and the stop engagement surface 38E engages the sled engagement surface SES as the sled 30 is used to engage the bowstring 11 during a de-cocking mode. As this occurs, the bowstring 11 also enters into the respective bowstring guides or engagers 35A and 35B.

Figure 6:
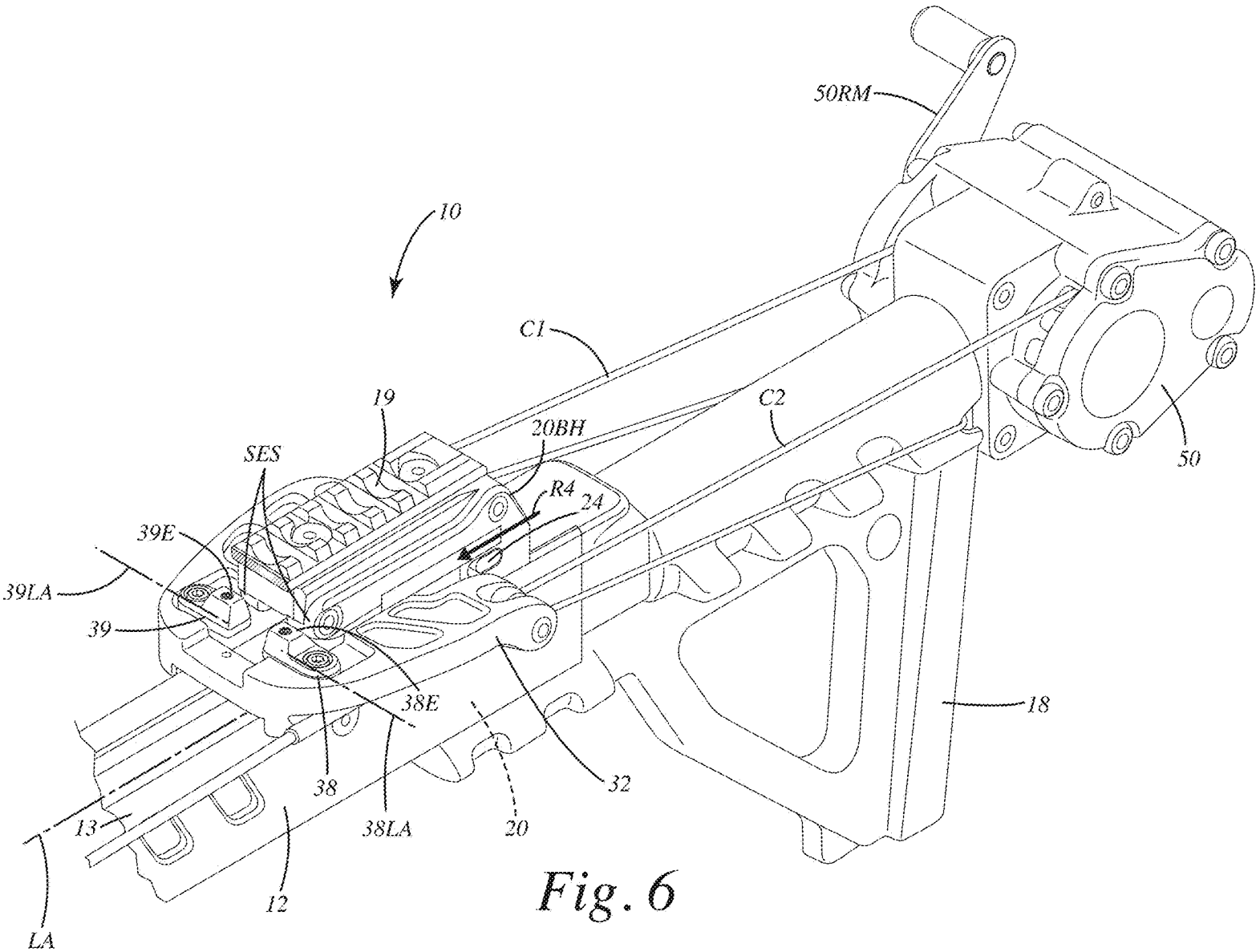
FIG. 6 is a close-up view of the sled with the pair of stops on the sled in a de-cocking mode and arrested against an engagement surface atop the crossbow to stop rearward movement of the sled toward the safety.
Figure 13:
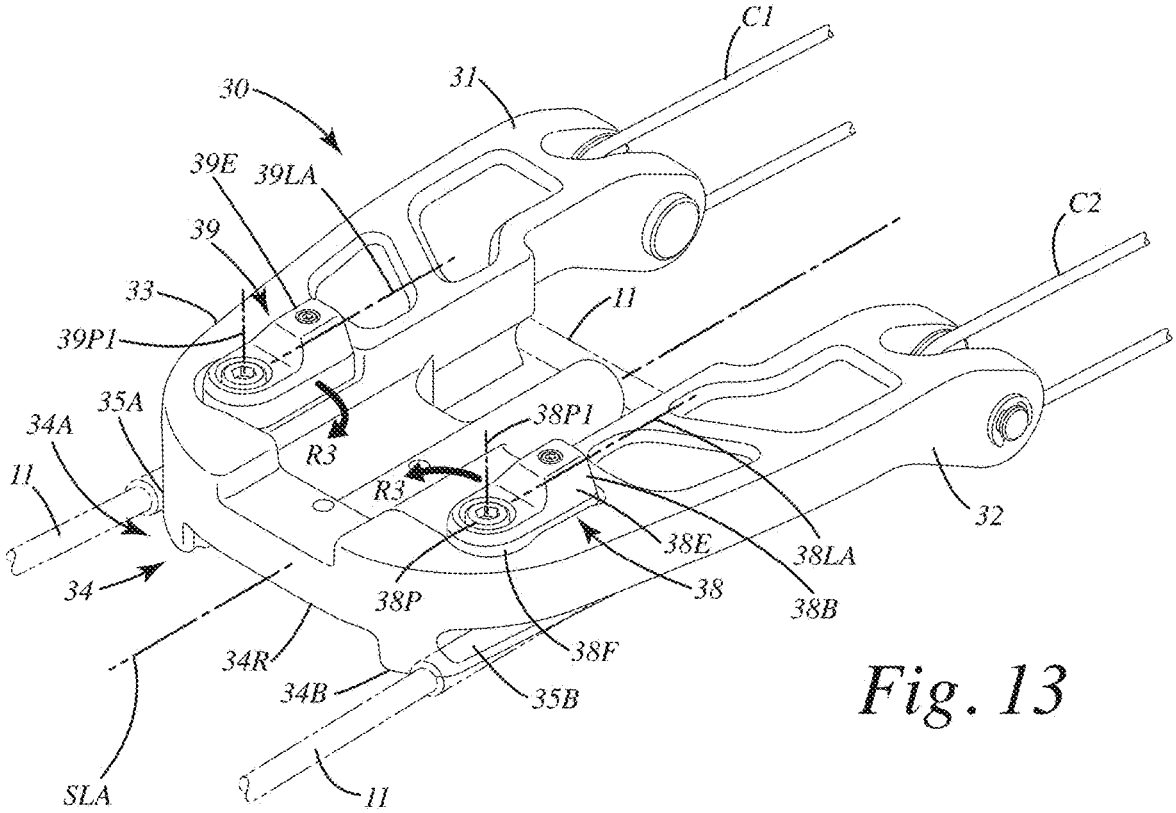
FIG. 13 is an upper perspective view of the sled with the stops in a neutral mode, used for example in FIG. 2 to cock the crossbow.
Figure 14:
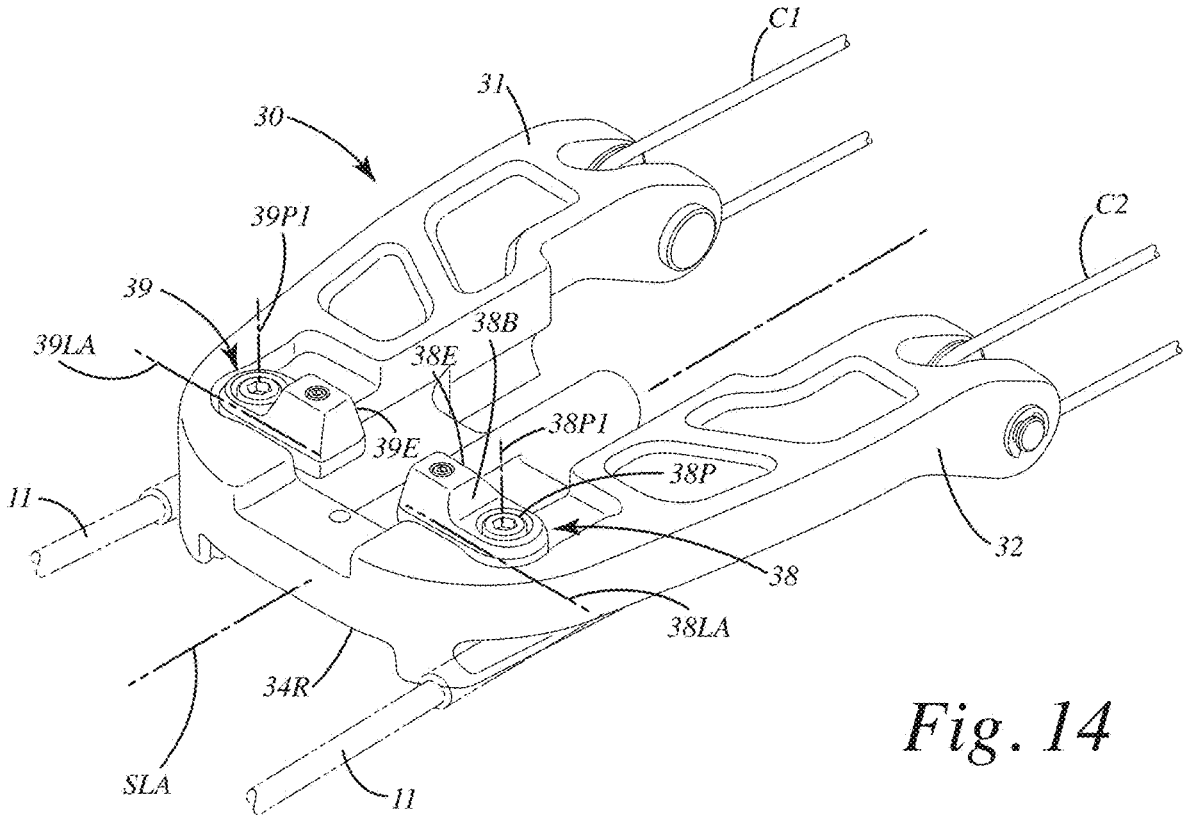
FIG. 14 is an upper perspective view of the sled with the stops in a de-cocking mode, used for example in FIG. 6 to de-cock the crossbow.
Figure 15:
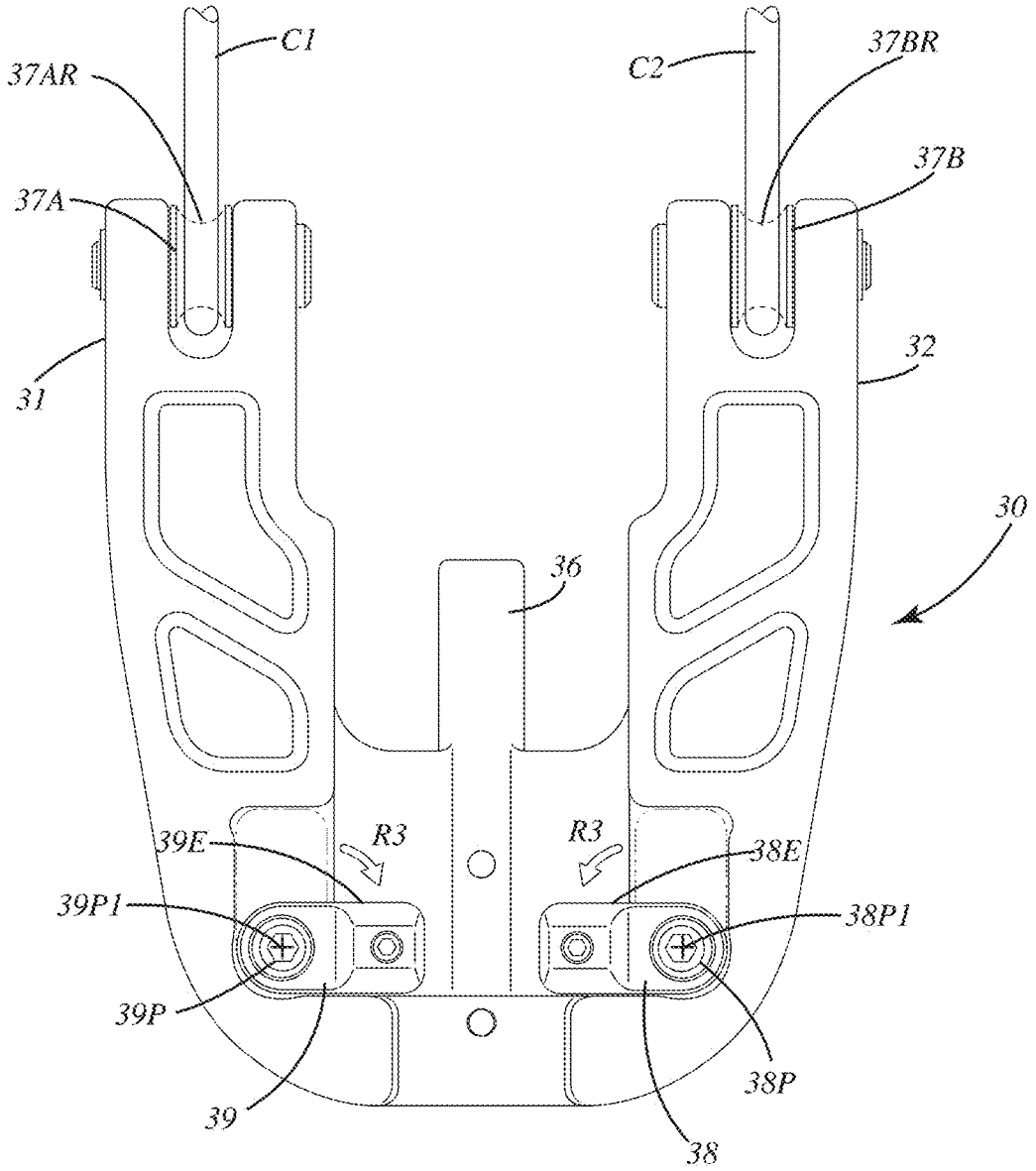
FIG. 15 is a top view of the sled with the stops being moved from a neutral mode to the de-cocking mode.

Optionally, with reference to FIGS. 6, 13 and 14, the stops 38 and 39 can include respective stop longitudinal axes 38LA and 39LA. In the neutral mode of the stops 38 and 39, shown in FIG. 13, the stop longitudinal axes 38LA and 39LA can be generally parallel to the frame 13 and the sled longitudinal axis SLA. In the de-cocking mode, the stops 38 and 39, shown in FIGS. 6 and 14, and the stop longitudinal axes 38LA and 39LA can be rotated such that these stop longitudinal axes are substantially perpendicular to the sled longitudinal axes SLA and substantially perpendicular to the barrel or frame 12 and/or the rail 13 and/or the crossbow longitudinal axis LA. These stops can rotate about the respective pivot axis 38P1 and 39P1, which optionally can be substantially vertical when transitioning and moving the stop longitudinal axes from the parallel to the frame configuration to the substantially perpendicular to the frame configuration in the de-cocking mode. Of course, when the respective pivot axes of the stops are oriented differently, the movement of these stops can change as well.

Figure 7:
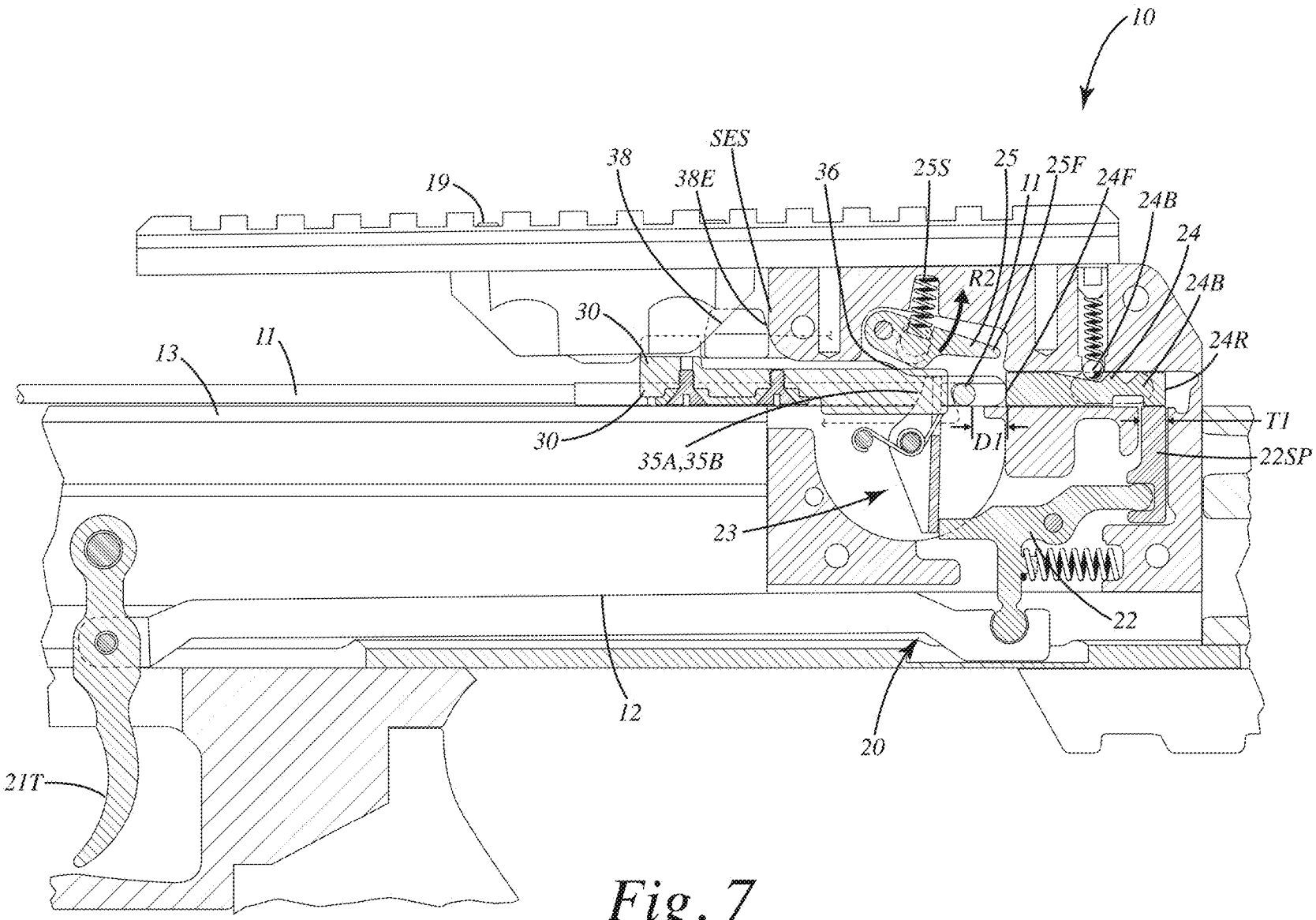
FIG. 7 is a partial section view of a trigger assembly with the bowstring drawn and a sled on the frame in a de-cocking mode in which an anti-dry fire protrusion has moved the anti-dry fire element to the open position when the sled is adjacent the trigger assembly, but wherein the sled is prevented from moving rearward by the stops far enough to push the sled or the bowstring against the safety so that a gap remains between the bowstring and the safety and so the safety can still be moved to a safety off mode.

Although the sled 30 is shown with first and second stops on opposite sides of the sled longitudinal axis SLA that generally engage a portion of the trigger assembly or box 20, the stops can be attached in different locations or positions on the sled and the sled engagement surface can be disposed on different components or portions of the crossbow. For example, the stops can include one or more stops that are joined with the sled and are movable from first position to a second different position. The first position can be out of the way of and not contact any portion of the trigger box, mounting arm, frame, or other component of the rail. The second position of the stop can be such that when it is moved, the stop or a portion thereof engages or contacts some portion of the trigger box, mounting arm, frame, or other component of the rail to impair or otherwise arrest or stop rearward movement of the sled toward the safety 24. Regardless of the configuration of the stops, in the de-cocking mode, they will enable the sled to engage the bowstring 11 as shown in FIG. 7 while the sled is in the rearmost position, being drawn by the cord and its respective cord portions C1 and C2 discussed above. In this rearmost position, the bowstring 11 remains out of contact and disengaged from the safety 24 and in particular the safety bar 24B and its forward most end 24F.

Figure 8:
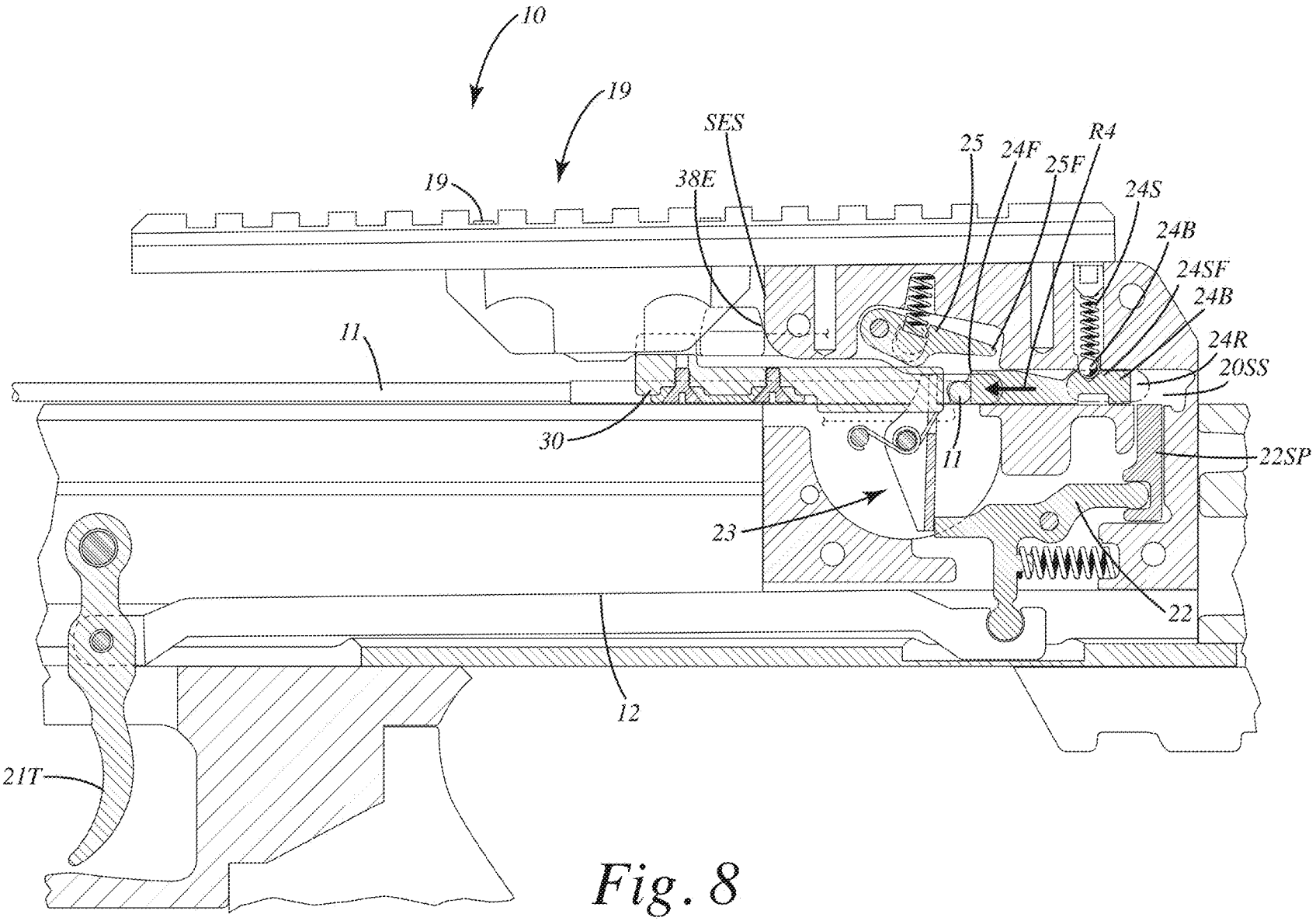
FIG. 8 is a partial section view of a trigger assembly with the bowstring drawn and a sled on the frame in a de-cocking mode in which an anti-dry fire protrusion has moved the anti-dry fire element to the open position when the sled is adjacent the trigger assembly, but wherein the sled is prevented from moving rearward by the stops far enough to push the sled or the bowstring against the safety so that a gap remains between the bowstring and the safety, but wherein the safety is moved from a safety on mode to a safety off mode, thereby moving into the gap and toward the bowstring.

As mentioned above, the forward most end 24F can be spaced at distance D1 from the bowstring 11. This distance D1 can be greater than the thickness T1 of the sear safety pin 22SP such that when the forward end 24F of the safety bar 24B moves forward reducing the distance D1 between it and the bowstring 11, the sear safety arm can be moved upward past the rearward end 24R of the safety bar 24B as shown, for example, in FIG. 8. In some cases, the safety moves closer to the bowstring, thereby reducing the distance D1 between the bowstring and the forward end of the safety in the de-cocking mode, particularly when the safety is converted to the safety off mode. In other cases, as shown in FIG. 8, the forward-facing end 24F may actually contact the bowstring 11 when the safety is converted from the safety on mode shown in FIG. 7 to the safety off mode shown in FIG. 8. Of course, in other applications, contact between the forward end 24F of the safety bar 24B and the bowstring 11 does not occur and a small gap having a distance less than the distance D1 remains between the bowstring and the forward facing end 24F of the safety bar Further optionally, during the transition of the safety bar 24B and the safety 24 in general from the positions in FIG. 7 which is a safety on mode, to the safety off mode shown in FIG. 8, the sled 30 can remain stationary and the stop engagement surfaces 38E and 39E can remain in contact with, engaging or immediately adjacent the sled engagement surface SES. The bowstring 11 also can continue to have its same tension during this transition. The cord and its portions C1 and C2 also can maintain the same tension T therein as the safety is converted from the safety on mode to the safety off mode.

A method of using the crossbow 10 of the current embodiment, and in particular a method of de-cocking the crossbow during a de-cocking operation will now be described in further detail. Generally, the method can comprise pulling on a bowstring that is in a drawn mode with a sled including a stop so the stop engages a limiter on the crossbow and ceases movement of the sled and stop relative to a frame of the crossbow in a de-cocking mode, leaving a first distance between the bowstring and a safety bar, without the sled and stop engaging the safety bar; moving the safety bar toward the bowstring to reduce the first distance to a second distance between the bowstring and the safety bar, the second distance being less than the first distance; pulling a trigger so that a catch disengages the bowstring; and transitioning the bowstring to an undrawn mode while the sled engages the bowstring to de-cock the crossbow.

Optionally, the method can include manually engaging the safety to slide a safety bar in a slot so that a forward face of the safety bar moves toward the bowstring without engaging the bowstring during the moving step. In some cases, the method can include manually sliding the safety bar toward the bowstring while the stop is in the de-cocking mode, without any part of the sled engaging the safety bar. The method can further include transitioning the stop from the de-cocking mode to a neutral mode by rotating the stop toward another stop on the sled after the crossbow is de-cocked and the bowstring is in the undrawn mode; and drawing the bowstring from the undrawn mode to the drawn mode while the stop is in the neutral mode.

Turning to FIGS. 1-12, the method can include converting the crossbow 10 from a fully drawn mode to a released mode or undrawn mode where the bowstring is fully released and no longer held by the trigger assembly 20. The method can begin as shown in FIG. 1 where the crossbow 10 is fully drawn and an arrow A is disposed on the rail 13, fully engaged with the bow string 11 which is in the drawn mode being held by the catch 23 of the trigger assembly 20. The arrow A can be removed from the rail so that the crossbow 10 is readied for de-cocking the bowstring from the draw mode to the released or undrawn mode. When the arrow A is removed from the rail 13 and frame 12, the trigger assembly 20 can be in the configuration shown in FIG. 5. There, the sear 22 is in the cocked mode and holds and engages the catch 23 so that the catch is still in the holding mode shown there, holding the bowstring 11 in the drawn mode. The safety 24 is still in the safety on mode which engages the sear safety pin or otherwise prevents it from moving upward in the configuration shown in FIG. 5.

With the arrow A removed, the force F3 also is removed from the anti-dry fire element such that the spring 25S pushes the arm 25F downward in front of the forward end or face 24F of the safety 24 so that the safety cannot be actuated from the safety on mode to the safety off mode. The bowstring 11 remains secured via the catch 23 with the bowstring engagement surface 23 being engaged fully by the bowstring 11, which again is under tension. A significant force is thus exerted against that catch 23 due to energy stored in the limbs.

Figure 2:
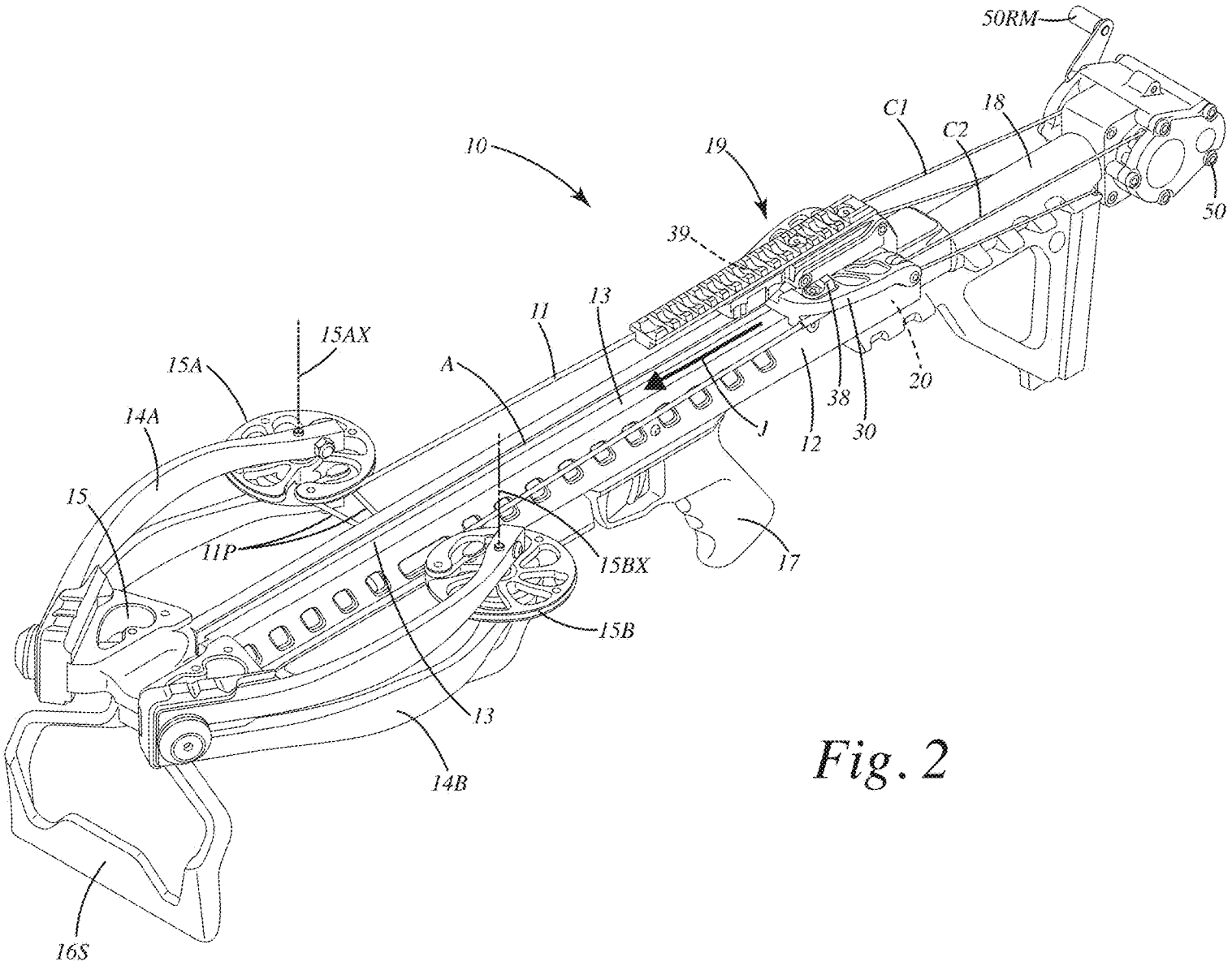
FIG. 2 is a perspective view of the crossbow being cocked using a sled and crank of the current embodiment.
Figure 3:
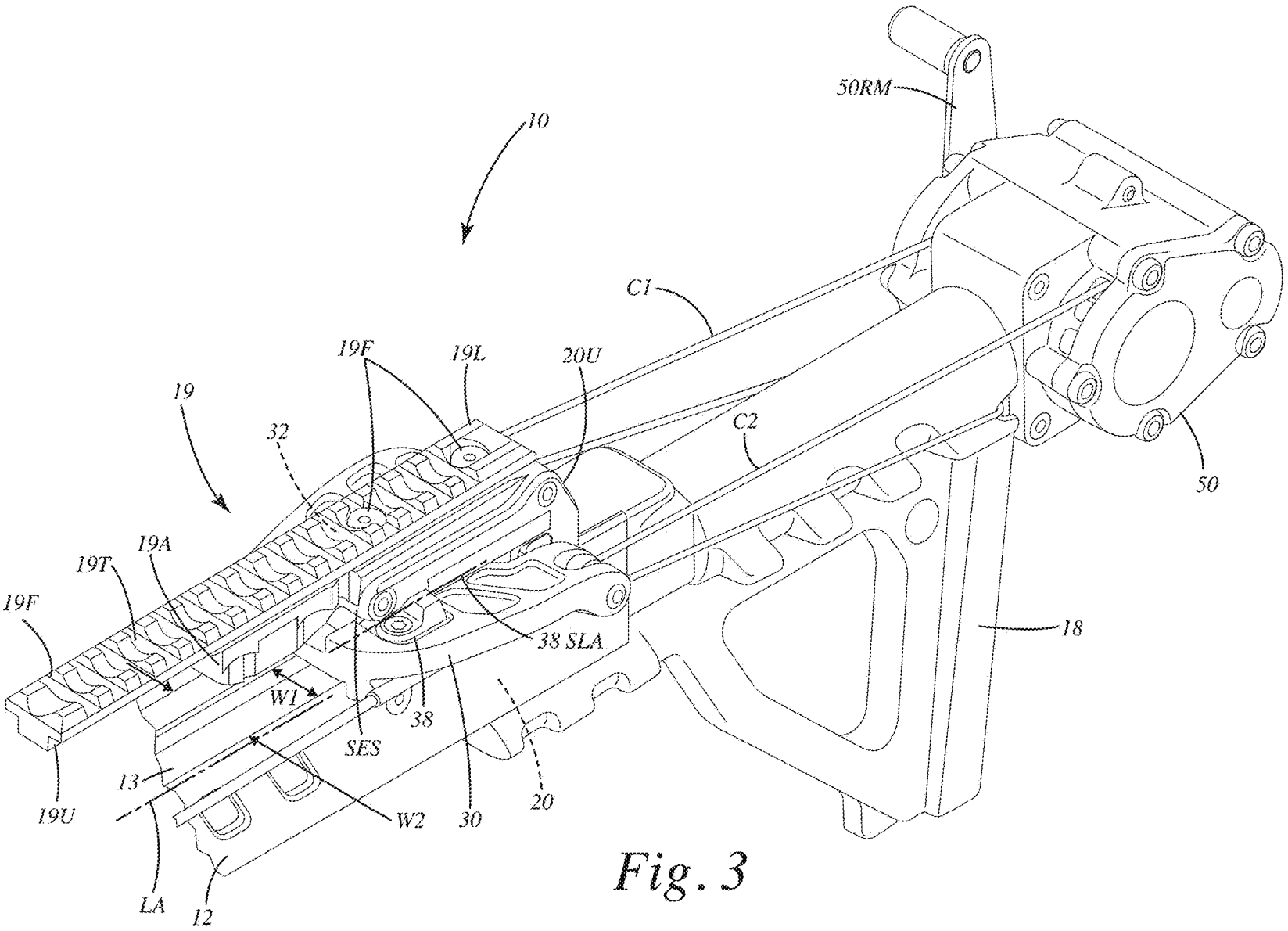
FIG. 3 is a close-up view of the sled with a pair of stops on the sled in a neutral mode to draw the bowstring.
Figure 17:
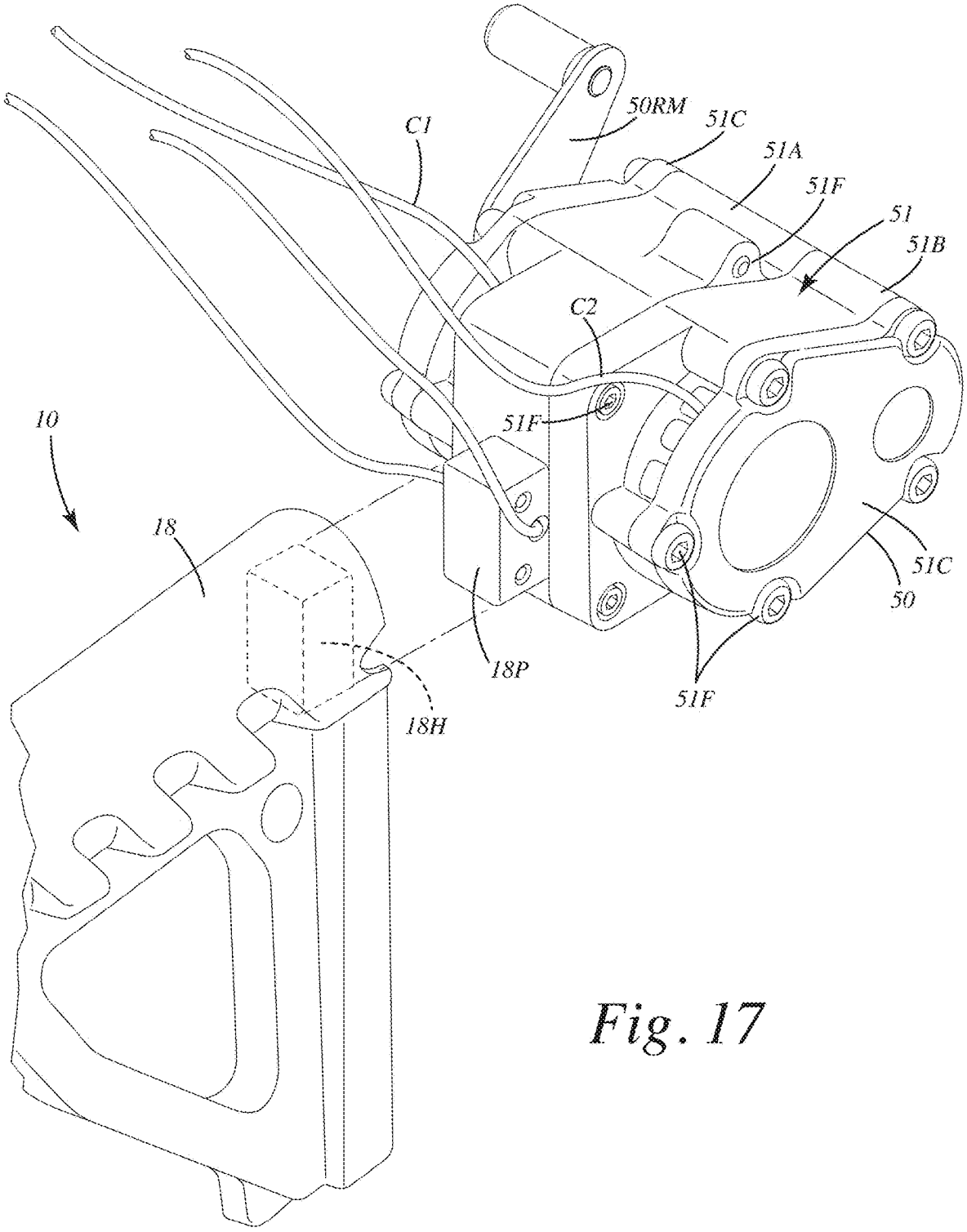
FIG. 17 is a perspective view of a crossbow crank being installed on a crossbow.
Figure 18:
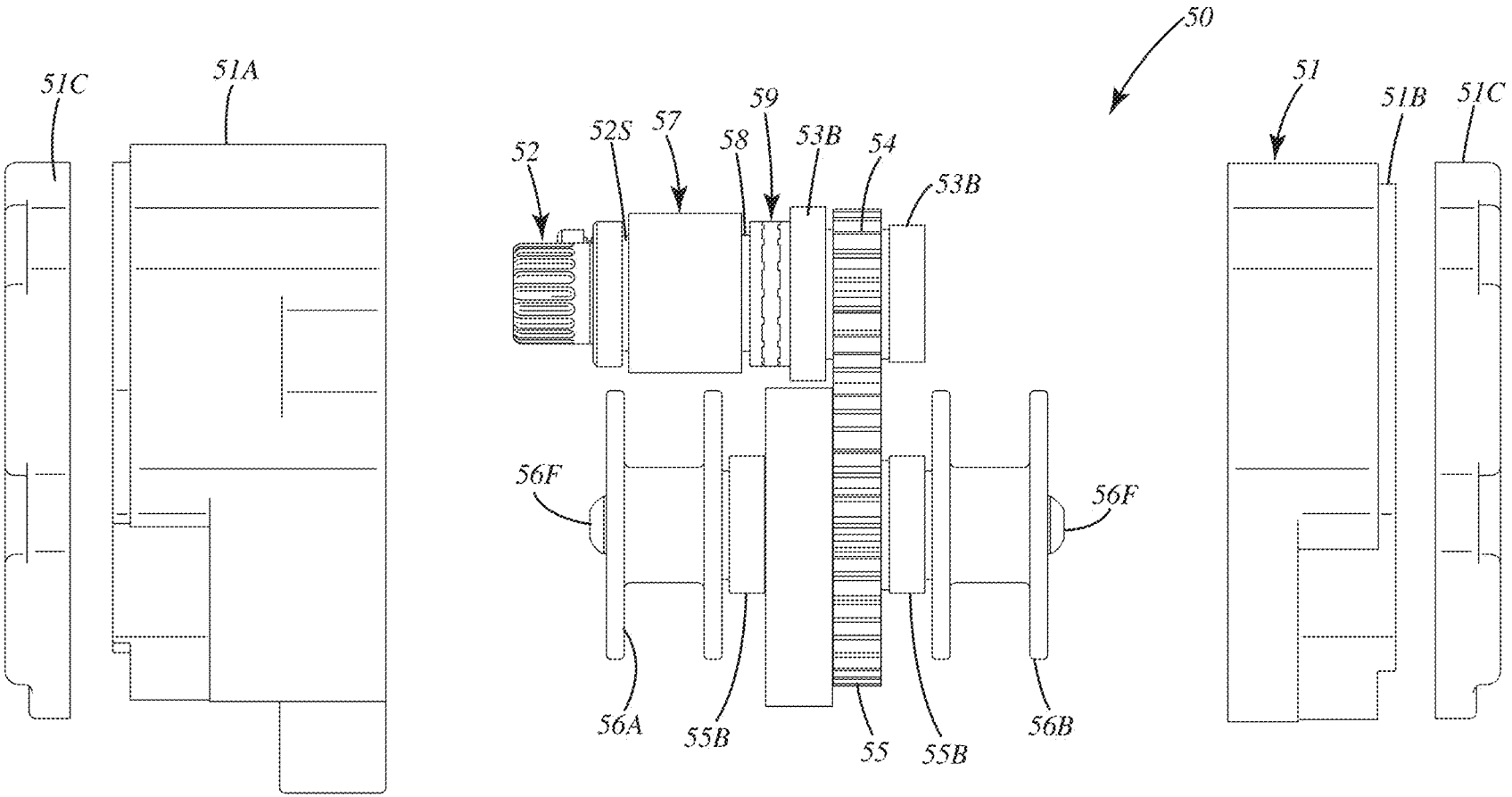
FIG. 18 is a partially exploded view of the crossbow crank.

As shown in FIG. 2, a crank 50 can be installed relative to the stock 18 and the crossbow 10 in general. With further reference to FIG. 17, the stock 18 can define a hole, aperture other feature that receives a projection 18P associated with the crank 50. The interface of the projection 18P and the hole 18H can be sufficient to secure the crank 50 to the crossbow 10. The cord portions C1 and C2 can extend forwardly from the crank 50 and can be joined with the bowstring engagement elements of the sled 30. Another portion of the cord can extend through a hole defined by the projection 18P and forwardly to connect with the other cord portions C1 and C2.

The crank can be actuated to move the sled 30 to the position shown in FIG. 6. There, as mentioned above, the sled can be in the de-cocking mode along with the first and second stops 38 and 39. When the sled is drawn rearward with the cord and its portions C1 and C2 toward the brake 50 via a user cranking the crank arm 50RM of the crank 50, the protrusion 36 of the sled 30 can engage the ramp 25M of the anti-dry fire element 25 such that it rotates in direction R2 against the bias of the spring 25S. When this occurs, the arm 25F of the anti-dry fire element moves upward, generally from the position shown in FIG. 5 to be positioned shown in FIG. 7, such that the arm 25F is no longer in front of and cannot interfere with movement of the safety 24 and/or the safety bar 24B thereof. The anti-dry fire element and the arm 25F therefore are no longer in front of the forward end 24F of the safety.

With the stops 38 and 39 in the de-cocking mode, rearward movement of the sled 30 via tension in the cord portions C1 and C2 exerted by the crank 50, if optionally included, or tension in the cord portions exerted by a user manually pulling on the cord and thus the sled 30, can be impaired. In particular, as shown in FIG. 7 rearward movement of the sled can be completely arrested and stopped when the stops 38 and 39 engage the stop engagement surface SES or some other stop limiter that is associated with the trigger assembly 20, frame 12, rail 13 or mounting arm 19 depending on the application. Accordingly, the sled will not push the bowstring 11 against or into engagement with the safety 24 and/or its forward end 24F. As further shown in FIG. 7, there can remain a distance D1 between the bowstring 11 and the front forward face 24F of the safety. In this configuration, the safety 24 can remain in the safety on mode, however no part of the sled or the bowstring is engaging the safety 24. Thus, if desired by a user, the user can switch the safety, thereby moving it from the position shown in FIG. 7, to, for example, the position shown in FIG. 10 which corresponds to the safety off mode. In doing so, the bowstring is out of the path of movement of the safety and does not interfere with its satisfactory movement. Optionally, as described below, when the crank 50 is used to move the sled via the cord and its portions C1 and C2, the crank can automatically lock so that the cord portions C1 and C2 will not unwind or unspool from the crank, and thus the cord portions can hold the sled and bowstring under a constant force while the de-cocking operation is commenced and continues.

With the sled 30 in the de-cocking mode and the stops 38 and 39 against the stop engagement surface SES or stop limiter, the safety as mentioned above can be converted from the safety on mode shown in FIG. 7 to the safety off mode shown in FIG. 8. To do so, again, a user can simply engage the safety shown in FIG. 6 and move it forward in direction R4 as shown in FIG. 8. In doing so, the forward end 24F of the safety 24 and in particular the safety bar 24B, optionally can move closer to the bowstring, reducing the distance D1 between the bowstring and that forward end. The safety detent 24D also can move from the forward notch to the second or rearward notch 24SF of the safety and/or safety bar 24B. The rear end or portion 24R of the safety also can move forwardly within the safety slot 20SS such that the rear end 24R clears the sear safety pin 22SP. In this configuration, the sear safety pin 22SP can move upward and optionally into the safety slot 20SS upon movement thereof via the sear 22 which can be affected via movement of the trigger 21T as described below.

Figure 9:
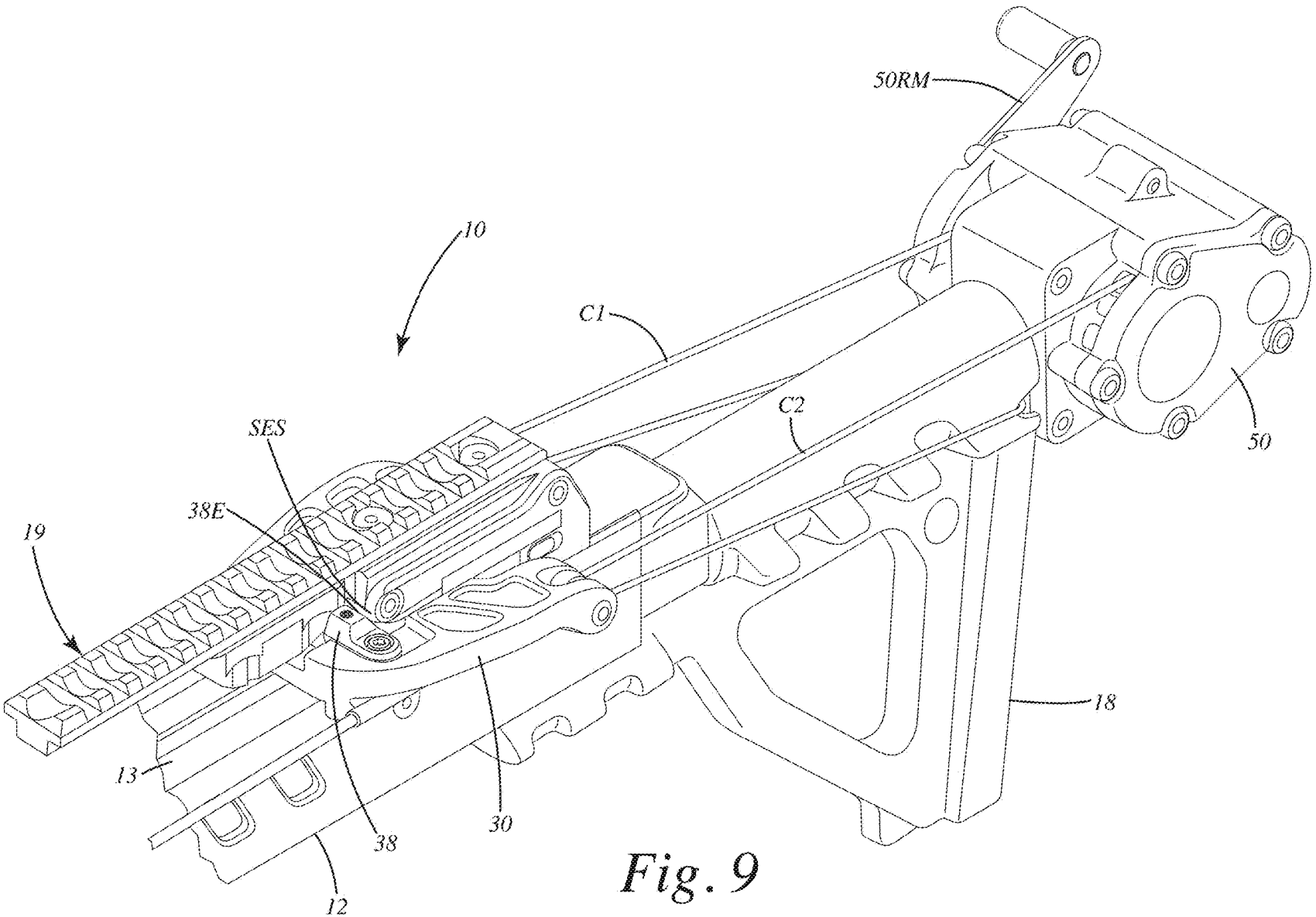
FIG. 9 is a close-up view of the sled with the pair of stops on the sled still in the de-cocking mode and arrested against the stop engagement surface atop the crossbow to stop rearward movement of the sled toward the safety.

With reference to FIGS. 9 and 10, the sled 30 can remain in place, held by the crank 50, holding the bowstring 11 in a fixed position even though the bowstring exerts significant forward force on the sled. The stops 38 and 39 remain engaged with the stop engagement surface SES to prevent any further movement of the bowstring 11. The safety 24, in particular the safety bar 24B, remains forward as shown. The anti-dry fire mechanism remains disengaged from the safety 24 via the protrusion 36 of the sled. In this condition, a user can exert the force F1 on the trigger 21T which in turn moves the trigger bar 21B rearward in direction R7. This rotates the sear 22 about the pivot pin 22P which in turn engages the sear safety pin 22SP moving it up in direction R6. Again, because the safety is in the safety off mode, the sear safety pin 22SP can move into the safety slot 20SS behind the rear surface 24R of the safety bar 24B. The engagement surface 22E of the sear also moves downward out of engagement with the engagement surface 23E of the catch. As a result, the catch is free to rotate in direction R8 under any force exerted upon the catch via the bowstring 11.

Figure 11:
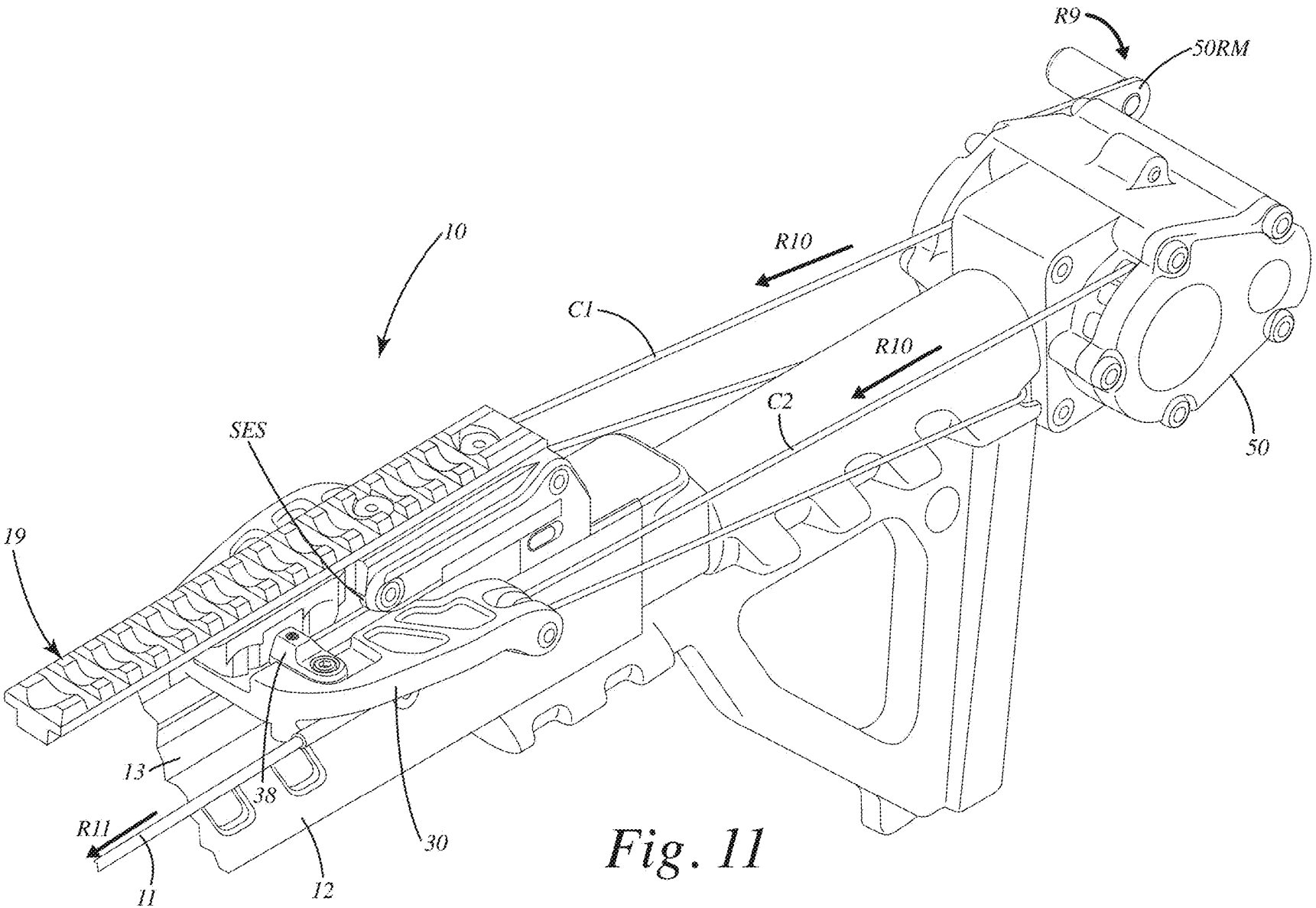
FIG. 11 is a close-up view of the sled with the pair of stops on the sled still in the de-cocking mode but with the stops and sled moving slightly forward under operation of a crank mounted on the stock of the crossbow.
Figure 12:
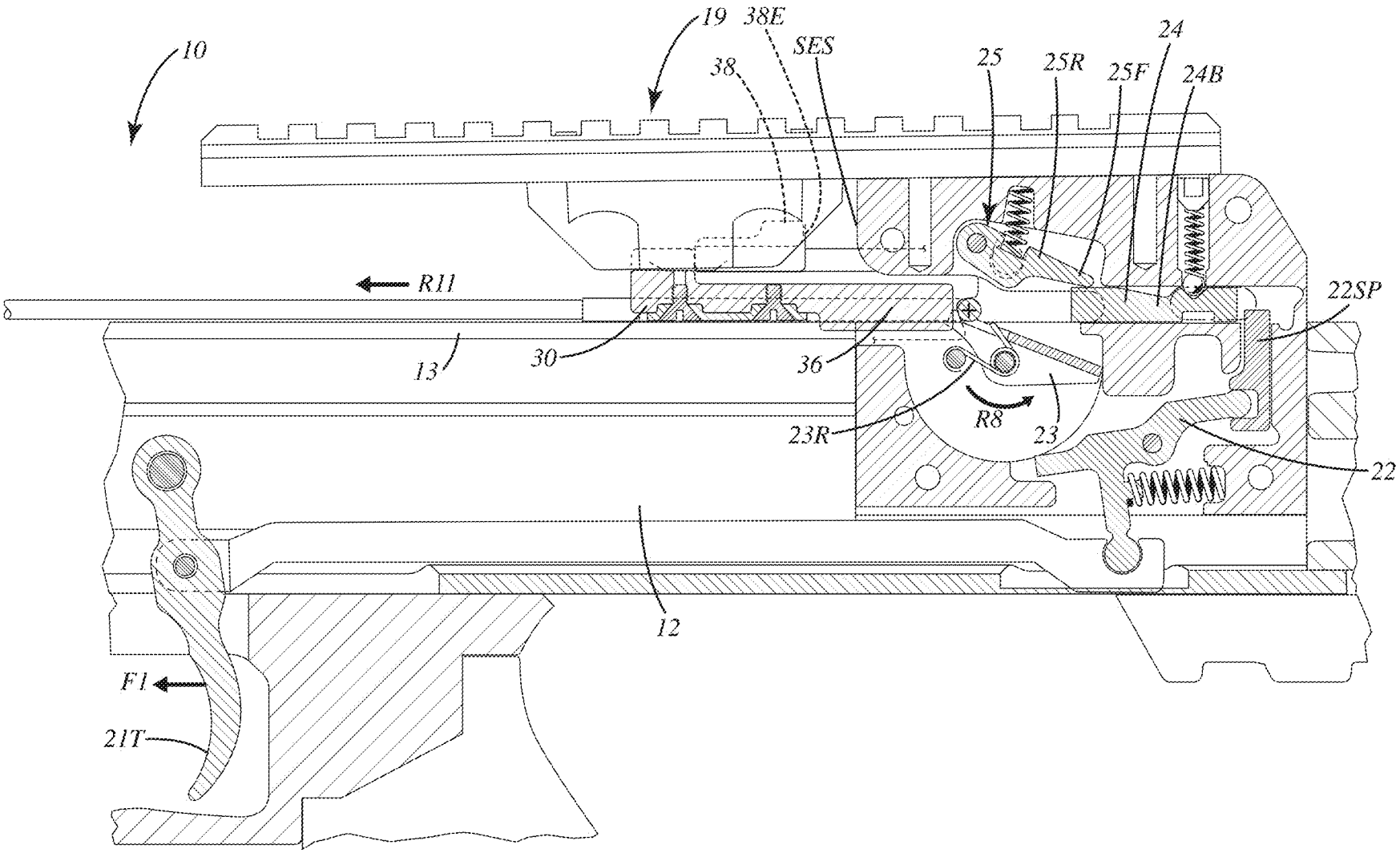
FIG. 12 is a partial section view of a trigger assembly with the bowstring drawn and a sled on the frame in a de-cocking mode, with the sled moving forwardly under control of the crank and the safety in the safety off mode, wherein the trigger has been pulled and a sear is in a fire mode, with the sear safety element past the safety and the catch fully transitioned from the holding mode to the drop mode such that the bowstring moves forwardly with the sled in the de-cocking mode.

With reference to FIGS. 11 and 12, the de-cocking system continues to de-cock the crossbow 10, letting the bowstring move from the drawn mode to the released or undrawn mode generally in direction R11. The bowstring 11 also remains under a very high tension when moving in this direction R11 due to the energy stored in the limbs and applied via the limbs and cams to the bowstring 11. The crank 50, however as described below can counter this force selectively based on input from the user. Optionally, the user rotates the crank arm 50RM in the direction R9. This allows the cord and its portions C1 and C2 to unwind from the crank 50 in directions R10. As a result, the sled 30 moves with the bowstring 11 forwardly along the frame 12 and rail 13, toward the riser of the crossbow. This let down of the bowstring, however, again is selectively controlled by the crank as described below. As shown in FIG. 12, because the catch 23 is allowed to move in direction R8, without the sear 22 engaging the catch any longer, that catch 23 can allow the bowstring 11 to ride over it and effectively release the bowstring. The catch 23 thus no longer holds the bowstring in the drawn mode because the catch is effectively in its drop mode. In the condition shown in FIG. 12, the sear also is in the fire mode, with the safety in the off mode. The anti-dry fire element is also in a lockout position. Of course, as the protrusion 36 of the sled 30 moves farther forward, the anti-dry fire element 25 and in particular the arm or finger 25F can move downward to touch a portion of the safety 24 and/or the safety bar 24B. The movement of the sled forwardly toward the riser can continue, with the crank 50 being operated via rotation of the crank arm 50RM moving in direction R9 until the bowstring is in its released mode or undrawn mode.

After this is completed, the bowstring can be considered de-cocked. When it is de-cocked, the sled can be disengaged from the bowstring and the crank 50 with their respective cord joined with the sled can be removed from the crossbow 10 for storage until the sled and crank are used again to draw the bowstring from the release mode to a drawn mode during a cocking operation of the crossbow. Of course, with the above de-cocking operation, a user need not shoot the arrow A shown in FIG. 1 from the crossbow to effectively convert the bowstring from the drawn mode to the released mode. Further, it will be appreciated that after the de-cocking operation, the trigger assembly 20 can be reset to a configuration shown generally in FIG. 5, without the bowstring present via the system of springs 22S and 23S within the trigger assembly. A user also can move the safety from the safety off mode back to the safety on mode before cocking the archery bow again. Further, if the same sled 30 and crank 50 are used, a user can reset the stops from the de-cocking mode to the neutral mode by rotating the respective stop blocks and flanges from the configuration shown in FIG. 14 to the configuration shown in FIG. 13.

As mentioned above, the current embodiment of the crossbow optionally can include a crossbow crank 50. As shown in FIGS. 2 and 17-22, the crossbow crank 50 will now be described in further detail. The crossbow crank can be used in lieu of a manual rope joined with the sled 30 to draw or cock the bowstring 11 to the drawn mode and/or to undraw or de-cock the bowstring 11 to the released or undrawn mode. The crank 50 can work in concert with the sled 30 as described above or can be used in connection with another type of sled that is not particularly configured with a de-cocking system like the illustrated sled 30. As shown in FIG. 17, the crank can be temporarily mounted to the stock 18 of the crossbow 10 via a protrusion 18P that fits within the hole 18H defined by the stock. Of course, the crank 50 can be connected to the frame 12 or some other portion of the crossbow 10 in some other manner. Further, the protrusion and hole can be reversed on the stock 18 and crank 50, respectively.

Figure 19:
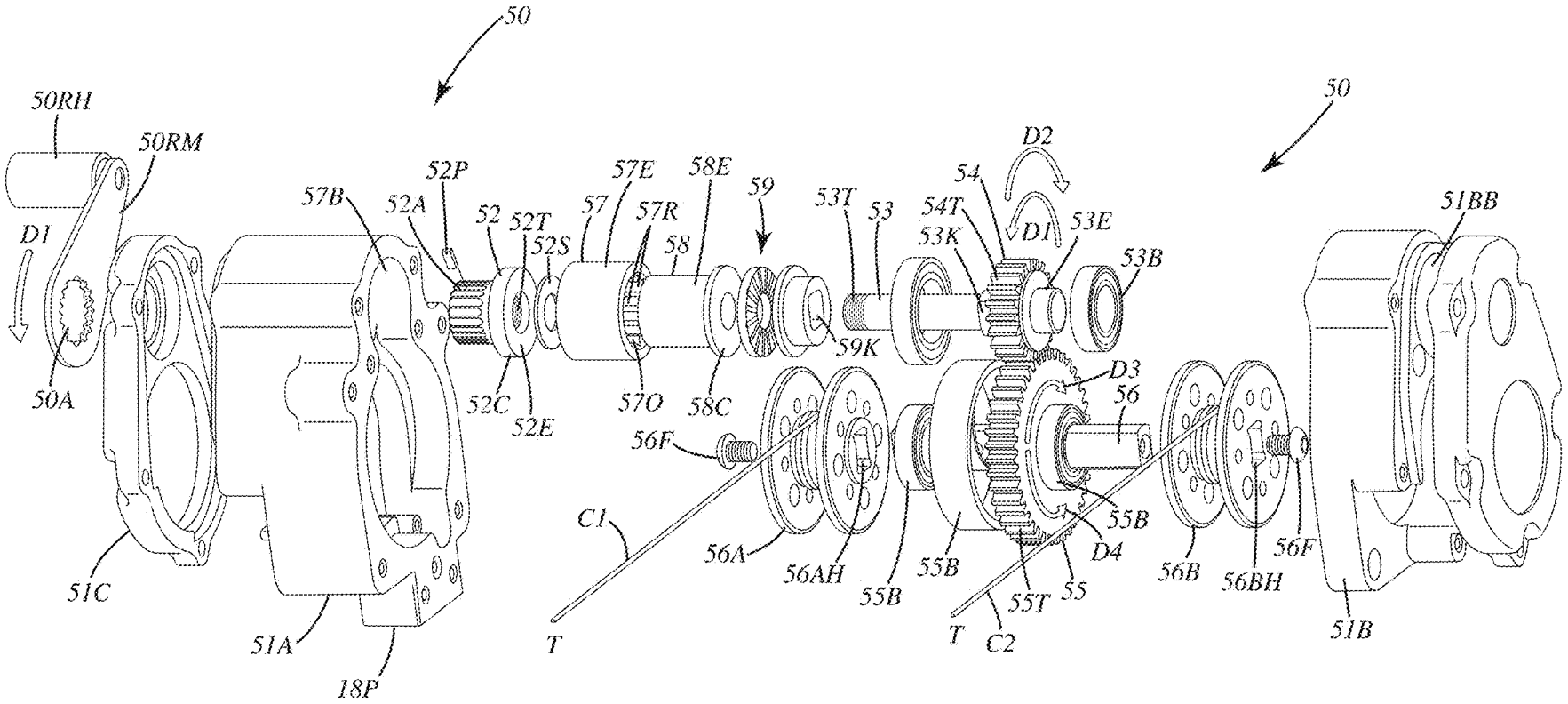
FIG. 19 is a further exploded view of the crossbow crank.
Figure 20:
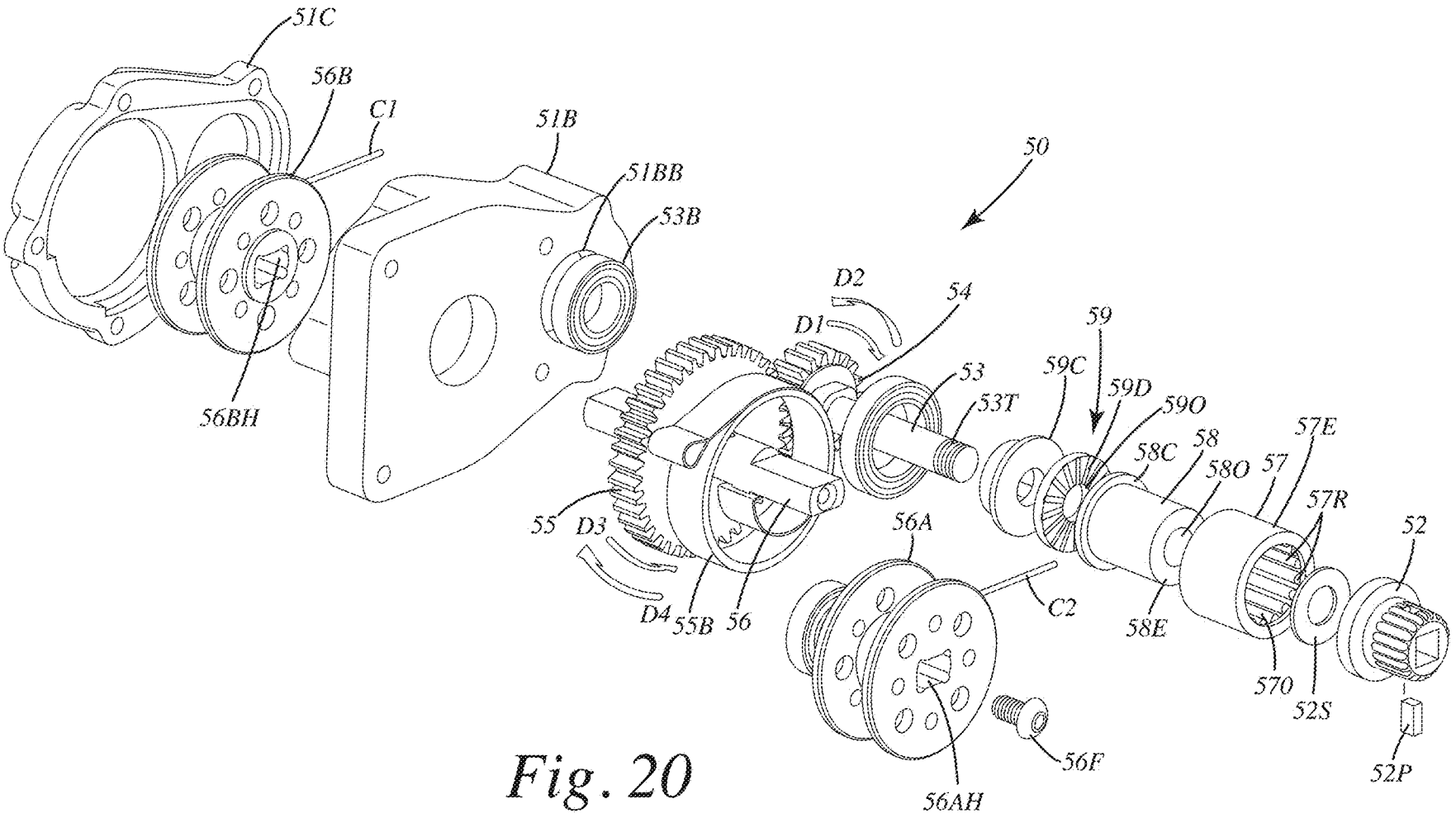
FIG. 20 is another exploded view of the crossbow crank.

Optionally, the crossbow crank can include a housing 51 comprised of multiple parts that conceal and protect other internal parts. The housing 51 can include a first section 51A and a second section 51B that are joined to one another via one or more fasteners. These fasteners 51F can be removed and replaced to disconnect their respective housing parts 51A and 51B to access the internal components of the housing. The housing also can include one or more covers 51C to cover the portions of respective spools as described below to gain access to the cord portions C1 and C2 that are wrapped on those spools or wrapped off those spools during a cocking and/or de-cocking operation with the crank 50. The crank can include a crank arm 50RM which can include a handle 50RH that can be rotatably joined with the arm 50RM. The crank can include an aperture 58 to which a portion of a drive nut 52 is joined. The drive nut can include one or more splines that interface with splines of the aperture 50A. The crank arm 50RM can be joined with the drive nut 52 via a pin 52P that fits within an aperture 52A to prevent the crank arm 50RM from sliding off the drive nut 52. Of course, other features can be included on the arm and the drive nut to secure these two elements together. The drive nut 52 can include internal threads 52T which again threadably engage threads 53T of the drive shaft 53, which is further connected to a drive gear 54 as shown in FIGS. 19 and 20. Optionally, a portion of the drive nut 52 in particular the collar 52C and the engagement surface 52E can be disposed inside the housing 51.

As shown in FIGS. 19-22 the crossbow crank can include a drive shaft 53 that is joined with a drive gear 54. The drive shaft 53 can be threadably joined with the drive nut 52. As mentioned above, the drive nut 52 can be joined with the crank arm 50 RM so that a user can rotate the drive nut 52 which engages the drive shaft 53 which again is connected to the drive gear 54.

Optionally, the drive shaft 53 can be an elongated round or cylindrical bar with a first end that includes threads 53T and a second end 53E that extends past the drive gear 54. The drive gear can be fixedly and non-rotatably joined with a drive shaft so that the drive gear and drive shaft rotate in unison. These components can be a single integral piece or can be connected via interfitting parts that prevent rotation. The drive shaft 53 can be mounted inside a drive shaft bearing 53B at the end 53E to promote rotation within the housing. The drive gear 54 can include a plurality of teeth 54T that mesh with corresponding teeth 55T of a secondary gear 55. The secondary gear 55 can be fixedly and rotatably mounted relative to a secondary shaft 56. The secondary shaft 56 can be mounted within the housing and can be disposed within bearings 55B on opposing sides of the secondary gear 55 to facilitate rotation of the secondary gear and secondary shaft 56 within the housing. These bearings 55B can be mounted in corresponding bearing holes or mounting holes in the housing 50.

The secondary shaft can further be joined with first 56A and second 56B spools, reels, or pulleys. These spools can be mounted to the shaft 56 at opposing ends, on opposite sides of the secondary gear 55 via fasteners 56F. The spools each optionally can include respective apertures 56AH and 56BH that are of a corresponding non-circular shape as the secondary shaft 56. Thus, when the spools are mounted on the shaft, the shaft is inserted in the respective apertures 56AH and 56BH such that the spools do not rotate relative to that shaft 56. As shown, each of the spools can be fixedly and non-rotatably mounted to the secondary shaft. The spools thus rotate with the secondary drive gear 55. The spools each can be configured to accommodate the cord that extends to the sled. For example, as shown in FIG. 19, the first spool 56A can accommodate the first cord portion C1 and the second spool 56B can accommodate the second cord portion C2. These cord portions of the cord can wrap onto and off from the spools depending on rotation of the secondary shaft that is motivated by the respective rotation of the secondary gear 55 and the primary or drive gear 54.

Optionally, the secondary gear 55 can be rotatable in response to rotation of the drive gear 54. As shown in FIG. 19, when the drive gear 54 rotates in direction D1, the secondary gear 55 and associated spools rotate in the third direction D3. As another example, when the drive gear 54 rotates counterclockwise, the secondary gear 55 rotates clockwise, as do the spools. In turn, the cord portions C1 and C2 wind onto the respective spools to pull on the cord and facilitate movement of the sled toward the crank. When the drive gear 54 rotates in a second direction D2, the secondary gear 55 rotates in a fourth direction D4 along with the spools 56A and 56B which in turn unwind the cord portions C1 and C2 therefrom to release the cord and facilitate movement of the sled away from the crank. As further shown in FIG. 19, the respective gears 54 and 55 can be mounted on the drive shaft 53 and the secondary shaft 56 which can be parallel to one another. The spools can be fixedly and non-rotatably joined with the secondary shaft 56. As illustrated, the drive gear optionally can be the only gear on the drive shaft, with no other gears or gear elements mounted to the drive shaft. Likewise, the secondary gear can be the only or single gear on the secondary shaft 56. Of course, in other applications, there may be additional drive gears and/or secondary gears mounted to the respective shafts. Moreover, if desired, there can be additional secondary shafts and/or additional drive shafts mounted in the crank housing to provide additional mechanical advantage in some applications.

Optionally, a biasing element 55B can be mounted in the housing and to the secondary shaft 56. This biasing element can be in the form of a spring and optionally can be a flat plate coil spring that is configured to urge the secondary gear 55 in a second direction D4, for example, shown in FIG. 19 which in turn can assist in rotating the drive gear 54 and thus the drive shaft in direction D2 to tighten the threads 53T of the drive shaft 53 relative to the drive nut 52 and tighten the drive nut 52 relative to the sleeve and the brake 59 along the drive shaft 53 thereby actuating the brake 59 as described below.

As shown in FIGS. 19-22, the crank 50 can include a one-way bearing 57 defining an opening 57O within which a sleeve 58 is disposed. The sleeve can be joined with a brake 59 that is disposed along the drive shaft 53. Optionally, the one-way bearing 57, sleeve 58 and brake 59 can be located between the drive nut 52 and the drive gear 54 along the shaft 53. Each of these components will now be described in further detail. The one-way 57 bearing can be any one-way device that allows rotation of the drive shaft 53 and thus the drive gear 54 in a single direction, for example, a first direction D1, but impairs rotation of the drive shaft 53 and thus the drive gear 54 in a second direction, for example D2. Of course, the directions D1 and D2 can be reversed depending on the configuration of the respective shafts, gears, and spools. Optionally, rotation of the shaft in the first direction D1 can translate to the portions of the cord C1 and C2 being drawn onto the respective spools 56A and 56B, thus pulling on the sled 30 and drawing and/or de-cocking the bowstring 11 and the crossbow 10 in general. This one-way bearing 57 can be disposed in the housing 50 and for example, press fit or frictionally fit into a bore 57B of the housing 51A. Alternatively, the one-way bearing can be adhered to, glued, cemented, or secured in a fixed, non-rotational manner relative to the housing along its exterior 57E. Of course, fasteners welds or other constructions can be used to fix the bearing to the housing or some other structure. In this configuration, the exterior 57E of the bearing 57 is fixed and non-rotational relative to the bore 57B and the housing 51A. However, the rollers 57R that extend within the opening 57O of the bearing 57 can allow relative rotation of the sleeve 58 disposed in the opening relative to those rollers selectively in the first direction D1, but not in the second direction D2. Of course, in other applications, the rollers can be reversed and can allow rotation in the second direction D2 but not the first direction D1.

As used herein, a one-way bearing can comprise a one-way bearing, a one-way clutch, a roller clutch, a sprag clutch, a backstopping clutch, or similar one-way devices. Generally, however, the one-way bearing is not in the form of and does not include a one-way ratcheting mechanism having a pawl that intermittently interfaces with teeth and a gear. The one-way bearing herein is smoother, more quiet, and less noticeable in actuation than such a ratcheting mechanism and can be well suited for hunting environments. One commercial example of a one-way bearing is the one-way bearing under the name of TRITAN Needle Roller Bearing, available from Grainger of Lake Forest, Illinois. Another commercial example of a one-way bearing is a one-way clutch roller bearing under the name of the HF Series, available from MiSUMi of Schaumburg, Illinois. Yet another commercial example of a one-way bearing is a sprag clutch available from GMN Bearing USA of Katy, Texas.

With further reference to FIGS. 19 and 20, the one-way bearing is arranged along the drive shaft 53 between the brake 59 and the drive nut 52. The drive shaft 53 can extend through the opening 57O of the one-way bearing 57. The sleeve 58 can be interposed between the shaft 53 and the rollers 57R. As shown, the sleeve 57 can be a generally cylindrical and/or tubular element that includes an opening or bore 580 through which the shaft is disposed. The shaft 53, when simply fit through the sleeve 58, can rotate relative to the sleeve and the sleeve relative to the shaft, in conditions where the brake 59 is not axially compressed as described below. The sleeve 58 can include a brake collar 58C at one end and an engagement surface 58E at the other end. The engagement surface 58E can be directly adjacent a drive nut spacer 52S that fits within the opening 57O or slightly outside of it and the one-way bearing 57. The drive nut spacer does not optionally contact any of the rollers 57R or the one-way bearing 57 in general. It can, however, selectively be frictionally engaged against the engagement surface 58E of the sleeve 58 as described below when compressed thereagainst by the drive nut 52 tightening on the threads 53T of the drive shaft 53. The drive nut spacer 52S can be constructed from a softer material, such as brass, a composite, and/or a polymeric material. Optionally it can bite into and provide good engagement and contact between the drive nut 52 and the sleeve 58.

As further shown in FIGS. 19 and 20, the sleeve can include and/or be joined with the brake collar 58C, which can be referred to as a first brake collar. The brake 59 can comprise this first brake collar 58C, as well as a second brake collar 59C and a brake disc 59D. These components, that is the first brake collar 58C, second brake collar 59C and brake disc 59D can be disposed along the shaft 53, optionally between the drive gear 54 and the one-way bearing 57 and/or drive nut 52. The brake disc itself 59D can be disposed between the first brake collar 59C and the second brake collar 58C. The brake disc 59D can include an opening 590 through which the shaft 53 is disposed and can rotate relative thereto. The second brake collar 59C also can define an opening through which the drive shaft 53 can be disposed and can rotate relative thereto. Optionally, each of the openings of the sleeve, the brake collars and the disc are all of a diameter that is larger than the diameter of the drive shaft 53 such that all of the sleeve 58 and brake 59 components can rotate freely relative to the drive shaft 53, when the brake 59 is not actuated as described below. Further optionally, the second brake collar 59C can define a contoured portion of the opening having one or more the first lands 59K. This contour opening and the first lands 59K can mate with one or more corresponding second lands 53K that are fixed and stationary relative to the drive gear 54 and/or the shaft 53. Accordingly, the first and second lands 53K and 59K can contact and/or mate with one another to prevent rotation of the second brake collar 59C relative to the drive shaft and/or the drive gear 54. However, these components can be disassociated from one another so that the second brake collar 59C can be removed from the drive shaft, along with the disc and the sleeve and other components.

The crossbow crank 50 can be constructed to include the one-way bearing and the brake as described above to provide certain functionality. For example, the crank 50 can be manually operated by user by rotating the crank arm 50RM in a first direction, for example D1. As this occurs, the shaft 53 and sleeve 58 automatically lock to one another to rotate the drive shaft in the first direction D1, with the sleeve and drive shaft rotating in unison, optionally with the drive gear 54 which in turn rotates the secondary gear 55 spooling on the portions of the cord C1 and C2 to the respective spools 56A and 56B. This in turn pulls the sled 30 along the barrel or frame 12 to move the bowstring during a drawing and/or de-cocking operation of the crossbow 10. However, the sleeve and drive shaft can automatically unlock from one another upon manual actuation of the crank arm 50RM in a second, opposing direction D2. As a result, the drive shaft 53 can rotate freely relative to the sleeve 58 and unencumbered by the one-way bearing 57. The associated drive gear 54 can rotate the secondary gear 55 and the respective spools 56A and 56B in a fourth direction D4 so as to allow the cord portions C1 and C2 to unwind from those spools. As a result, a sled connected to the spools via the cord can be controllably pulled by the tension in the bowstring 11, pulling down the sled to de-cock the bowstring or move the bowstring from the drawn mode to a released or undrawn mode. The aforementioned locking and unlocking can be at least partially affected via the interaction of the brake 59 with the drive shaft 53 and drive gear 54 as described below.

As mentioned above, the brake can be disposed along the drive shaft 53, optionally distal from the one-way bearing 57. The brake can be axially compressible along the drive shaft 53 to fixedly join the drive shaft with the sleeve 58 that is disposed in the opening of the one-way bearing when the drive shaft is rotated in the first direction D1, for example, upon manual input by user on the arm 50RM. Upon this axial compression, the one-way bearing 57 allows rotation of the sleeve 58 in that direction D1. The rollers 57 optionally can rotate relative to the exterior surface 58E of the sleeve 58 as the sleeve rotates in unison with the drive shaft 53. This axial compression of the brake along the drive shaft can fix the drive shaft to the sleeve in a non-rotatable manner. The axial compression also temporarily fixes the sleeve, brake, shaft, and drive gear as a single unitary rotating structure.

Optionally, when manual user input is discontinued to the arm 50RM of the crank 150, the tension in the cord, for example, the cord portion C1 will urge the secondary gear 55 to rotate in the fourth direction D4 which in turn will urge or attempt to rotate the drive gear 54 and the shaft 53 in the second direction D2. However, because the drive shaft 53 and drive gear 54 are fixed non-rotatably to the sleeve 58, when that sleeve attempts to rotate initially against the rollers 57R in the second direction D2, due to the brake automatically locking and all the components rotating as a single unit, the one-way bearing 57 will engage the sleeve to impair the drive shaft, sleeve, drive gear, secondary gear and spools from rotating in a manner that allows the cord portions C1 and C2 to unravel or unwind from the respective spools 56A and 56B. As a result, the sled 30, even though being pulled under the forces of a partially or fully drawn bowstring 11, will not be moved or pulled toward the riser 16 of the bow. Further, due to the arresting of rotation in the second direction D2 of the shaft 53, the crank arm 50RM likewise will not begin to spin uncontrollably in the direction D2 with the shaft 53 upon cessation of the manual actuation of the crank.

In most cases, any tension T in the cord and its cord portions C1 and C2 caused by the bow string pulling on the sled counteracts rotation of the drive shaft 53, drive gear 54 and crank arm 50RM in the first direction D1, and urges the drive shaft or generally produces a force attempting to rotate the drive shaft in the second direction D2, however, the drive shaft and drive gear are prevented from rotating in the second direction via the one-way bearing 57 interacting with the sleeve 58 which is again locked to the shaft in a fixed and non-rotational manner relative via the brake 59.

Figure 21:
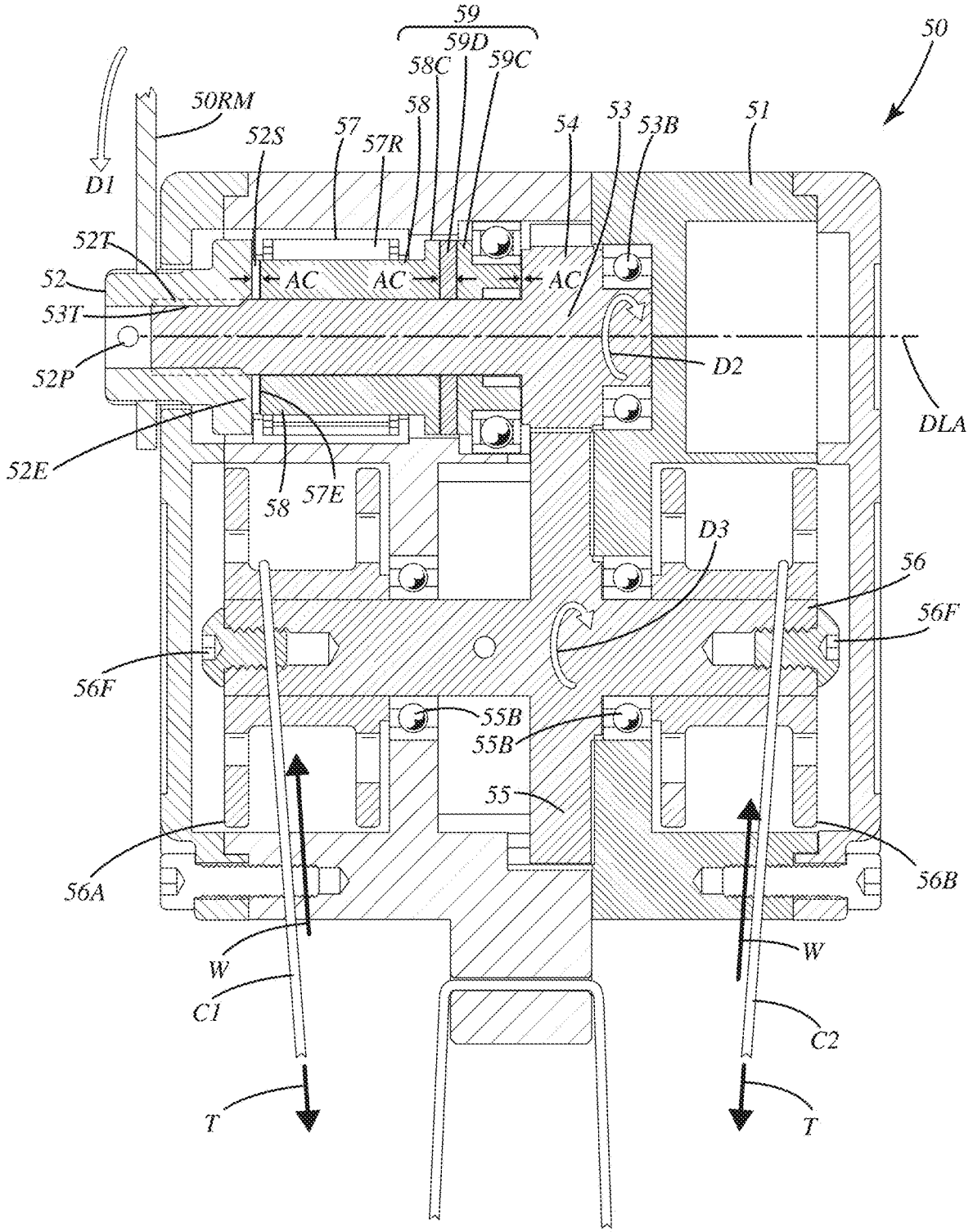
FIG. 21 is a section view of the crossbow crank with a drive shaft locked relative to a sleeve via a brake, so that a one-way bearing allows rotation of the drive shaft, a drive gear and one or more spools in a first direction, but impairs rotation of the drive shaft, the drive gear and one or more spools in a second direction opposite the first direction.

The automatic activation and deactivation of the brake 59 and thus the automatic locking and unlocking of the sleeve 58, drive shaft 53, and drive gear 54 relative to one another can be provided via rotation of the drive nut 52 with the crank arm 50RM. For example, as shown in FIG. 21, when the crank arm 50RM is rotated in direction D1, this likewise rotates the drive nut 52 in that same direction D1. As a result, the threads 52T of the drive nut tighten relative to the threads 53T of the drive shaft 53. The distance between the drive nut 52 and the drive gear 54 is reduced or decreased. This in turn causes the drive nut engagement face 52E to press against the drive nut spacer 52 which in turn pushes farther against the engagement face 58E of the sleeve 58. This compression continues axially, parallel to the drive shaft longitudinal axis DLA and along the drive shaft 53. As a result, the various components along the drive shaft 53 begin to and continue to axially compress under an axial compression force AC. This in turn causes the brake collar 58C to compress against the brake disc 59D which compresses against the other brake collar 59C which in turn compresses against the drive gear 54 or lands of the drive shaft 53. With all of these components axially compressed, the brake 59 effectively rotationally locks the sleeve 58 relative to the drive shaft 53 and drive gear 54. Thus, all of these components rotate in unison as a single unit, that is, the drive nut 52, sleeve 58, brake 59, drive shaft 53 and drive gear 54 all rotate in unison about the drive shaft longitudinal axis DLA. These components can rotate in unison in the first direction D1, however, when rotation ceases in direction D1, and the tension in the one or more cord parts C1 and C2 urge rotation of the drive gear 54 and thus the drive shaft 53 in direction D2, this rotation in direction D2 is impaired via the one-way bearing 57 interacting with the sleeve which again is axially compressed with the brake and rotationally fixed to the drive shaft due to the brake 59. Accordingly, the drive shaft 53 is impaired from rotation in that second direction D2. This impairment of rotation in the second, opposite direction D2 can be achieved without any further manual input by the user on the crank arm and/or the winch in general. Again, this is because the brake is activated automatically to ensure that the drive shaft and sleeve that extends within the opening of the one-way bearing 57 are all locked rotationally to one another.

As briefly described above, it will be appreciated that upon manual rotation of the crank arm 50RM in direction D1, the drive shaft 53 rotates in direction D1 along with the drive gear 54, which turns the secondary gear in direction D3 which in turn rotates the respective spools 56A and 56B to pull the cord, and in particular the portions of the cord C1 and C2 in the winding direction W and thereby wind those cord portions C1 and C2 on the respective spools. This cord winding translates to movement of the sled to which the cord is attached to draw or cock the bowstring of the crossbow 10. Optionally, as the user rotates the drive shaft 53 in the first direction D1, that shaft 53 is fixedly joined with a gear 54 in a housing, with the gear 54 being rotatably coupled to the spools 56A, 56B so that the spools wind the cord portions C1 and C2 thereon. The rotation axially compresses the brake 59 along the shaft 53 during and as a result of the rotating in the first direction D1 to fixedly join the shaft 53 with the sleeve 58 disposed around the shaft 53 so that the shaft 53, gear 54 and sleeve 58 rotate in unison. As mentioned, the sleeve can be disposed in the one-way bearing 57 that is joined with the housing 51 so that when the rotating in the first direction D1 ceases, the shaft and gear are impaired from rotating in a second direction D2 opposite the first direction D1 via the one-way 57 bearing interacting with the sleeve 58.

The crank 50 can be used to draw the bowstring of the crossbow 10. For example, as shown in the configuration shown in FIG. 21, where the sleeve 58 and drive shaft 53 are automatically locked to one another via the brake 59, the user can rotate the crank arm 50RM to pull on the cord portions C1 and C2 in the winding direction W as shown. The user can do this to pull the sled 30 and draw the bowstring 11 as shown, for example, in FIG. 2. In this configuration, the sled can be set up so that the stops 38 and 39 are in the neutral mode to allow full draw of the bowstring past the catch 23 as shown in FIG. 4, optionally with the safety 24 in the safety on mode.

Figure 22:
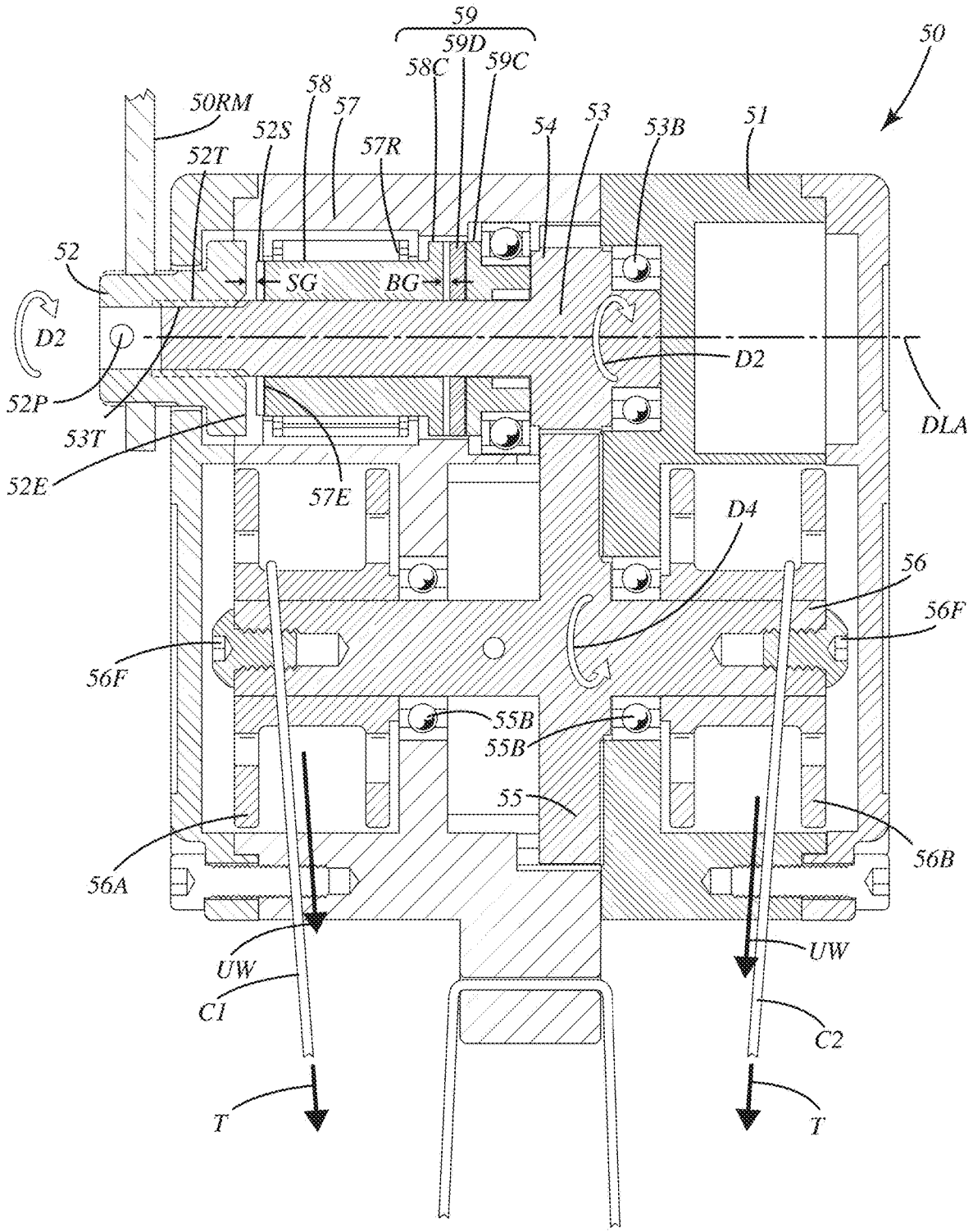
FIG. 22 is a section view of the crossbow crank with a drive shaft spinning freely relative to a sleeve and a one-way bearing so that the drive shaft and a drive gear and one or more spools can rotate in a first direction and/or an opposite direction, without being impaired by the one-way bearing in either direction.

After the bowstring 11 is captured by the catch 23, for example, as shown in FIG. 5, the sled 30 can be removed. This removal can be facilitated by slack being established in the cord and its cord portions C1 and C2. To provide this slack, a user, as shown in FIG. 22 can rotate the crank arm 50RM in direction D2. This rotation in direction D2 unthreads the threads 52T of the drive nut 52 from the threads 53T of the drive shaft 53. As a result, the drive shaft becomes disengaged from the sleeve and can rotate freely with the drive nut and crank arm 50RM as the user holds the crank arm 50RM. As this occurs, the drive gear 54 can rotate in direction D2 as well which in turn causes the secondary gear 55 to rotate in direction D4 causing the spools 56A and 56B to likewise rotate in direction D4. This rotation and direction D4 allow the cord portions C1 and C2 to unwind in direction UW from the spools. The user can pull the sled 30 as shown in FIG. 2 forwardly in direction J to disengage the sled from the bowstring and remove it from the rail 13. The user subsequently can remove the crank 50 from the crossbow along with the cord portions C1 and C2, and the sled 30, to ready the crossbow for loading an arrow and shooting.

As mentioned above, the rotation of the crank in direction D2 as shown in FIG. 22 facilitates disengagement of the drive shaft 53 from the sleeve 57. This can occur when the drive nut 52 threads or loosens relative to the drive shaft 53. When this occurs, the drive nut 52 moves away from the drive nut spacer 52S and the sleeve engagement surface 58E. The drive nut engagement surface 52E thus becomes spaced by a gap SG from the spacer 52S. Optionally, the spacer 52S also becomes slightly spaced from the engagement surface 57E of the sleeve. When the drive nut no longer engages the spacer 52S, the axial compression AC, shown in FIG. 21, is decreased and/or eliminated. Thus, the brake 59 and its components, that is, the collars 58C and 59C as well as the disc 59D no longer are frictionally engaged with one another and small gaps BG can be established between one or more of these components. In this manner, the brake no longer locks the sleeve 58 to the drive shaft 53. Thus, these components can rotate freely relative to one another and more particularly, the drive shaft 53 and drive gear 54 can rotate and freely spin relative to the sleeve and the one-way bearing 57. Thus, the one-way bearing can no longer impair or act on the drive shaft 53 rotating in the second direction D2. As a result, the drive shaft 53 can freely rotate in the second direction D2 again without being prevented impaired or stopped from rotating via the one-way bearing 58.

Optionally, the disengagement of the drive nut 52 relative to the sleeve can occur automatically upon rotation of the crank arm 50RM in direction D2. No other input to any other components of the crossbow winch 50 are required to rotate the drive shaft 53 in direction D2 to let out or unwind the cord portions C1 and C2 in direction UW. Further optionally, the engagement of the drive nut relative to the sleeve can occur automatically upon rotation of the crank arm 50RM in direction D1, as shown in FIG. 21. No other input to any other components of the crossbow crank 50 are required to rotate the drive shaft 53 in direction D1 to wind or hold cord portions C1 and C2 in direction W.

The crossbow crank 10 can be used to de-cock the crossbow 10. For example, as shown in the configuration shown in FIG. 21, where the sleeve 58 and drive shaft 53 are automatically locked to one another via the brake 59, the user can rotate the crank arm 50RM to pull on the cord and its cord portions C1 and C2 in the winding direction W as shown. The user can do this to pull the sled 30 during a de-cocking operation, for example, as shown in FIGS. 6-12. In this configuration, the sled can be set up so that the stops 38 and 39 are in the de-cocking mode so that the bowstring 11 is not compressed against the safety 24 and so the safety can be actuated from the safety on mode shown in FIG. 7 to the safety off mode to actuate the trigger assembly as shown in FIGS. 10 and 12, thereby allowing the catch 23 to move to the drop mode, thereby allowing the bowstring 11 to move forward to the released or undrawn mode in a de-cocking operation.

When the catch is released to the drop mode and before that operation, the sled 30 can be urged forward by the bowstring. Tension T can be established in the cord portions C1 and C2, and this tension can be increased or greater after the catch 23 is moved to its drop mode. The sled can be held in place, for example, as shown in FIG. 10 via the cord portions that are around the spools in the crank. Due to the tension T in the cord portions, the drive shaft 53 can remain engaged with the sleeve 58 which can remain engaged with the one-way bearing 57. Accordingly, the drive shaft 53 can be prevented from rotating in the second direction D2, and thus the cord portions C1 and C2 can be prevented from unwinding from the respective spools 56A and 56B.

It will be noted, however, that as a tension T is applied via the cord portions C1 and C2 in a manner to unwind the cord portions in a direction UW, as shown in FIG. 22, this can automatically urge the secondary gear 55 to rotate in direction D4 slightly which will cause the drive gear 54 to also rotate in second direction D2 opposite the first direction D1. When this occurs, the drive shaft 53 will rotate in direction D2 slightly and thus drive shaft threads 53T thread into the threads 52T of the drive nut 52. Because the drive nut 52 is resting or positioned through the crank housing 51, and the arm 50RM provides some inertia, the drive nut 52 will not rotate. Thus, the drive shaft 53 will tighten relative to the drive nut 52 thereby axially compressing the components with the axial compression force AC via the brake 59 along the drive shaft 53 as shown in FIG. 21. As a result, the drive shaft 53 becomes non-rotatable relative to the sleeve 58. Because the sleeve 58 is disposed in the one-way bearing that prevents rotation in the direction D2, any further rotation of the drive shaft 53 in direction D2 is impaired and/or prevented. Further, the drive shaft, drive gear and spools are impaired from rotation so that the cord portions C1 and C2 will not unwind any direction UW off from the spools. In turn, this will prevent the bowstring 11 from uncontrollably pulling the sled 30 as it moves from the drawn mode to the released or undrawn mode.

Returning to FIGS. 22 and 12, after a user actuates the safety 24 and the catch 23 releases the bowstring, a user can manually actuate the arm 50RM and rotate it in direction D2. As a result, the drive nut 52 loosens relative to the drive shaft 53 and the threads 53T unthread from the threads 52T. Accordingly, one or more gaps SG, BG can be established between various components along the shaft, such as between the drive nut spacer 52S, the sleeve 58 and the brake 59 components. This in turn allows the drive shaft 53 and drive gear 54 to rotate unimpaired by the one-way bearing 57 in direction D2. As this occurs, the drive gear 54, also rotating in direction D2 rotates the secondary gear 55 and spools in direction D4. As a result, the cord portions C1 and C2 unwind and direction UW from the spools 56A and 56B while the user continues to rotate the arm 50RM manually in direction D2. This disengagement of the brake unlocks the sleeve 58 from the drive shaft 53 automatically and again allows the drive shaft 53 to rotate freely in either the first direction D1 or the second direction D2 without any constraint on rotation of the shaft via the one-way bearing 57. The user can continue to rotate the arm 50RM in direction D2, with the bowstring pulling on the sled 30 until the bowstring achieves the released mode. After that point, the user can remove the sled from the bowstring and the crank from the stock until the next cocking operation of the ball crossbow is warranted.

During the de-cocking operation, while the bowstring is let down via the sled 30 connected to the crank 50 via the cord C1 and C2, sometimes a user may cease rotating the shaft 53 in the second direction D2 via manual input through the crank arm 50RM. When this occurs, the crank prevents the crank arm 50RM from continuing to rotate uncontrollably in direction D2. In particular, the tension T in the cord portions C1 and C2 automatically urges the shaft 53 to rotate in the second direction D2 while the arm 50RM and drive nut 52 remain stationary. As a result, the threads 53T thread into the threads of the drive nut 52T to axially compress all the components between the drive nut 52 and the drive gear 54 along the drive shaft 53. This in turn causes axial compression of the brake 59 along the shaft such that the shaft and gear are again impaired from rotating in the second direction D2 via the one-way bearing interacting with the sleeve which is locked rotationally to the drive shaft.

A first alternative embodiment of the crossbow and a crossbow crank is shown in FIGS. 23-31 and generally designated 110 and 150, respectively. The crossbow and crossbow crank can be substantially similar or identical to the crossbow 10 and crank 150 in the embodiment above in structure, function, and operation, with several exceptions. For example, the crossbow 110 can include a riser 116 joined with a crossbow frame 112 and a stock or butt 118 extending rearward from the frame 112. A first limb 114A and second limb 114B can be joined with the riser 116 with a bowstring 111 extending between cams 115A and 115B rotatably mounted on the respective limbs. A pistol grip 117 can be joined with the crossbow frame 112. All of these components can be identical or similar to like or similar components described in the embodiment of the crossbow 10 above.

Figure 27:
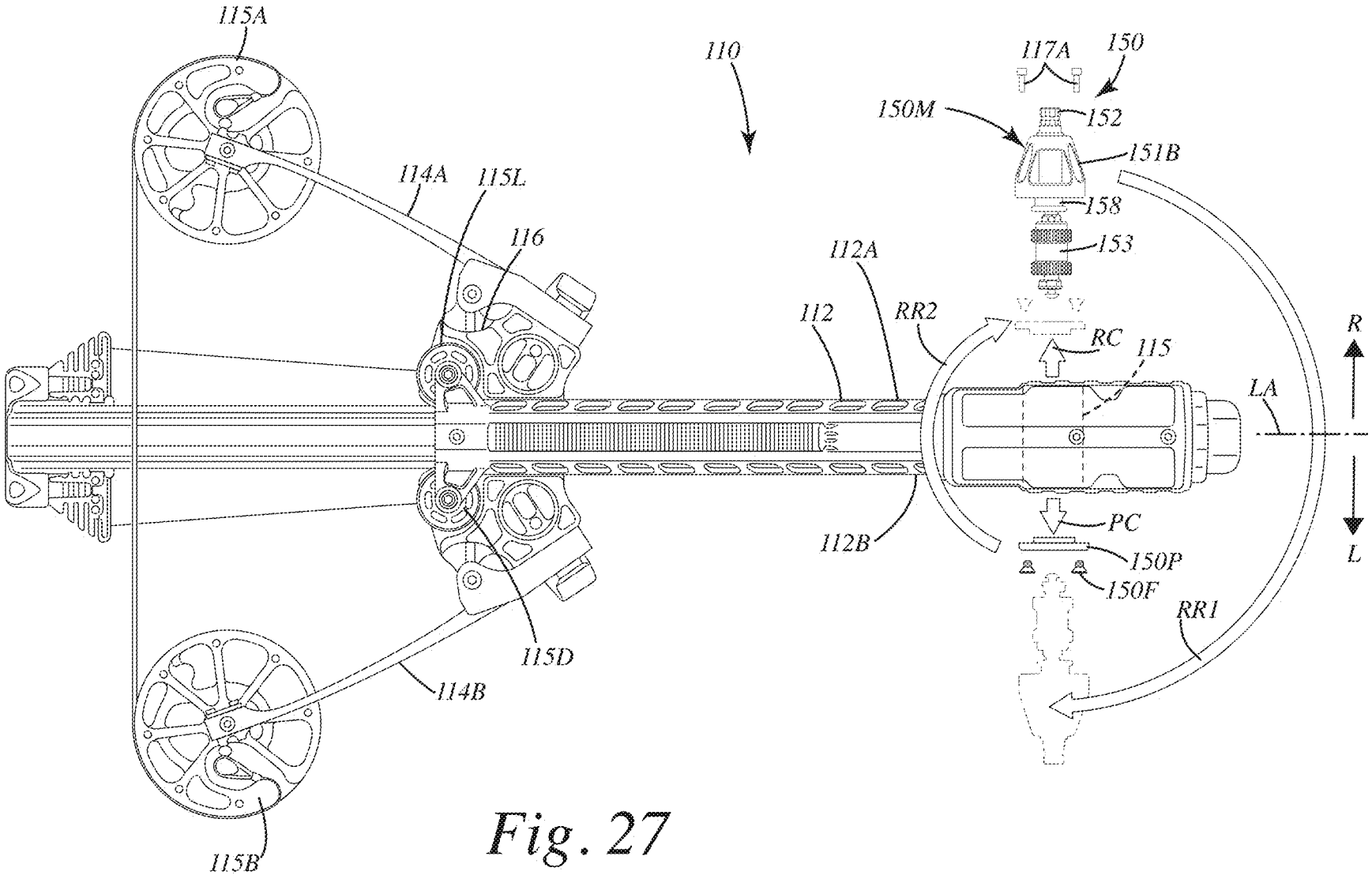
FIG. 27 is a top view of the crossbow with the reversible modular crossbow crank removed and being swapped from the right side to the left side for different handed cranking.
Figure 31:
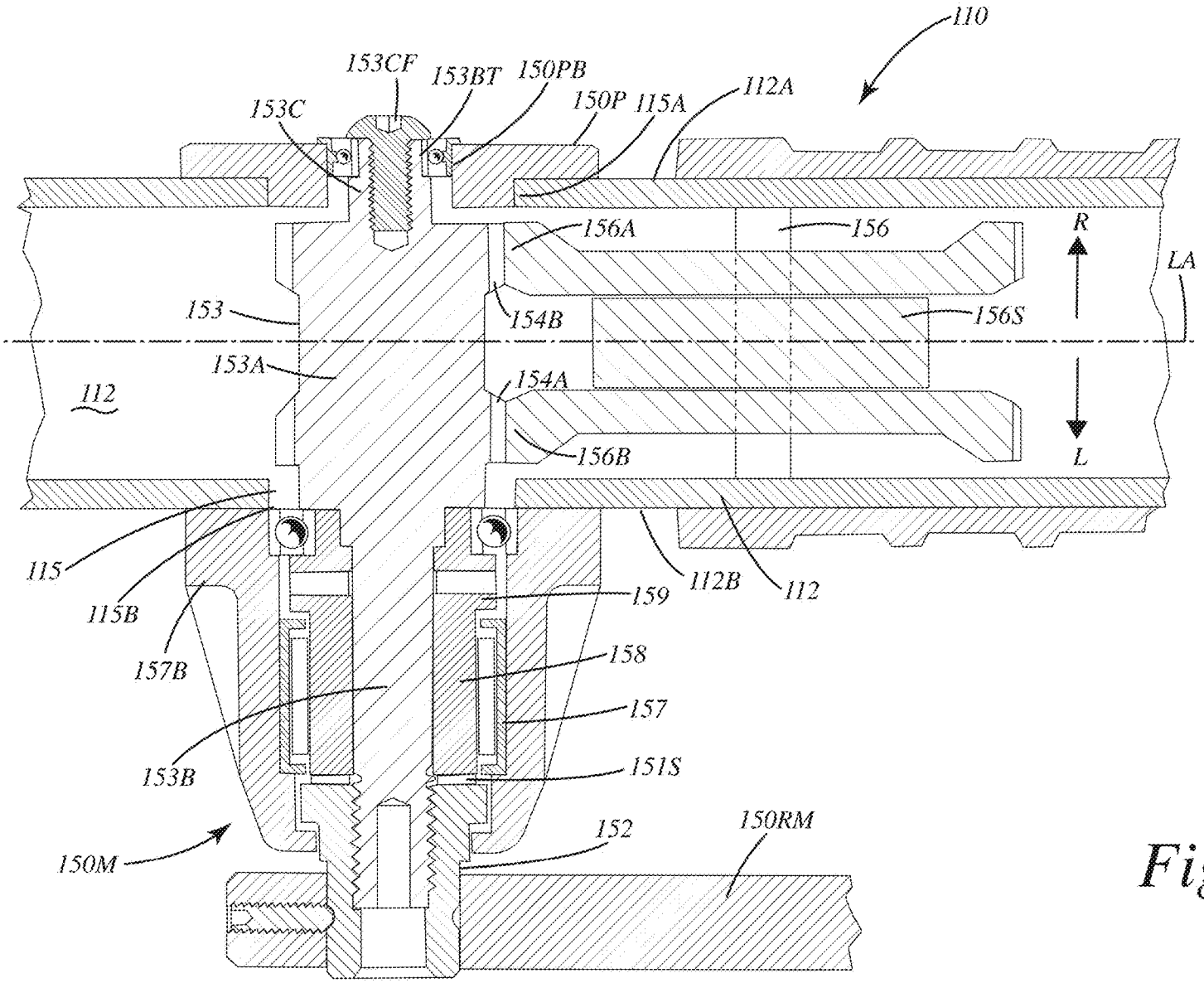
FIG. 31 is a partial section view of the reversible modular crossbow crank swapped to the right side of the stock of the crossbow.

In this embodiment, however, the crank 150 can be constructed to fit at least partially and/or removably inside the crossbow frame 112, rather than attached rearward of the stock 118. The crank and its components can form a crank module 150M which can be selectively mountable relative to the crossbow frame 112 on either the right side R or the left side L of the crossbow frame and/or longitudinal access LA as shown in FIGS. 27 and 31. With this removeable, replaceable and reorientable crank 150, the crossbow 110 can provide a user with the ability to reconfigure the crossbow crank 150 to a preferred side of the crossbow frame. Accordingly, the user can operate the crossbow crank 150 with the crank arm 150 RM to convert the crossbow to a drawn mode and/or to let down the crossbow and bowstring to an undrawn mode from the right side or the left side of the crossbow frame, whichever is more convenient or easy for the user.

In this embodiment, components other than the crank 150 optionally can be slightly different. For example, the crossbow 110 can include the limbs 114A and 114B with the associated cams 115A and 115B. These limbs can be reverse draw limbs as shown, so that the cams extend forwardly of the crossbow frame and rail. The bowstring 111 in the undrawn state can extend between the cams generally forward of their axes.

In this embodiment, the crossbow 110 optionally can include redirection pulleys 115C and 115D. These pulleys can redirect the bowstring 111 when it is drawn to a narrow configuration inside or below a barrel shroud 119 that is generally disposed above a rail or barrel 113 or the crossbow frame 112. The rail 113 can be similar to the rail above, and the location where an arrow is mounted or is disposed when the crossbow is drawn. Optionally, the crossbow can include a scope or rail mount 119M that can be fastened to or can be integral with the shroud 119 and/or the crossbow frame 112.

Further optionally, in this embodiment the crossbow 110, unlike the embodiment of the crossbow 10 above, can include a moving receiver 120 that is disposed at least partially within and/or adjacent the crossbow frame 112. The moving receiver 120 shown in FIG. 28 can be similar or identical to the receiver disclosed in pending U.S. application Ser. No. 18/756,477, entitled, Crossbow Bolt Retention Plunger, filed Jun. 27, 2024, which is hereby incorporated by reference in its entirety. For example, the receiver 120 can be movable along the frame 112 from a first position, generally adjacent and aligned with the cams 115A and 115B in an undrawn mode, to a second position, where the receiver 120 is distal from the cams and the limbs in the drawn mode shown in FIG. 28. There, the receiver is disposed in the second position, generally in the drawn mode in which it has drawn the bowstring to the drawn configuration. The receiver 120 can be moved from the undrawn mode to the drawn mode, that is, from the first position to the second position, by the crank 150 that is disposed within the internal compartment 112C defined by the crossbow frame or another component.

Figure 28:
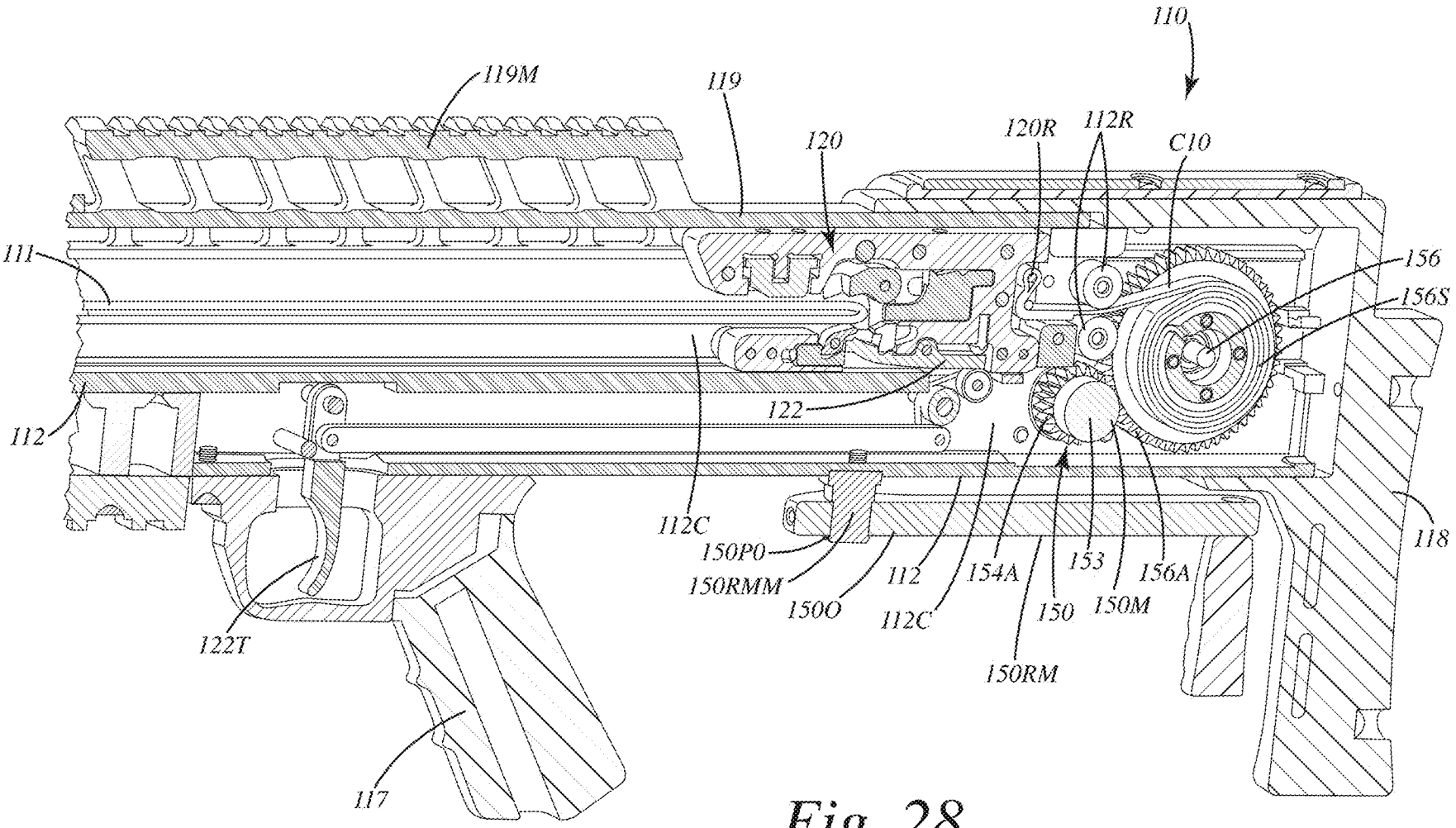
FIG. 28 is a section view of the crossbow and the reversible modular crossbow crank engaging a spool from which a web extends and is joined with a moveable receiver.

As shown in FIG. 28, the crank 150 and a particular a portion of the crank module 150M as described below can extend within or inside the crossbow frame 112. The frame itself can form an internal void, cavity, interior or compartment 112C that extends toward the butt 118 of the crossbow 110. Within the compartment 112C, the receiver 120 can be connected to a cord C10, which can be any cord C1, C2 of the types described in the embodiments above. In this embodiment, the cord C10 optionally can be more in the form of a web, strap, or ribbon. The cord C10 can be disposed between one or more rollers 112R and can be connected to the receiver 120 via one or more retaining rods or pins 120R. The cord C10 can extend to and can furl, wind, or wrap upon the spool 156S. The spool 156S can be rotatably mounted in the crossbow frame 112 and in particular inside the compartment 112C, rearward of the receiver 120 and generally between the receiver 120 and the butt 118 of the crossbow 110. The spool 156S can be configured to wind the cord C10 onto it, or off from it depending on the operation of the crank 150. The spool can be mounted to a secondary shaft 156, which itself can be mounted on bearings or other rotatable elements that can rotate within the crossbow frame 112. The secondary shaft 156 can extend to and be joined with respective sides 112A and 112B of the crossbow frame 112 so that the shaft remains generally stationary, but still rotates. The secondary shaft 156 and the spool 156S can be configured similar or identical to the respective secondary shaft 56 and spools 56A, 56B as described in the embodiment above.

Optionally, the shaft 156 can be offset from the first driveshaft 153 of the crank and its crank module 150M, similar to the shaft 56 being offset from the driveshaft 53 of the crank 50 described in the embodiment above. The secondary shaft 156 can also be parallel to the first or primary driveshaft 153. In this embodiment, however, the crank module 150M, crank 150 and driveshaft 153 can be disposed forward of the spool 156S and the second driveshaft 156. The first driveshaft 153 can also be disposed at least partially below the secondary shaft 156.

Figure 26:
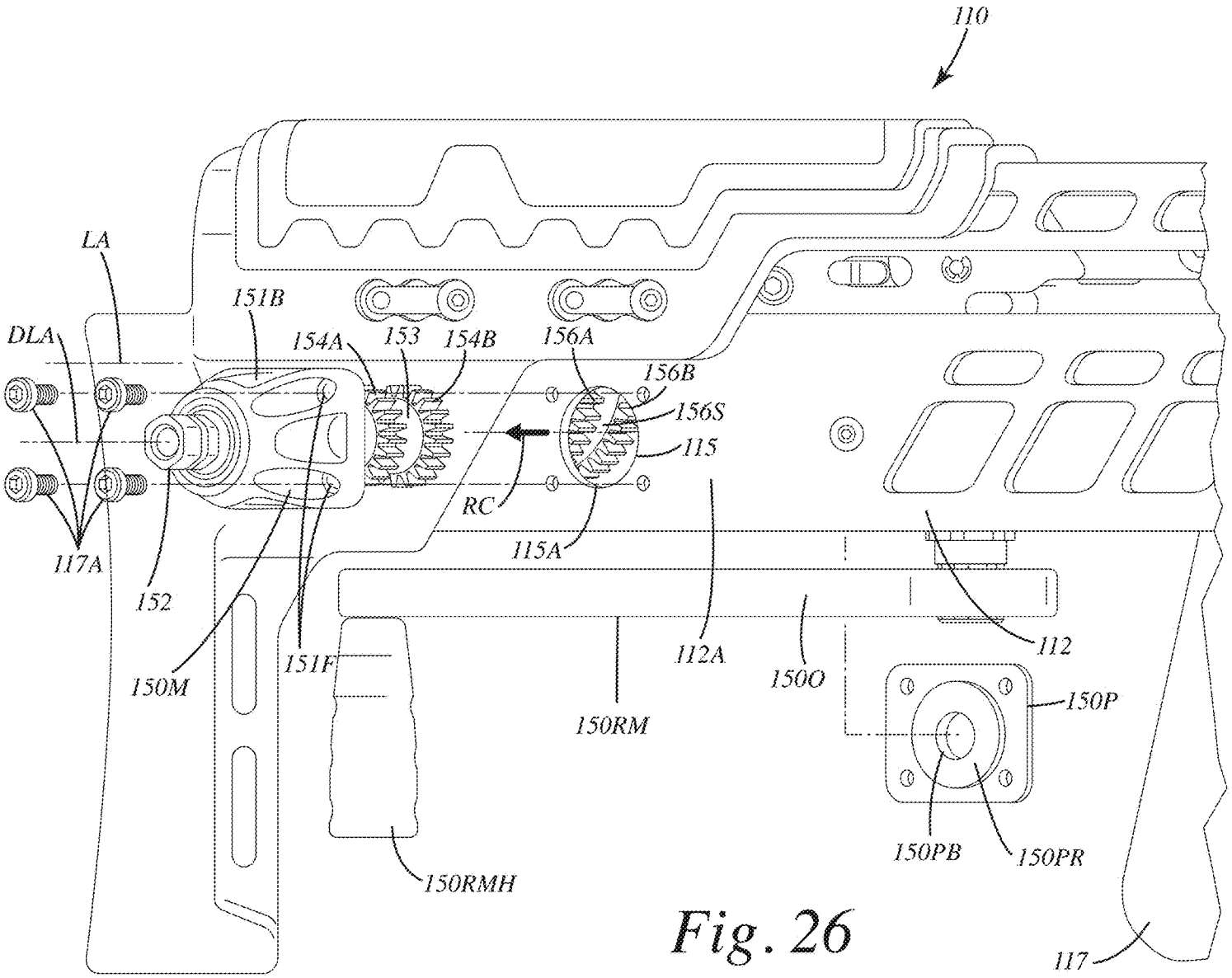
FIG. 26 is a partially exploded view of a crank housing, a one way bearing, and gears removed from the stock of the crossbow to swap the reversible modular crossbow crank from the right side to the left side for different handed cranking.
Figure 29:
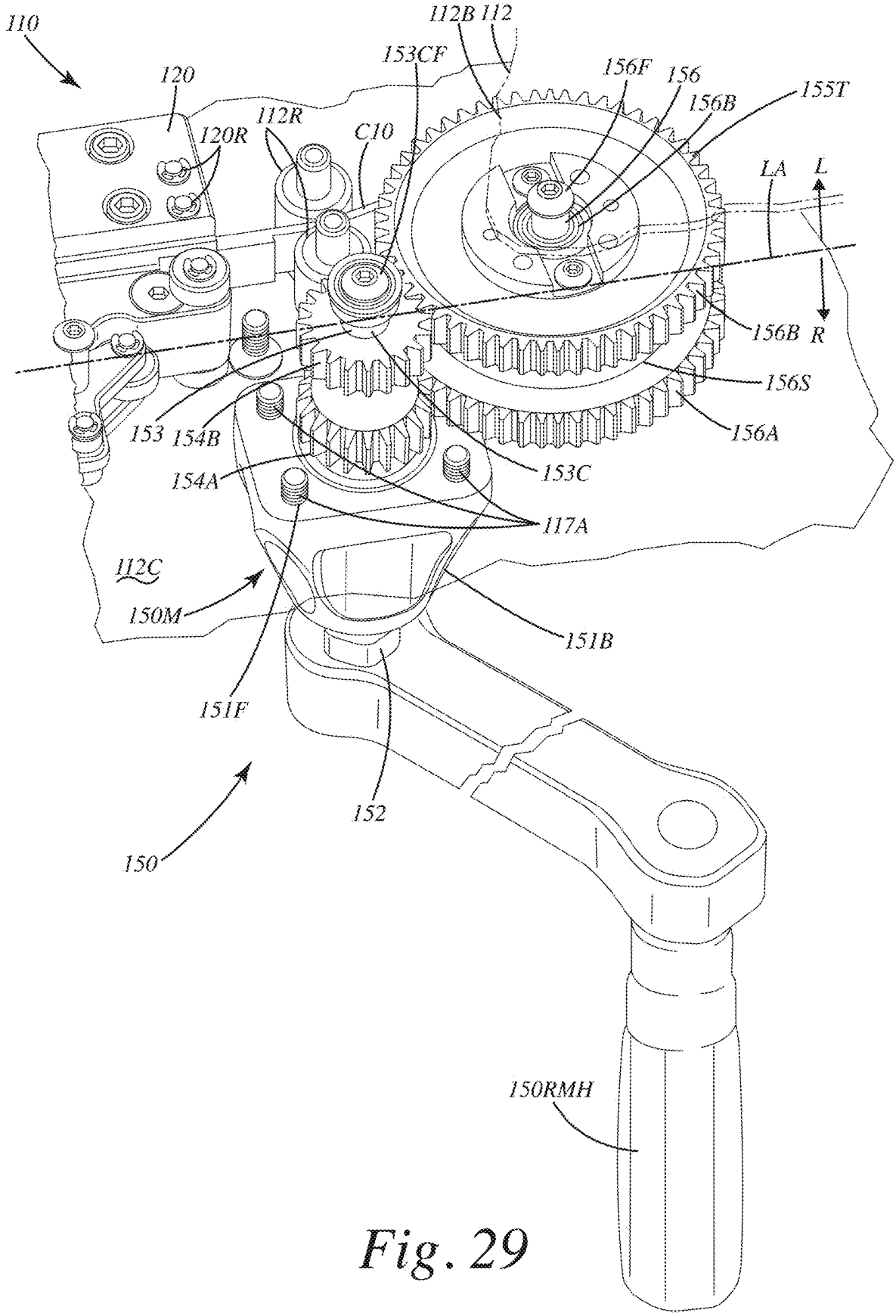
FIG. 29 is a view of the reversible modular crossbow crank engaging the spool and the web secured to the moveable receiver.

As shown in FIGS. 26 and 29, the spool 156S can be mounted to the secondary shaft 156 which can extend through a portion of a second surface 112B of the crossbow frame 112. The second surface 112A can be opposite a first surface 112A of the crossbow frame 112 and separated therefrom by the compartment 112C in the crossbow frame 112. The secondary shaft 156 can be fastened with one or more fasteners 156F to the second surface 112B. On an opposite side of the secondary shaft 156 another fastener similar to fastener 156F can secure the secondary shaft to the first surface 112A of the crossbow frame. Optionally, the first surface 112A can be on the right side R of the crossbow frame 112 when the crossbow is held by a user, and the second side surface 112B can be disposed on the left side L of the crossbow frame 112. Put another way, the first surface 112A can be on the right side R of the longitudinal axis LA of the crossbow frame and the second surface 112B can be on the left side L of the longitudinal axis LA. Also disposed on the secondary shaft 156 can be a first secondary gear 156A and a second secondary gear 156B. These first and second secondary gears can be disposed on opposite sides of the spool 156S and the cord C10 when wound on the spool 156S. The gears can be identically sized and can have the same number of teeth 155T. The first secondary gear 154A and second secondary gear 154B can be completely installed and disposed inside the internal compartment 112C of the crossbow frame 112, versus outside the frame or stock, like the embodiment above. The gears can be rotatably mounted on the secondary shaft 156 and can rotate in the same location about that shaft, without ever being removed from the crossbow frame and the compartment 112C.

The gears can be disposed on the respective right and left sides of the longitudinal axis LA. For example, the first secondary gear 154A can be on the right side R and the second secondary gear 154B can be disposed on the left side L of the longitudinal axis LA and/or of the crossbow frame. The spool 156S and the cord C10 can be split amongst the left side and the right side, generally parallel to the longitudinal axis LA. The first secondary gear and second secondary gear can be rotatable but fixed and stationary within the compartment 112C and the crossbow frame 112, rotating about or with the shaft 156 optionally in a single fixed location. One or more bearings 156B can be disposed between the gears and the shaft 156 promote rotation. Further optionally, the spool 156S and/or secondary shaft 156 can be associated with a biasing element 155B in the form of a spring similar or identical to the biasing element 55B described in the embodiment above and shown in FIG. 19.

The respective first secondary gear 156A and second secondary gear 156B respectively can mesh with and rotationally engage the first drive gear 154A and the second drive gear 154B disposed on the first drive shaft 153, when the crank module 150M is mounted in the configuration shown in FIG. 29, which is set up for a right side mounting relative to the crossbow frame 112. As described below, when the crank module 150M is removed from the crossbow frame as shown in FIG. 26 in direction RC, the first drive gear 154A and its teeth and the second drive gear 154B and its teeth are respectively removed or disengaged from the first secondary gear 156A and its teeth, and the second secondary gear 156B and its teeth.

Optionally, when the module 150M is swapped from the right side R to the left side L of the longitudinal axis and/or the crossbow frame as shown in FIG. 27, for example, in direction RR1 and reinstalled relative to the crossbow frame 112 on the opposite side, the interaction between the drive gears and the secondary gears changes. As a further example, upon reinstallation of the module 150M relative to the crossbow frame 112 as shown in FIG. 31, where the crank module 150M is mounted so that the crank arm 150RM can be engaged on the left side L of the longitudinal axis LA and the left side 112A of the crossbow frame 112, the first drive gear 154A can mesh with and engage the second secondary gear 156B, and the second drive gear 154B can mesh with and engage the first secondary gear 156A. Optionally, upon swapping of the drive module from a right handed to a left handed configuration or vice versa can result in the changing of engagement of the first and second drive gears relative to the first and second secondary gears. Regardless of this change from the left side to the right side, however, the crank module 150M and its respective drive gears 154A and 154B can engage the secondary gears 156A and 156B and thereby rotate the spool 156S and move the cord C10 in a manner similar to or identical to that of the crank 50 engaging the respective secondary gears 56 as described in the embodiment of the crossbow 10 above. For this reason, the engagement action will not be repeated here.

Figure 23:
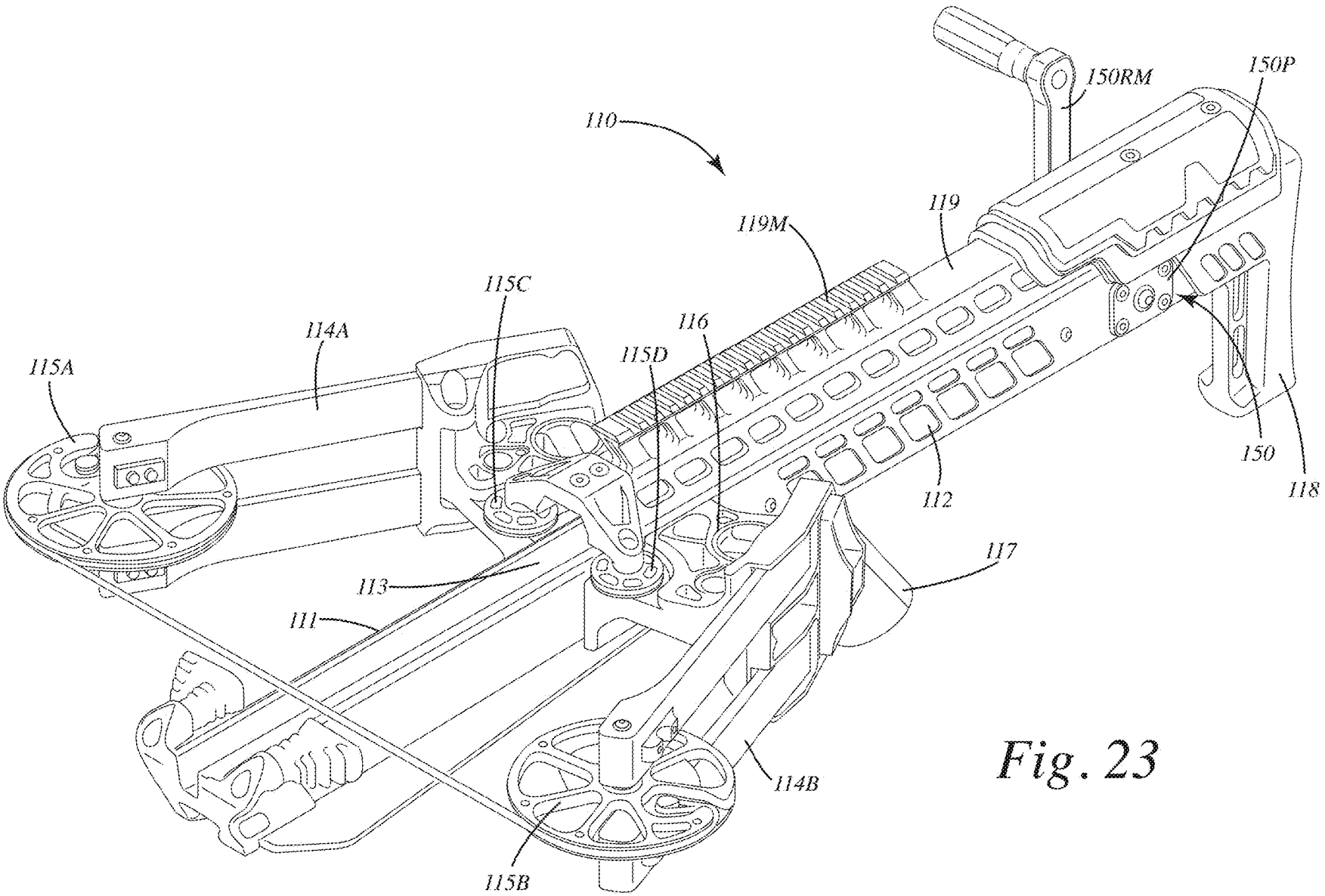
FIG. 23 is a first perspective view of a first alternative embodiment of the crossbow including a moving receiver and an internally mounted and reversible modular crossbow crank having a one way bearing.
Figure 24:
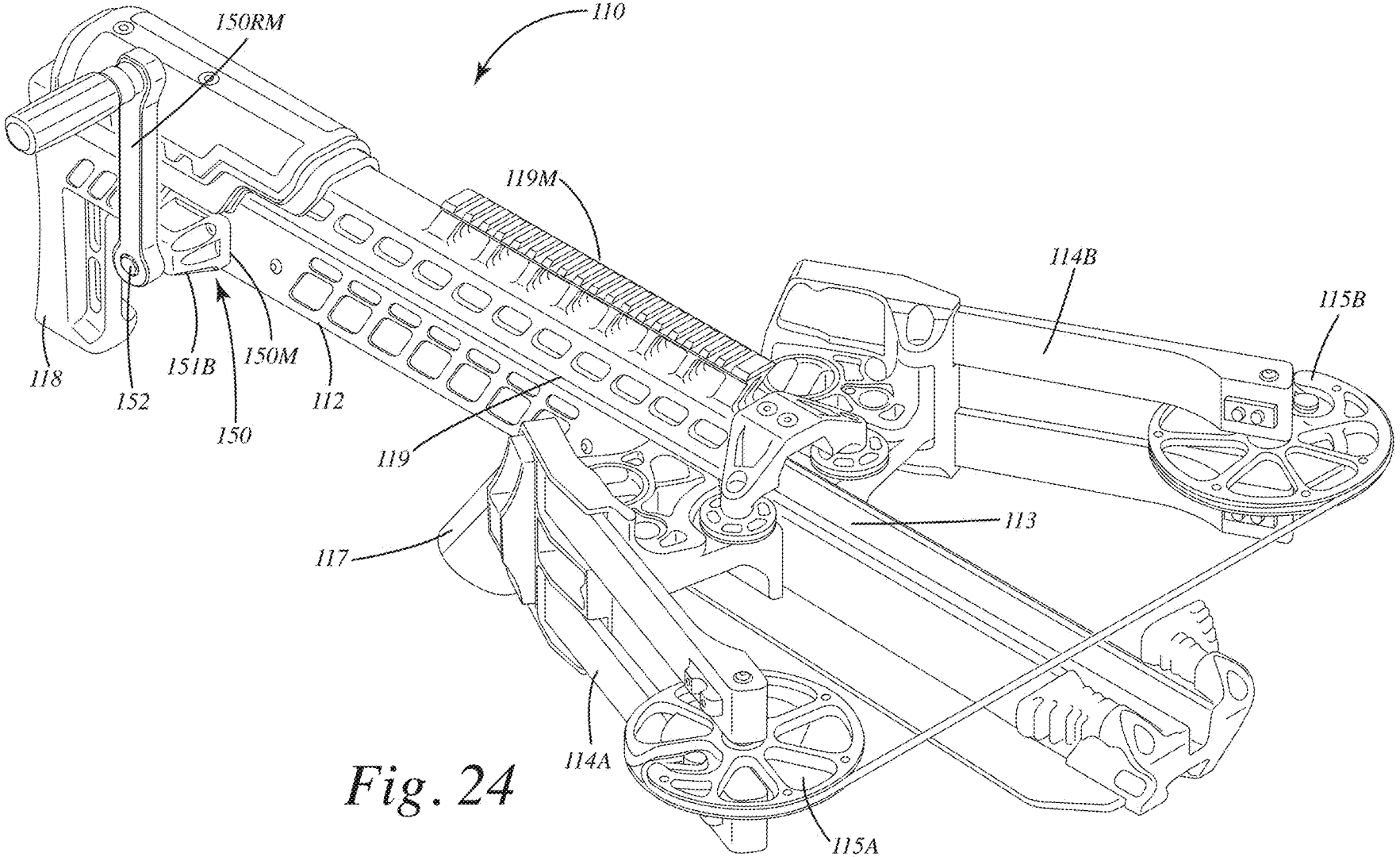
FIG. 24 is a second perspective view of the crossbow thereof including the reversible modular crossbow crank projecting from a first or right side of the crossbow.

Optionally, the crossbow 110 can include a crank arm 150RM. As shown in FIGS. 23, 26 and 28, the crank arm 150RM can include a handle 150RMH that is rotatably mounted to the arm portion 150O. The portion 150O can include an opening 150PO that receives a mount portion 150RMM that is fastened into the crossbow frame 112. As shown in FIG. 28, the mount portion can be in the form of a nut or spindle shaped similar to the drive nut 152 of the crank module 150M as described below. The crank arm 150RM can be stowed such that the elongated arm portion 150O is parallel to the crossbow frame in a stored position, while the handle 150RMH extends at a right angle or perpendicular to the portion 150O. Optionally, the arm 150RM can include a spring-loaded detent, set screw or other element that can temporarily hold and secure the portion 150O to the mount portion 150RMM.

As mentioned above, the receiver 120 can be a moving receiver and can include various components that allow the receiver to retain, hold and release the boring 111. These components all could be tied to a trigger assembly 122 that is similar to the trigger assembly as noted in the above and in U.S. application Ser. No. 18/756,477, entitled, Crossbow Bolt Retention Plunger, filed Jun. 27, 2024. Suffice it to say that the trigger assembly can operate in a manner similar to the trigger assembly described in the embodiment above so it will not be described again here.

Figure 25:
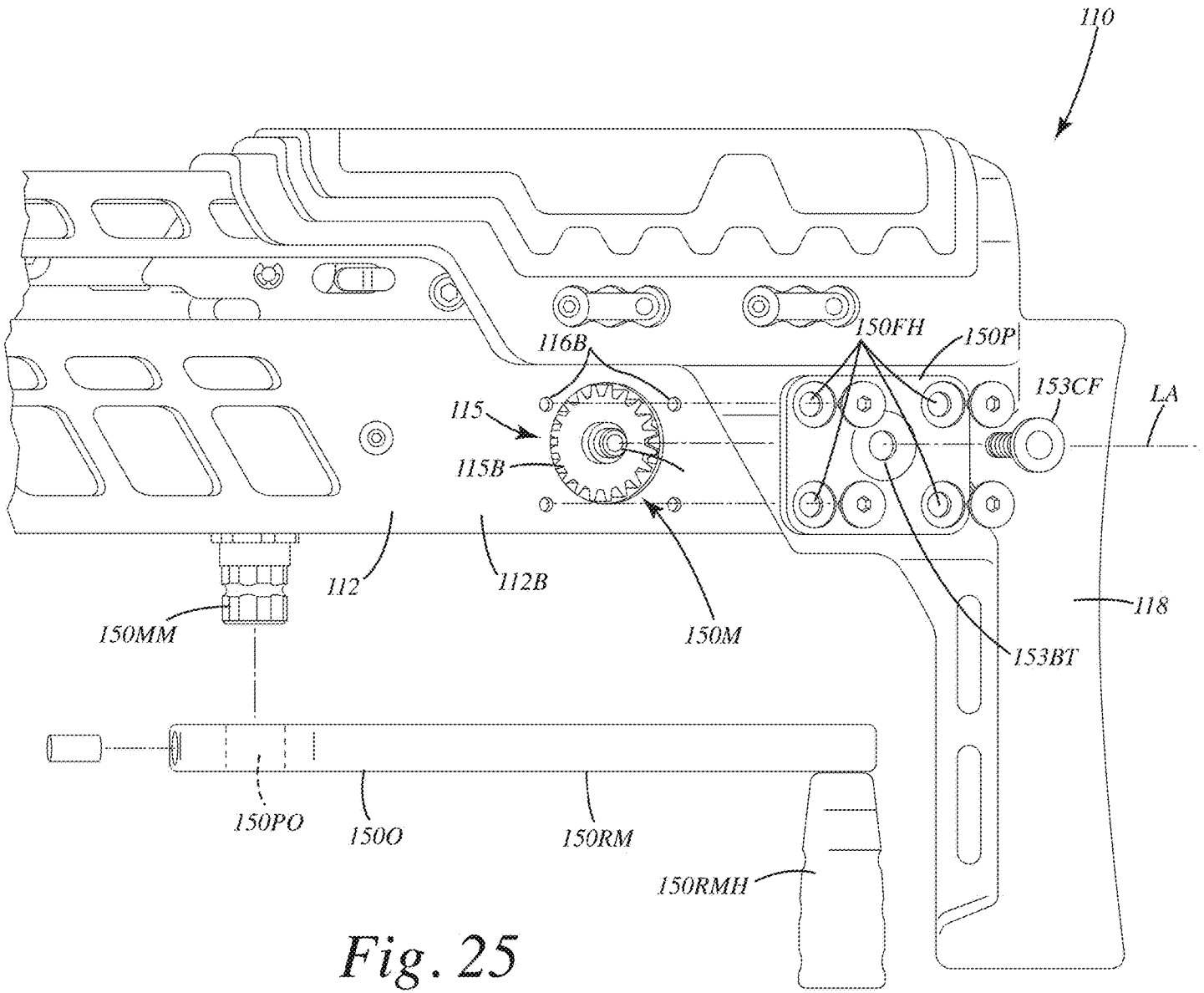
FIG. 25 is a partially exploded view of a crank plate removed from a stock of the crossbow to swap the reversible modular crossbow crank from the right side to the left side for different handed cranking.

Turning now to FIGS. 25-30, the crank module 150M and crank 150 of the embodiment of the crossbow 110 will now be described in further detail. The crank module 150M can be mountable relative to a transverse crank mounting hole 115 defined through the crossbow frame 112. This hole 115 can comprise a first aperture 115A disposed in the first side or first side surface 112A of the crossbow frame 112 as shown in FIG. 26. The hole 115 can comprise a second hole or aperture 115B on the second side or second surface 112B of the crossbow frame 112 as shown in FIG. 25. These apertures 115A and 115B optionally can be aligned with one another and centered on a driveshaft longitudinal axis DLA, which can correspond to the driveshaft axis of the driveshaft 153 of the crank 150. This hole 115 can be transverse to the longitudinal axis LA of the crossbow frame. The axis DLA can be perpendicular to the longitudinal axis LA of the frame 112.

As shown in FIGS. 25 and 26, the transverse hole 115 can be sized such that the first drive gear 154A and second drive 154B can pass through the respective openings 115A and 115B, into the internal compartment 112C. The diameter or dimension of the transverse hole 115 can be larger than the outermost diameter of the drive gears. This is so that the drive gears can clear the openings in the surfaces when the crank module 150M is installed relative to the crossbow frame. The crossbow frame 112 also can define one or more first fastener holes 116H adjacent the transverse mounting hole 115 on the first surface 112A. One or more additional fastener holes 116B can be disposed around the second opening 115B of the transverse mounting hole 115 on the second surface 112B of the crossbow frame 112. These first and second sets of holes can be aligned with one another and can be threaded to receive respective fasteners 117A that are associated with a module housing 151B.

The module housing 151B likewise can be outfitted to include respective holes 151F that can receive the respective fasteners 117A and can facilitate attachment of the module housing 151B to a respective first or second surface of the crossbow frame. Optionally, although shown as being side surfaces of the crossbow frame, the respective first and second surfaces herein can be upper and lower surfaces, front and rear surfaces, or other surfaces. Moreover, the transverse mounting hole need not be transverse to the side surfaces as shown. Instead, the mounting hole might extend from an upper surface to a lower surface of the crossbow frame or some other component. Moreover, the transverse mounting hole might be defined in a different component altogether than the crossbow frame.

Figure 30:
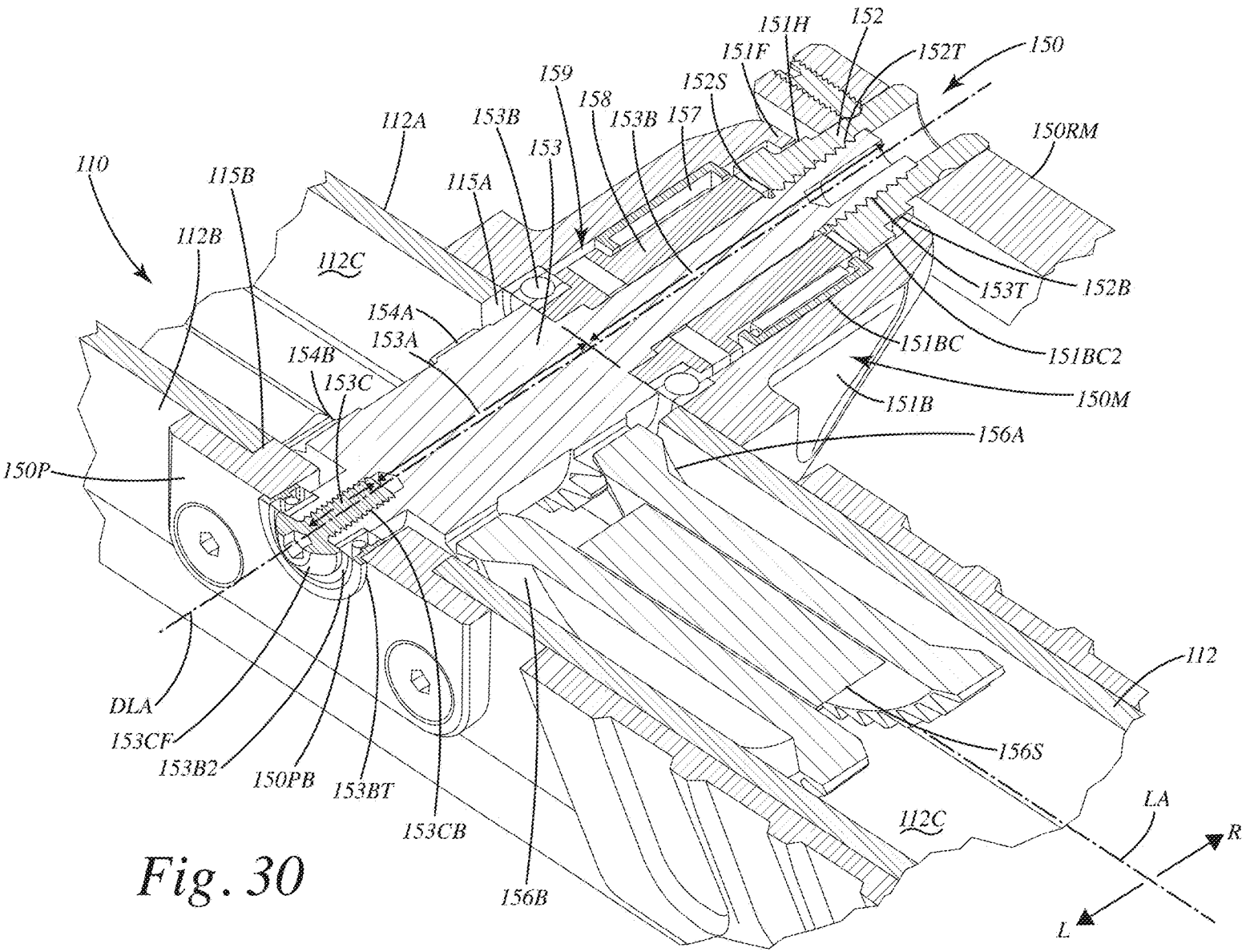
FIG. 30 is a partial section view of the reversible modular crossbow crank on a right side of the stock of the crossbow.

The crank module 150M as shown in FIGS. 25-26 and FIG. 30 can include one or more of a one-way bearing 157, a sleeve 158, and a brake 159 all of which can be mounted to or adjacent or along a driveshaft 153. These components, that is, the one-way bearing 157, the sleeve 158, the brake 159 and the driveshaft 153 can be similar or identical to the same components the embodiment of the crossbow 10 above in structure, function in operation, and therefore will not be described again in detail here. Suffice it to say that the sleeve is disposed in the one-way bearing, the driveshaft extends through the sleeve and is configured to extend within the transverse crank mounting hole 115. A crank arm can be joined with the driveshaft similar or identical to the embodiment above. Similar to the embodiment above, the brake 159 can include one or more discs and flanges. The brake 159 can be generally mounted along the driveshaft 153 and axially compressible along the driveshaft to automatically lock the driveshaft in the sleeve 158 with one another when the driveshaft 153 is rotated in a first direction, which again is mentioned and fully described in the embodiment above, and therefore will not be described again here.

The construction of the crank 150 and the module 150M can differ from that of the crank 50 described above in several ways. For example, the housing 151B can be selectively securable and removably mountable to either side or surface of the crossbow frame 112, with various components of the module projecting into and/or housed within the crossbow frame 112. As shown in FIG. 30, the module housing 151B can include an internal bore 151BC. This internal bore can be sized to receive the one-way bearing 157, the sleeve 158 and the brake 159. Of course, in other constructions, the housing module housing 151B may only house one or two of these components, for example, the one-way bearing 157, sleeve 158 and drive nut 152, while the brake drive gears and the remainder of the driveshaft project into the internal compartment 112C of the crossbow frame, optionally in the transverse mounting hole 115.

As shown, the bore 151BC can include a step 151S such that the diameter of the bore 151BC decreases at the step 151S. The one-way bearing 157, which can be any of the devices described in the embodiment above and referred to as a one-way bearing, can be placed adjacent the step 151S. The bore 151BC can include another segment 151BC2 that extends away from the step 151S, having a smaller diameter. This segment can extend to a flange 151F that forms an opening 151H through which portion of the drive nut 152 extends. The drive nut 152 optionally can include a base 152B that is slightly larger in diameter or dimension than the hole 151H such that the nut is trapped relative to the module housing 151B by virtue of the base 152B interfering with the flange 151F. Similar to the drive nut mentioned in the above embodiment, the drive nut 152 may include spines or flanges on an exterior surface to engage the manual crank arm 150RM. The drive nut 152 also can include internal threads 152T. Those threads can engage the threads 153T of the driveshaft 153 to operate and function in a manner similar to that of the embodiment of the crossbow 10 described above.

The crank 150 and crank module 150M can include a spacer 152S disposed between the drive nut 152 and the sleeve 158. Again, this spacer 152S can be similar in structure, function, and operation to that of the spacer 52S described above when the drive nut 152 is threaded onto and off the threads 153T of the driveshaft 153. The crank module 150M optionally can include a bearing 153B which can be fixedly and non-rotatably attached to the module housing 151B. In particular, the bearing outer raceway can be fixed and stationary relative to the module housing 151B. The inner raceway, however, can be rotatable relative to the outer raceway via the bearings disposed therebetween. This bearing set up can be similar in structure, function, and operation to the bearing 53B as described in the embodiment above, and therefore will not be described again here.

As shown in FIG. 30, the driveshaft 153 can extend through the sleeve 158, the brake 159 and within the opening of the one-way bearing 157, similar to the driveshaft 53 of the embodiment of the crank 50 described in the embodiment above. In particular, the crank portion 153B can extend through the module housing 151B and within the bore 151BC of that housing. In this instance, the portion of the driveshaft 153B can extend beyond the first surface 112A of the crossbow frame. The driveshaft 153 also can extend within the internal compartment 112C of the crossbow frame 112. In particular, the portion 153A can extend within the internal compartment 112C, generally between the first surface 112 A and the second surface 112 B, within the transverse mounting hole 115. The portion 153A of the driveshaft can transition to yet another portion, 153C that can be of a reduced diameter or dimension. This portion 153C of the driveshaft can extend beyond the surface 112B of the crossbow frame 112.

As will be appreciated, the portion 153B of the driveshaft 153 also can extend beyond the first surface 112A of the crossbow frame. The portion 153C can define threaded bore 153CB and they can receive a fastener 153CF. The fastener 153CF can engage an inner raceway of another bearing 153BT that is disposed in or joined a mounting plate 150P that is disposed opposite the module housing 151B. The fastener 153CF can engage an inner raceway of the bearing 153BT and allow the driveshaft 153 to rotate relative to the outer raceway of that same bearing 153BT. Of course, the bearing can be deleted, or replaced with bushings or other elements that allow the driveshaft and other components to rotate as described in connection with the embodiment above.

As described above, the driveshaft 153 can include, can be integral with and/or can be joined with one or more drive gears. A first drive gear 154A and a second drive gear 154B can be joined with a drive shaft. In particular, those drive gears can be formed or joined with the portion 153A of the driveshaft 153 that is disposed in the internal compartment 112C, generally between the first surface 112A and the second surface 112B. The crank module 150M can be installed relative to the crossbow frame 112. Although shown as a pair of driveshaft drive gears 154A and 154B, one of the pair might be eliminated, or one or more additional drive gears can be added, depending on the application and the dimensions of the internal compartment 112C. In other applications where one or more of the first secondary gear 156A and second secondary gear 156B are disposed outside the crossbow frame, one or more of the drive gears 154A, 154B likewise can be disposed outside the frame to engage those secondary gears. Moreover, in some applications, the first drive gear 154A and the second drive gear 154B might be combined as a single wide, unitary gear that spans and can engage the first secondary gear and the second secondary gear simultaneously.

The crank module 150 M can be joined and temporarily secured to the crossbow frame 112 by way of the module housing 151B being fastened to the crossbow frame. For example, as shown in FIGS. 26, 29 and 30, fasteners 117A can be disposed through respective holes 151F and threaded to secure the housing 151B to the surface 112A of the crossbow frame 112. Of course, in other applications, the housing 151B can be secured to the crossbow frame with a clamp, a cam, a fitting, or other temporary securement structure. The structures, however, can enable the housing and the crank module 150M and its components to be removed from the crossbow frame, reinstalled and swapped from one side of the frame to an opposing side of the frame or surface of the frame to provide right or left-handed cranking operation of the crank 150 during any draw or letdown operations.

The crank module can be further stabilized relative to the crossbow frame, such that the drive gears adequately and consistently mesh with the secondary gears via a mounting plate 150P as mentioned above. The mounting plate 150P can include a generally plate like portion and can be configured to be removed from and secured to the first surface 112A or the second surface 112B of the crossbow frame, generally opposite the module housing 151B. The mounting plate thus can be mounted to a left side or a right side of the crossbow frame. When so mounted, it can be opposite the module housing, across the internal compartment within which the other components such as part of the trigger assembly are mounted.

Optionally, the mounting plate 150P can define one or more mounting plate holes 150FH, sometimes referred to as second fastener holes herein. These second fastener holes 150FH, as shown in FIG. 25, can be configured to receive multiple second fasteners 150F which can align with and be threaded into respective holes 116B defined by the crossbow frame 112. This securement can fix the mounting plate to the crossbow frame along the first surface 112A or the second surface 112B depending on the orientation of the crank module 150M. When included, the mounting plate can be disposed on an opposite side of the crossbow frame from the module housing 151B.

As mentioned above, the mounting plate 150P can include a bearing 153BT. The bearing 153BT can be mounted or joined with the mounting plate 150P. In some cases, the bearing can be press fit in a bearing or central hole 150PB of the plate. In alternative constructions, the bearing can be absent, and a low friction material or bushing can be placed within the plate hole 150PB. As mentioned above, the drive shaft 153 can include a portion 153C, which can be in the form of a distal end. That distal end can be registered with the mounting plate bearing 153BT that is disposed within the hole 150PB. The driveshaft 153 can rotate within a portion of the mounting plate bearing, for example, the inner raceway of that bearing. A fastener 153CF can secure and register the distal end of the driveshaft 153 with the bearing 153BT to promote consistent and even rotation of the driveshaft relative to the mounting plate.

Optionally, the bearing fastener 153CF can engage a portion of the mounting plate bearing 153BT such that the mounting plate bearing is compressed between the fastener and the driveshaft 153. As an example, the head of the fastener 153CF can engage the inner raceway of the bearing only, such that the inner raceway can continue to rotate relative to the outer raceway of the bearing 153BT and thereby allow the driveshaft to spin inside and relative to the mounting plate bearing.

As shown in FIG. 26, the mounting plate 150P can include a centering ring 150PR. The centering ring 150PR can be sized slightly smaller than either of the openings 115A or 115B of the transverse mounting hole 115 defined by the crossbow frame 112. This centering ring 150PR can ensure that the mounting plate 150P is registered and aligned with the driveshaft 153 and the module housing 151B on the opposite side of the crossbow frame. This can further facilitate alignment of the drive gears with the secondary gears associated with the spool that winds the cord C10 thereon and off depending on the operation of the crank 150.

The crank module 150M optionally can include a first drive gear 154A and a second drive gear 154B that engage and selectively rotate the first secondary gear 156A and second secondary gear 156B as described above. The crank module 150M again can be configured to be reversed and reinstalled in the transverse crank mounting hole 115 in a first direction extending from the first surface 112A, or a second direction extending from the second surface 112 B of the crossbow frame 112. Generally, the crank module 150M is selectively mountable relative to the crossbow frame on either the right side R or the left side L of the crossbow frame 112 to provide a user with the ability to operate the crossbow crank with a crank arm 150RM in a draw mode or let down mode to the undrawn mode as explained in the embodiment above from the right side or the left side of the crossbow frame 112.

A method of using the crossbow crank 150 and the crossbow 110 in general will now be described in further detail. It is to be noted however, that the actual operation of the driveshaft 153 in connection with the one-way bearing 157, sleeve 158, brake 159, spacer 152S and drive nut 152 will not be described in significant detail here because those components and elements all operate and function identically to the same or like components described in the embodiment of the crossbow and crank above. What will be described is the use of the crossbow crank 150 when accommodating right-hand or left-hand use of the crank 150 to draw, hold and/or let down a bowstring 111 of the crossbow 110. Generally, that method of using the crossbow and/or a crossbow crank can include removing a crank module 150M from a first surface 112A of a crossbow frame 112 defining a crank mounting hole 115, the crank module comprising a sleeve 158 disposed in a one-way bearing 157, a driveshaft 153 extending through the sleeve 158 and a drive gear 154A, 154B to rotatably couple with a spool 156S rotatably mounted inside the crossbow frame 112 and installing the crank module 150M through a second surface 112B of the crossbow frame 112 opposite the first surface 112A so the crank module 150M extends through the crank mounting hole 115.

After the crank module is adequately installed relative to the crossbow frame 112, the crossbow crank can be operated in a manner similar to the embodiment of the crossbow crank 50 described above. Generally, the driveshaft 153 can be rotated in a first direction, the break 159 can be axially compressed along the driveshaft to fix the driveshaft 153 with the sleeve 158 disposed around the driveshaft. The driveshaft 153, gear 154A, 154B and sleeve 158 rotate in unison in the first direction. The sleeve 158 can be disposed in the one-way bearing 157 so that when said rotating in the first direction ceases, the driveshaft 153 and drive gear 154A, 154B are impaired from rotating in a second direction opposite the first direction via the one-way bearing 157 interacting with sleeve 158 which again is held in place and stationary relative to the module housing 151B. The method can further include winding the cord C1 on the spool 156S inside the internal compartment 112C of the crossbow frame 112. As the cord is wound on the spool, the moving receiver 120 including a trigger latch 122 can be pulled along the crossbow frame 112 toward the spool 156S as the cord C10 winds on the spool. Various other operations similar to those in the methods described in the current embodiment of the crossbow 10 and crank 50 above can be performed and will not be repeated here.

With reference to FIGS. 26 and 27, a method of swapping the crossbow module 150M from one side to another of the crossbow 110 will be further described. This activity can be performed when the crossbow 110 is in an undrawn state, and the receiver 120 is not joined with the bowstring under tension. A user can remove the first fasteners 117A from the module housing 151B and from the crossbow frame first surface 112A. The fasteners can thread out of the holes 116A in that side 112A. The module 150M can be withdrawn from the transverse mounting hole 115 in direction RC. As this occurs, the first drive gear 154A disengages the first secondary gear 156A and likewise the second drive gear 154B disengages the second secondary gear 156B.

Where a mounting plate 150P is included in the crank 150, the mounting plate fastener 153CF can be removed from the distal end 153C of the driveshaft 153. The distal end of the driveshaft 153C can be further removed and pulled out from engagement with the mounting plate bearing 153BT as the module 150M is removed from the transverse mounting hole. During the removal, the drive gears 154A and 154B, as well as the distal end 153C can pass out of the internal compartment 112C of the crossbow frame 112, and further out of the opening 115A past the first side surface 112A of the crossbow frame 112.

Further, where a mounting plate 150P is included in the crank 150, the mounting plate 150P also can be removed from the second side surface 112B. To do so, the mounting plate fasteners 150F can be removed from the plate and from the second side surface 112B of the crossbow frame. This enables the mounting plate to be removed in direction PC away from the second surface 112B of the crossbow frame.

With the crank module 150M removed from the crossbow frame, and the optional mounting plate 150P also removed from the crossbow frame, these components can be swapped from one side to the other. As shown in FIG. 27, the crossbow module 150M can be rearranged and moved from the right side R to the left side L of the longitudinal axis LA in direction RR1. The mounting plate 150P can be moved in direction RR2, generally from the left side of longitudinal axis LA to the right side R. The respective crossbow module and mounting plate can be realigned and oppose one another through the transverse mounting hole 115. The module housing 151B can be moved toward the second surface 112B of the crossbow frame 112. The mounting plate 150P likewise can be moved toward and engage the first surface 112A of the crossbow frame 112.

With reference to FIG. 31, the driveshaft 153 and the respective gears 154A and 154B can be inserted and installed into and through at least a portion of the transverse mounting hole 115. In particular, the driveshaft and drive gears can be inserted through the second opening 115B in the second surface 112B. Due to the reversal of the drive gears 154A and 154B within the internal compartment 112C, the second drive gear 154B will pass beyond the second secondary gear 156B and will engage the first secondary gear 156A upon installation of the crank module on the second side 112B. The first gear 154A will engage the second secondary gear 156B.

As also shown in FIG. 31, the distal end 153C of the drive shaft 153 will pass into the mounting plate hole 150PB and enter into the inner raceway of the bearing 153BT. The respective mounting plate and housing 151B can be secured to the crossbow frame with the respective fasteners as described above. In addition, the plate bearing fastener 153F can be threaded and installed relative to the driveshaft 153 to secure the distal end 153C within the bearing 150BT.

With all the fasteners, the mounting plate and module housing securely fastened, and those components secured to the crossbow frame, a user can install the crank arm 150RM relative to the drive nut 152 to operate the crank module 150M. With the reversal of the crank, module 150M, however, the user can operate the crank 150 from the opposite side of the crossbow frame than the side from which the crank module was initially removed.

When the crank module 150M is fully installed and operated, the respective components, that is, the drive nut 152, spacer 151S, one-way bearing 157, sleeve 158, brake 159, driveshaft 153 and respective drive gears and secondary gears can operate identical to the same components described in connection with the embodiment of the crossbow 10 and crank 50 above. Accordingly, the operation, function and interaction of those components will not be described again here.

The following additional statements are provided, the numbering of which is not to be construed as designating levels of importance.

Statement A. A crossbow comprising: at least one limb joined with a frame; a bowstring joined with the limb and transverse to the frame, the bowstring moveable between a drawn mode and an undrawn mode; a trigger assembly joined with the frame and including a catch that is operable in a holding mode in which the catch retains the bowstring in the drawn mode and a drop mode that releases the bowstring so the bowstring can transition to the undrawn mode; a safety including a forward end facing toward the catch, the safety operable in a safety on mode and a safety off mode; a sled comprising: a guide that moves along the frame when the sled engages the bowstring; a bowstring engager configured to receive the bowstring during movement of the bowstring to the drawn mode with the sled; and a first stop that is selectively operable in a neutral mode in which the first stop does not interfere with rearward movement of the sled along the frame so that the bowstring can move to the drawn mode, and in a de-cocking mode in which the first stop interferes with movement of the sled along the frame so that the sled is prevented from engaging the bowstring against the forward end of the safety facing the catch, while the safety remains in the safety on mode.

Statement B. The crossbow of Statement A, comprising: a crossbow crank mounted to the crossbow; the crossbow crank including a sleeve disposed in a one-way bearing; a drive shaft extending through the sleeve; a drive gear joined with the drive shaft so the drive gear and drive shaft rotate in unison; a spool coupled to the drive gear, the spool configured to engage a cord; and a crank joined with the drive shaft, wherein the sled is joined with the crossbow crank via a cord wrapped on the spool.

Statement C. The crossbow of any preceding Statement, wherein the crossbow crank provides tension in the cord to pull the sled so that the stop engages another part of the crossbow, with the sled's movement toward the crank being arrested by such engagement of the stop.

Statement D. The crossbow of any preceding Statement, wherein the drive shaft and drive gear rotate in a first direction about a first axis, wherein the one-way bearing permits such rotation so that the spool rotates in a second direction opposite the first direction, wherein the cord wraps on the spool in the second direction.

Statement E. The crossbow of any preceding Statement, wherein a user rotates the drive shaft and drive gear in the first direction during the de-cocking mode until the stop engages the other part of the crossbow, and wherein upon cessation of the rotating in the first direction, the cord urges the drive shaft and drive gear to rotate in the second direction, however, the one-way bearing impairs such rotation in the second direction, optionally automatically by engaging the sleeve and preventing rotation in the second direction.

Statement F. The crossbow of any preceding Statement, wherein a drive nut threads onto the drive shaft to axially compress a brake along the drive shaft against the sleeve to lock the sleeve and drive shaft to one another, so the sleeve is engaged by the one-way bearing to impair the rotation in the second direction.

Statement G. The crossbow of any preceding Statement, wherein upon rotation of a crank arm that rotates the drive shaft and drive gear in the second direction, the brake automatically releases and is no longer axially compressed along the drive shaft so that the one-way bearing no longer impairs the rotation of the drive shaft and drive gear in the second direction, because the drive shaft is no longer rotationally joined with the sleeve engaged by the one-way bearing and can rotate freely relative to the one-way bearing.

Statement H. The crossbow of any preceding Statement, wherein as the crank arm, drive shaft and drive gear rotate in the second direction, the spool rotates in the first direction, opposite the second direction, to allow the cord to unwind from the spool in a controlled manner during the de-cocking of the crossbow, wherein the bowstring moves farther toward the released mode.

Statement I. The crossbow of any preceding Statement, wherein the stop disengages the portion of the crossbow, such as a limiter, optionally a mounting arm or the frame, as the crossbow is de-cocked.

Statement J. The crossbow of any preceding Statement, wherein the sleeve and drive shaft automatically lock to one another upon manual actuation of the crank to rotate the drive shaft in the first direction, so that the sleeve and drive shaft rotate in unison.

Statement K. The crossbow of any preceding Statement, wherein the sleeve and drive shaft automatically unlock from one another upon manual actuation of the crank to rotate the drive shaft in the second direction, so that the drive shaft rotates freely relative to the sleeve.

Statement L. The crossbow of any preceding Statement, wherein the rotation of the drive shaft in the second direction rotates a spool on a secondary axis in the first direction so that a cord unwinds from a spool on the secondary axis, wherein the cord is attached to the sled, wherein the bowstring is under tension to urge the sled forward, away from the crank, toward a released mode, wherein a brake impairs the drive shaft, drive gear and spool from spinning uncontrollably by automatically engaging with a sleeve disposed in a one-way bearing.

Statement M. The crossbow of any preceding Statement, wherein a crossbow crank automatically locks via a brake being axially compressed along the drive shaft to rotationally fix the drive shaft to a sleeve, with a one-way bearing preventing the sleeve and thus drive shaft from rotating in a second direction opposite the first, whereby a user can manually move the safety to the safety off mode while the first stop is in the de-cocking mode, and subsequently activate the trigger assembly so that the bowstring can be let down from the drawn mode to the undrawn mode with the sled engaging the bowstring as the letdown occurs.

Although the different elements and assemblies of the embodiments are described herein as having certain functional characteristics, each element and/or its relation to other elements can be depicted or oriented in a variety of different aesthetic configurations, which support the ornamental and aesthetic aspects of the same. Simply because an apparatus, element, or assembly of one or more of elements is described herein as having a function does not mean its orientation, layout or configuration is not purely aesthetic and/ornamental in nature.

Directional terms, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to any specific orientation (s).

In addition, when a component, part or layer is referred to as being "joined with," "on," "engaged with," "adhered to," "secured to," or "coupled to" another component, part or layer, it may be directly joined with, on, engaged with, adhered to, secured to, or coupled to the other component, part or layer, or any number of intervening components, parts or layers may be present. In contrast, when an element is referred to as being "directly joined with," "directly on," "directly engaged with," "directly adhered to," "directly secured to," or "directly coupled to" another element or layer, there may be no intervening elements or layers present. Other words used to describe the relationship between components, layers and parts should be interpreted in a like manner, such as "adjacent" versus "directly adjacent" and similar words. As used herein, the term "and/or" includes any and all combinations of one or more of the associated listed items.

The above description is that of current embodiments of the invention. Various alterations and changes can be made without departing from the broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular. Any reference to claim elements as "at least one of X, Y and Z" is meant to include any one of X, Y or Z individually, any combination of X, Y and Z, for example, X, Y, Z; X, Y; X, Z; Y, Z, and/or any other possible combination together or alone of those elements, noting that the same is open ended and can include other elements.

Reference throughout this specification to "a current embodiment" or "an embodiment" or "alternative embodiment" means that a particular feature, structure, or characteristic described in connection with the embodiment is included in at least one embodiment herein. Accordingly, the appearance of the phrases "in one embodiment" or "in an embodiment" or "in an alternative embodiment" in various places throughout this specification are not necessarily all referring to the same embodiment. Additionally, the particular features, structures, or characteristics of one embodiment are contemplated for proper and full combination in any suitable manner in one or more other embodiments, which is fully contemplated herein. Further, features, structures, or characteristics of one embodiment or multiple embodiments are readily and completely mixed and matched with any features, structures, or characteristics of any other embodiment or multiple embodiments in varying combinations and permutations.

What is claimed is:

1. A crossbow crank comprising:

a housing configured to removably secure to a right side or a left side of a crossbow frame;

a one-way bearing joined with the housing and defining an opening;

a sleeve disposed in the opening;

a drive shaft disposed in the opening with the sleeve disposed between the one-way bearing and the drive shaft;

a drive gear fixedly joined with the drive shaft, so the drive gear and drive shaft rotate in unison;

a spool coupled to the drive gear, the spool configured to engage a cord;

a mounting plate configured to removably secure to the left side or the right side of a crossbow frame, opposite the housing, the mounting plate adjacent a bearing on the drive shaft opposite the housing and one-way bearing, the bearing configured to engage the drive shaft on the left side or the right side of the crossbow frame opposite the housing and one-way bearing; and a brake mounted along the drive shaft distal from the one-way bearing, the brake being axially compressible along the drive shaft to fixedly join the drive shaft with the sleeve when the drive shaft is rotated in a first direction, so that the drive shaft, sleeve, and drive gear rotate in unison in the first direction, wherein the one-way bearing engages the sleeve to impair the drive shaft, sleeve, and drive gear from rotating in a second direction opposite the first direction, wherein the housing, one way bearing, sleeve, drive shaft, drive gear and brake are joined with one another and removeable from the crossbow frame together simultaneously as a crank module, wherein the crank module is selectively mountable relative to the crossbow frame on the right side of the crossbow frame while the mounting plate is selectively mounted to the left side of the crossbow frame, wherein the crank module is removable from the right side of the crossbow frame, and configured to subsequently be reoriented and reinstalled relative to the crossbow frame on an opposing left side of the crossbow frame, wherein the mounting plate is removable from the left side of the crossbow frame, and configured to subsequently be reoriented and reinstalled relative to the crossbow frame on the right side of the crossbow frame with the bearing adjacent the mounting plate on the right side configured to engage the drive shaft on the right side when the crank module is reinstalled on the left side of the crossbow frame, whereby a user is provided the ability to selectively operate the crossbow crank with a crank arm in a draw mode from the right side or the left side of the crossbow frame.

2. The crossbow crank of claim 1, wherein the cord is wound on the spool, wherein the spool is joined with a secondary gear, wherein the drive gear is removeable from the secondary gear by removing the drive shaft from the crossbow frame with the housing.

3. The crossbow crank of claim 1, comprising:

a drive nut threaded to the drive shaft and joined with the crank arm;

wherein a tension in the cord automatically urges the drive shaft to rotate in the second direction to tighten the drive nut relative to the drive shaft, thereby frictionally engaging the sleeve and the brake with one another, but the drive shaft and the drive gear being impaired from rotating in the second direction opposite the first direction via the one-way bearing interacting with the sleeve.

4. The crossbow crank of claim 1, comprising:

a plurality of first fastener holes defined by the housing, configured to receive a plurality of first fasteners to secure the housing adjacent a first surface of the crossbow frame; and a plurality of second fastener holes defined by the mounting plate, configured to receive a plurality of second fasteners to secure the mounting plate adjacent a second surface of the crossbow frame opposite the first surface.

5. A crossbow crank comprising:

a housing configured to removably secure to a right side or a left side of a crossbow frame;

a mounting plate configured to removably secure to the left side or the right side of the crossbow frame, opposite the housing;

a bearing joined with the mounting plate;

a one-way bearing joined with the housing and defining an opening;

a sleeve disposed in the opening;

a drive shaft disposed in the opening with the sleeve disposed between the one-way bearing and the drive shaft;

a bearing fastener engaging the portion of the bearing joined with the mounting plate and a distal end of the drive shaft;

a drive gear fixedly joined with the drive shaft, so the drive gear and drive shaft rotate in unison;

a spool coupled to the drive gear, the spool configured to engage a cord; and a brake mounted along the drive shaft distal from the one-way bearing, the brake being axially compressible along the drive shaft to fixedly join the drive shaft with the sleeve when the drive shaft is rotated in a first direction, so that the drive shaft, sleeve, and drive gear rotate in unison in the first direction, wherein the one-way bearing engages the sleeve to impair the drive shaft, sleeve, and drive gear from rotating in a second direction opposite the first direction, wherein the housing, one way bearing, sleeve, drive shaft, drive gear and brake are joined with one another and removeable from the crossbow frame together simultaneously as a crank module, wherein the distal end of the drive shaft is registered with the bearing joined with the mounting plate so that the drive shaft rotates with a portion of the bearing joined with the mounting plate, whereby the crank module is selectively mountable relative to the crossbow frame on either the right side or the left side of the crossbow frame to provide a user with the ability to operate the crossbow crank with a crank arm in a draw mode from the right side or the left side of the crossbow frame, wherein the bearing joined with the mounting plate is compressed between the bearing fastener and the drive shaft.

6. A crossbow crank for a crossbow including a crossbow frame defining a transverse crank mounting hole, with a spool and first secondary gear mounted in the crossbow frame, the crossbow crank comprising:

a sleeve disposed in a one-way bearing;

a drive shaft extending through the sleeve and configured to extend within the transverse crank mounting hole;

a first drive gear joined with the drive shaft so the first drive gear and drive shaft rotate in unison, the first drive gear configured to engage a first secondary gear joined with a spool in the crossbow frame; and a crank joined with the drive shaft;

a housing configured to be removably joined with a first surface of the crossbow frame; and a mounting plate defining a plate aperture, the mounting plate configured to be removably joined with a second surface of the crossbow frame, the second surface opposite the first surface, the plate aperture configured to rotatably receive a portion of the drive shaft, wherein the sleeve, one way bearing, and drive shaft are removable from the transverse crank mounting hole together in unison in the form of a crank module, wherein the crank module is configured to be reversed and reinstalled in the transverse crank mounting hole in an opposite direction, whereby the crank module is selectively mountable relative to the crossbow frame on either a right side or a left side of the crossbow frame to provide a user with the ability to operate the crossbow crank with a crank arm in a draw mode from the right side or the left side of the crossbow frame, wherein the housing and mounting plate are configured to be reversed so that the housing is removably joined with the second surface and the mounting plate is removably joined with the first surface.

7. The crossbow crank of claim 6, comprising:

a brake mounted along the drive shaft, the brake being axially compressible along the drive shaft to automatically lock the drive shaft and the sleeve with one another when the drive shaft is rotated in the first direction;

wherein the housing is configured to be removably joined with the first surface of the crossbow frame via a plurality of first fasteners secured to the crossbow frame, wherein the one-way bearing is inside the housing but is external to the crossbow frame when the housing is removably joined with the crossbow frame via the plurality of first fasteners secured to the crossbow frame.

8. The crossbow crank of claim 6, wherein the crank module includes a single crank arm mount so that a crank arm can be operatively joined with the crossbow crank at only the single crank arm mount.

9. The crossbow crank of claim 6, comprising:

a drive nut threadably joined with the drive shaft, the drive nut rotatably disposed in the housing opposite the mounting plate;

a crank arm joined with the drive nut, wherein the drive shaft is configured to extend through the transverse crank mounting hole such that the drive shaft protrudes beyond the first surface and the second surface.

10. The crossbow crank of claim 6, comprising:

wherein the drive shaft is configured to extend through the transverse crank mounting hole defined by the crossbow frame such that the drive shaft protrudes beyond the first surface and the second surface;

wherein the housing and mounting plate are configured to be reversed so that the housing is able to be removably joined with the second surface and the mounting plate is able to be removably joined with the first surface.

11. A crossbow crank for a crossbow including a crossbow frame defining a transverse crank mounting hole, with a spool and first secondary gear mounted in the crossbow frame, the crossbow crank comprising:

a sleeve disposed in a one-way bearing;

a drive shaft extending through the sleeve and configured to extend within the transverse crank mounting hole;

a second drive gear joined with the drive shaft; a first drive gear joined with the drive shaft so the first drive gear and drive shaft rotate in unison, the first drive gear configured to engage a first secondary gear joined with a spool in the crossbow frame; and a crank joined with the drive shaft, wherein the sleeve, one way bearing, and drive shaft are removable from the transverse crank mounting hole together in unison in the form of a crank module, wherein the crank module is configured to be reversed and reinstalled in the transverse crank mounting hole in an opposite direction, whereby the crank module is selectively mountable relative to the crossbow frame on either a right side or a left side of the crossbow frame to provide a user with the ability to operate the crossbow crank with a crank arm in a draw mode from the right side or the left side of the crossbow frame, wherein the crank module is mountable in a first direction in the transverse crank mounting hole, such that the first drive gear is configured to engage a first secondary gear joined with a spool in the crossbow frame, and such that the second drive gear is configured to engage a second secondary gear joined with the spool in the crossbow frame, wherein the crank module is configured to be reversed and reinstalled the opposite direction to the first direction in the transverse crank mounting hole, such that the first drive gear is configured to engage the second secondary gear joined with a spool in the crossbow frame, and such that the second drive gear is configured to engage the first secondary gear joined with the spool in the crossbow frame.

12. A method of using a crossbow crank, the method comprising:

removing a crank module from a first surface of a crossbow frame defining a crank mounting hole, the crank module comprising a sleeve disposed in a one-way bearing, a drive shaft extending through the sleeve, and a drive gear configured to rotatably couple with a spool rotatably mounted inside the crossbow frame; and installing the crank module through a second surface of the crossbow frame opposite the first surface so that the crank module extends through the crank mounting hole.

13. The method of claim 12, comprising:

rotating the drive shaft in a first direction; and axially compressing a brake along the drive shaft to fixedly join the drive shaft with the sleeve disposed around the drive shaft so that the drive shaft, drive gear and sleeve rotate in unison in the first direction;

wherein the sleeve is disposed in the one-way bearing so that when said rotating in the first direction ceases, the drive shaft and drive gear are impaired from rotating in a second direction opposite the first direction via the one-way bearing interacting with the sleeve.

14. The method of claim 13, comprising:

winding a cord on the spool inside the crossbow frame; and pulling a moving receiver including a trigger latch along the crossbow frame toward the spool as the cord winds on the spool.

15. The method of claim 12, comprising:

removing a housing within which the drive shaft extends from the first surface of the crossbow frame;

removing a mounting plate from the second surface of the crossbow frame;

securing the mounting plate to the first surface of the crossbow frame;

securing the housing to the second surface of the crossbow frame.

16. The method of claim 12, comprising:

disengaging the drive gear from a first secondary gear joined with the spool during said removing; and engaging the drive gear with a second secondary gear joined with the spool during said installing, the second secondary gear being distal from the first secondary gear.

* * * * *